United States Patent [19]

Takada et al.

[11] Patent Number: 5,061,614

[45] Date of Patent: Oct. 29, 1991

[54] SILVER HALIDE EMULSION, METHOD OF MANUFACTURING THE SAME, AND COLOR PHOTOGRAPHIC LIGHT-SENSITIVE MATERIAL USING THE EMULSION

[75] Inventors: Shunji Takada; Hideki Naito; Yuichi Ohashi; Seiji Yamashita; Shigeru Shibayama; Shigeo Hirano, all of Minami-Ashigara, Japan

[73] Assignee: Fuji Photo Film Co., Ltd., Kanagawa, Japan

[21] Appl. No.: 372,525

[22] Filed: Jun. 27, 1989

[30] Foreign Application Priority Data

Jun. 28, 1988 [JP] Japan ..... 63-159888
Oct. 14, 1988 [JP] Japan ..... 63-258787

[51] Int. Cl.[5] ..... G03C 1/36

[52] U.S. Cl. ..... 430/569; 430/606; 430/607; 430/609; 430/611

[58] Field of Search ..... 430/567, 569, 603, 611, 430/606, 607, 609

[56] References Cited

U.S. PATENT DOCUMENTS

| | | | |
|---|---|---|---|
| 3,047,393 | 7/1962 | Herz et al. | 96/109 |
| 3,957,490 | 5/1976 | Libeer et al. | 96/94 R |
| 4,276,374 | 6/1981 | Mifune et al. | 430/603 |
| 4,797,354 | 1/1989 | Saitou et al. | 430/567 |
| 4,814,264 | 3/1989 | Kishida et al. | 430/567 |
| 4,839,268 | 6/1989 | Bando | 430/567 |
| 4,853,322 | 8/1989 | Makino et al. | 430/567 |
| 4,960,689 | 10/1990 | Nishikawa et al. | 430/603 |

OTHER PUBLICATIONS

Z. Wiss. Photo. 63, 133 (1969).

*Primary Examiner*—Hoa V. Le
*Attorney, Agent, or Firm*—Birch, Stewart, Kolasch & Birch

[57] ABSTRACT

A silver halide emulsion manufactured by performing reduction sensitization and addition of at least one compound selected from the group consisting of compounds represented by formulas [I], [II], and [III] during the silver halide grain formation in a process of manufacturing silver halide emulsions:

$$R—SO_2S—M \quad [I]$$

$$R—SO_2S-R^1 \quad [II]$$

$$RSO_2S—L_m—SSO_2—R^2 \quad [III]$$

wherein R, $R^1$, and $R^2$ can be the same or different and represent an aliphatic group, an aromatic group, or a heterocyclic group, M represents a cation, L represents a divalent bonding group, m represents 0 or 1, compounds represented by formulas [I] to [III] can be polymers containing, as a repeating unit, divalent groups derived from compounds represented by formulas [I] to [III], and, if possible, R, $R^1$, $R^2$ and L can be bonded with each other to form a ring.

18 Claims, No Drawings

SILVER HALIDE EMULSION, METHOD OF MANUFACTURING THE SAME, AND COLOR PHOTOGRAPHIC LIGHT-SENSITIVE MATERIAL USING THE EMULSION

BACKGROUND OF THE INVENTION

1. Field of the Invention

The present invention relates to a method of manufacturing a silver halide emulsion having high sensitivity and producing low fog and also relates to an emulsion and a silver halide light-sensitive material with high sensitivity and good graininess.

2. Description of the Related Art

Basic properties required for a photographic silver halide emulsion are high sensitivity, low fog, and fine graininess.

In order to increase the sensitivity of an emulsion the following is required, (1) increase the number of photons absorbed by a single grain; (2) increase the efficiency of converting photoelectrons generated by light absorption into a silver cluster (latent image); and (3) increase development activity for effectively utilizing the obtained latent image. Increasing the size increases the number of photons absorbed by a single grain but degrades image quality. Increasing the development activity is an effective means of increasing the sensitivity. In the case of parallel development as color development, however, the graininess is generally degraded. In order to increase the sensitivity without graininess degradation, it is most preferable to increase the efficiency of converting photoelectrons into a latent image, i.e., increase a quantum sensitivity. In order to increase the quantum sensitivity, low-efficiency processes such as recombination and latent image dispersion must be minimized. It is known that a reduction sensitization method of forming a small silver nucleus without development activity inside or on the surface of a silver halide is effective to prevent recombination.

James et al. have found that the sensitivity can be increased with a lower fog level than that in normal reduction sensitization when a kind of reduction sensitization, in which a coating film of an emulsion subjected to gold-plus-sulfur sensitization is vacuum-deaerated and then heat-treated in a hydrogen atmosphere, is performed. This sensitization method is well known as hydrogen sensitization and is effective as a lab-scale high sensitization means. The hydrogen sensitization is actually used in the field of astrograph.

Methods of reduction sensitization have been studied for a long time. Carroll, Lowe et al., and Fallens et al. disclose that a tin compound, a polyamine compound, and a thiourea dioxide-based compound are effective as a reduction sensitizer in U.S. Pat. Nos. 2,487,850 and 2,512,925 and British Patent 789,823, respectively. Collier compares properties of silver nuclei formed by various reduction sensitization methods in "Photographic Science and engineering", Vol. 23, P. 113 (1979) She used methods of dimethylamineborane, stannous chloride, hydrazine, high-pH ripening, and low-pAg ripening. Reduction sensitization methods are also disclosed in U.S. Pat. Nos. 2,518,698, 3,201,254, 3,411,917, 3,779,777, and 3,930,867. Not only selection of a reduction sensitizer but also a method of using a reducing agent are disclosed in, e.g., JP-B-57-33572 ("JP-B-" means examined Japanese patent application), JP-B-58-1410, and JP-A-57-179835 ("JP-A-" means unexamined published Japanese patent application)

Techniques of improving storage stability of an emulsion subjected to reduction sensitization are disclosed in JP-A-57-82831 and JP-A-60-178445. Regardless of a number of studies as described above, an increase in sensitivity is insufficient as compared with that obtained in hydrogen sensitization in which a light-sensitive material is treated with hydrogen gas in a vacuum. This is reported by Moisar et al. in "Journal of Imaging Science", Vol. 29. P. 233 (1985).

The conventional techniques of reduction sensitization are insufficient to satisfy a recent demand for a photographic light-sensitive material with high sensitivity and high image quality. The hydrogen sensitizing means also has a drawback in which a sensitizing effect is lost when a light-sensitive material is left in air after hydrogen sensitization. Therefore, it is difficult to utilize this sensitization method to prepare a photographic light-sensitive material for which no special apparatus can be used.

SUMMARY OF THE INVENTION

It is a first object of the present invention to provide a method of manufacturing an emulsion with high sensitivity and good graininess and an emulsion with high sensitivity and low fog.

It is a second object of the present invention to provide a photographic light-sensitive material with high sensitivity and good graininess and a photographic light-sensitive material with high sensitivity and low fog.

It is a third object of the present invention to provide a color light-sensitive material with high sensitivity and good graininess and a color light-sensitive material with high sensitivity and low fog.

It is a fourth object of the present invention to provide a silver halide color photographic light-sensitive material having high sensitivity, good graininess and sharpness, and an improved response to stress.

The objects of the present invention are achieved by the silver halide emulsion, the methods of manufacturing the same, and the color photographic light-sensitive material using the same described in items (1) to (9) below.

(1) A silver halide emulsion manufactured by performing reduction sensitization and addition of at least one compound selected from the group consisting of compounds represented by formulas [I], [II], and [III] are performed in a process of manufacturing silver halide emulsions:

$$R—SO_2S—M \quad [I]$$

$$R—SO_2S—R^1 \quad [II]$$

$$RSO_2S—L_m—SSO_2—R^2 \quad [III]$$

wherein R, $R^1$, and $R^2$ can be the same or different and represent an aliphatic group, an aromatic group, or a heterocyclic group, M represents a cation, L represents a divalent bonding group, m represents 0 or 1, compounds represented by formulas [I] to [III] can be polymers containing, as a repeating unit, divalent groups derived from compounds represented by formulas [I] to [III], and, if possible, R, $R^1$, $R^2$ and L can be bonded with each other to form a ring.

(2) The emulsion as in item (1), wherein said reduction sensitization is performed in the presence of at least one compound selected from the group consisting of compounds represented by formulas [I], [II], and [III].

(3) The emulsion as in item (1), wherein said reduction sensitization is performed in the presence of at least one compound selected from the group consisting of compounds represented by formulas [I], [II], and [III] during precipitation of silver halide grains.

(4) The emulsion as in item (1), wherein not less than 50% of a total projected area of all silver halide grains are occupied by tabular grains having an aspect ratio of 3 to 8.

(5) A silver halide color photographic light-sensitive material comprising a support having thereon at least one silver halide emulsion layer comprising a silver halide emulsion reduction sensitized in the presence of at least one compound represented by formulas [I], [II], and [III], in which at least 50% of a total projected area of all silver halide grains in the emulsion layer are occupied by tabular silver halide grains and an average aspect ratio of the tabular silver halide grains occupying 50% is not less than 3.0.

(6) The silver halide color photographic light-sensitive material as in item (5), wherein the average aspect ratio of the tabular silver halide grains is 3 to 20.

(7) The silver halide color photographic light-sensitive material as in item (5), wherein the average aspect ratio of the tabular silver halide grains is 4 to 15.

(8) The silver halide color photographic light-sensitive material as in item (5), wherein the average aspect ratio of the tabular silver halide grains is 5 to 10.

(9) The silver halide color photographic light-sensitive material as in item (5), wherein tabular silver halide grains having an average aspect ratio of 3 to 20 occupies not less than 50% of a total projected surface area of all silver halide grains.

DETAILED DESCRIPTION OF THE INVENTION

The present invention will be described in detail below.

Processes of manufacturing silver halide emulsions are roughly classified into, e.g., grain formation, desalting, chemical sensitization, and coating steps. Grain formation is further classified into e.g. nuclation, ripening, and precipitation substeps. These steps are performed not in the above-mentioned order but in a reverse order or repeatedly. "To perform reduction sensitization in a process of manufacturing silver halide emulsions" means that reduction sensitization can be basically performed in any step. The reduction sensitization can be performed during nuclation or physical ripening in the initial stage of grain formation, during precipitation, or before or after chemical sensitization e.g. gold sensitization, and/or sulfur sensitization, or selenium sensitization. In the case of performing chemical sensitization including gold sensitization, the reduction sensitization is preferably performed before the chemical sensitization so as not to produce undesired fog. The reduction sensitization is most preferably performed during precipitation of silver halide grains. The method of performing the reduction sensitization during precipitation includes a method of performing the reduction sensitization while silver halide grains are grown by physical ripening or addition of a water-soluble silver salt and a water-soluble alkali halide and a method of performing the reduction sensitization while grain precipitation is temporarily stopped and then precipitating grains.

The reduction sensitization of the present invention can be selected from a method of adding a known reducing agent in a silver halide emulsion, a method called silver ripening in which precipitating or ripening is performed in a low-pAg atmosphere of a pAg of 1 to 7, and a method called high-pH ripening in which precipitating or ripening is performed in a high-pH atmosphere of a pH of 8 to 11. These methods can be used in a combination of two or more thereof.

A method of adding a reduction sensitizer is preferable because the level of reduction sensitization can be precisely adjusted.

Known examples of the reduction sensitizer are stannous salt, amines and polyamines, a hydrazine derivative, formamidinesulfinic acid, a silane compound, and a borane compound. In the present invention, these known compounds can be used singly or in a combination of two or more thereof. Preferable compounds of the reduction sensitizer are stannous chloride, thiourea dioxide, and dimethylamineborane. An addition amount of the reduction sensitizer depends on emulsion manufacturing conditions and therefore must be selected to satisfy the desired conditions. A preferable addition amount falls within the range of $10^{-7}$ to $10^{-3}$ per mol of a silver halide.

The reduction sensitizer can be dissolved in water or in a solvent, e.g., glycols, ketones, esters, or amides and then added during grain formation, or before or after chemical sensitization. Although the reduction sensitizer can be added in any step of emulsion manufacturing process, it is most preferably added during grain precipitation. The reduction sensitizer is preferably added at an arbitrary timing during grain formation though it can be added in a reaction vessel beforehand. In addition, the reduction sensitizer can be added in an aqueous solution of a water-soluble silver salt or water-soluble alkali halide to perform grain formation by using the aqueous solution. A method of adding a solution of the reduction sensitizer several times or continuously adding it over a long time period during grain growth is also preferable.

Thiosulfonic acid compounds represented by formulas [I], [II], and [III] will be described in more detail below. When R, $R^1$, and $R^2$ each represent an aliphatic group, it is a saturated or unsaturated, straight-chain, branched or cyclic aliphatic hydrocarbon group and is preferably alkyl having 1 to 22 carbon atoms or alkenyl or alkynyl having 2 to 22 carbon atoms. These groups can have a substituent group. Examples of the alkyl are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl are allyl and butenyl.

Examples of the alkinyl are propargyl and butynyl.

An aromatic group of R, $R^1$, and $R^2$ includes aromatic group of single-ring or condensed-ring and preferably has 6 to 20 carbon atoms. Examples of such an aromatic group are phenyl and naphthyl. These groups can have substituent group.

A heterocyclic group of R, $R^1$, and $R^2$ includes a 3- to 15-membered ring having at least one element of nitrogen, oxygen, sulfur, selenium, and tellurium and at least one carbon atom, preferably, a 3- to 6-membered ring. Examples of the heterocyclic group are pyrrolidine, piperidine, pyridine, tetrahydrofurane, thiophene, oxazole, thiazole,, imidazole, benzothiazole, benzoxazole, benzimidazole, selenazole, benzoselenazole, tellurazole, triazole, benzotriazole, tetrazole, oxadiazole, and thiadiazole.

Examples of the substituent group on R, $R^1$, and $R^2$ are an alkyl group (e.g., methyl, ethyl, and hexyl), an alkoxy group (e.g., methoxy, ethoxy, and octyloxy), an aryl group (e.g., phenyl, naphthyl, and tolyl), a hydroxyl group, a halogen atom (e.g., fluorine, chlorine, bromine, and iodine), an aryloxy group (e.g. phenoxy), an alkylthio group (e.g., methylthio and butylthio), an arylthio group (e.g. phenylthio), an acyl group (e.g. acetyl, propionyl, butyryl, and valeryl), a sulfonyl group (e.g. methyl sulfonyl and phenylsulfonyl), an acylamino group (e.g., acetylamino and benzaoylmino), a sulfonylamino group (e.g., methanesulfonylamino group and benzenesulfonylamino), an acyloxy group (e.g., acetoxy and benzoxy), carboxyl, cyano, sulfo, amino, $-SO_2SM$ (M represent a monovalent cation), and $-SO_2R^1$.

A divalent bonding group represented by L includes an atom or an atom group containing at least one of C, N, S, and O. Examples of L are alkylene, alkenylene, alkynylene, arylene, —O—, —S—, —NH—, —CO—, and $-SO_2-$. These divalent group can be used singly or in a combination of two or more thereof.

Preferably L represent divalent aliphatic group or a divalent aromatic group. Examples of the divalent aliphatic of L are $\text{-}(CH_2)_n\text{-}$ (n=1 to 12), $-CH_2-CH=CH-CH_2-$, $-CH_2C\equiv CCH_2-$,

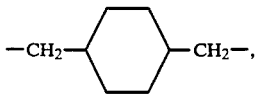

and xylylene. Examples of the divalent aromatic group of L are phenylene and naphthylene.

These substituent groups can have any further substituent group as mentioned above.

M is preferably a metal ion or an organic cation. Examples of the metal ion are a lithium ion, a sodium ion, and a potassium ion. Examples of the organic cation are an ammonium ion (e.g., ammonium, tetramethylammonium, and tetrabutylammonium), a phosphonium ion (e.g. tetraphenylphosphonium), and a guanidil group.

When a compound represented by each of formulas [I] to [III] is a polymer, examples of its repeating unit are as follows:

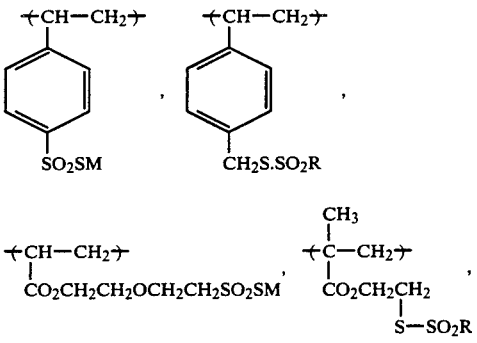

-continued

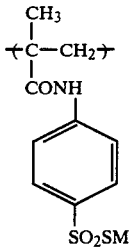

Each of the above polymers can be a homopolymer or a copolymer with another copolymerizable monomer.

Examples of a compound represented by formula [I], [II], or [III] are listed in Table A to be presented later. However, compounds are not limited to those in Table A.

Compounds represented by formulas [I], [II], and [III] can be easily synthesized by methods described or cited in JP-A-54-1019; British Patent 972,211; "Journal of Organic Chemistry", Vol. 53, PP. 396 (1988); and "Chemical Abstracts", Vol. 59, 9776e.

A preferable addition amount of a compound represented by formula [I], [II], or [III] is $10^{-7}$ to $10^{-1}$ mol per mol of a silver halide. The addition amount is more preferably $10^{-6}$ to $10^{-2}$ and most preferably $10^{-5}$ to $10^{-3}$ mol/mol of Ag.

A conventional method of adding an additive in a photographic emulsion can be adopted to add compounds represented by formulas [I] to [III] in manufacturing process. For example, a water-soluble compound can be added in the form of an aqueous solution having an arbitrary concentration, and a water-insoluble or water-retardant compound is dissolved in an arbitrary organic solvent such as alcohols, glycols, ketones, esters, and amides, which is miscible with water and does not adversely affect photographic properties, and then added as a solution.

A compound represented by formula [I], [II], or [III] can be added at any timing during grain formation of a silver halide emulsion, or before or after chemical sensitization. The compound is preferably added before or during reduction sensitization. The compound is most preferably added during precipitation steps.

Although the compound can be added in a reaction vessel beforehand, it is preferably added at an arbitrary timing during grain formation. In addition, a compound represented by formula [I], [II], or [III] can be added in an aqueous solution of a water-soluble silver salt or water-soluble alkali halide to perform grain formation by using the aqueous solution. A method of adding a solution of a compound represented by formula [I], [II], or [III] several times or continuously adding it over a long time period during grain formation is also preferable.

A compound most preferable in the present invention is represented by formula [I].

In a tabular silver halide emulsion subjected to reduction sensitization in the presence of a thiosulfonic acid compound used in the present invention, an aspect ratio means a ratio of a diameter with respect to a thickness of a silver halide grain. That is, the aspect ratio is a value obtained by dividing the diameter of each silver halide grain by its thickness. In this case, the diameter is a diameter of a circle having an area equal to a projected area of a grain upon observation of a silver halide emulsion by a microscope or electron microscope. Therefore, "the aspect ratio is 3 or more" means the diameter of a circle is three times or more the thickness of a grain.

An average aspect ratio is obtained as follows. That is, 1,000 silver halide grains of the emulsion are extracted at random to measure their aspect ratios, tabular grains corresponding to 50% of a total projected area are selected from those having larger aspect ratios, and an arithmetical mean of aspect ratios of the selected tabular grains is calculated. An average of a diameter or thickness of the tabular grains used to calculate the aspect ratio corresponds to an average grain size or average grain thickness.

An example of an aspect ratio measuring method is a method of photographing a transmission electron micrograph by a replica technique to obtain a sphere-equivalent diameter and a thickness of each grain. In this case, the thickness is calculated from the length of a shadow of the replica.

In the silver halide emulsion manufactured by performing reduction sensitization and addition of at least one of compounds represented by formulas [I], [II], and [III] in a process of manufacturing silver halide emulsions, preferably, tabular grains having aspect ratio of 3 to 8 account for 50% or more of the total projected area of all silver halide grains in the silver halide emulsion.

In the tabular silver halide grains subjected to reduction sensitization in the presence of a thiosulfonic acid compound used in the present invention, the average aspect ratio is 3.0 or more, preferably 3 to 20, and more preferably, 4 to 15, and most preferably, 5 to 10. The tabular silver halide grains in one emulsion layer account for 50% or more, preferably 70% or more, and more preferably 85% or more, of the total projected area of all silver halide grains of said emulsion layer.

A silver halide photographic light-sensitive material having good sharpness can be obtained by using such an emulsion. The sharpness is good because a degree of light scattering caused by an emulsion layer using the above emulsion is much smaller than that of a conventional emulsion layer. This can be easily confirmed by experimental method ordinarily used by those skilled in the art. The reason why the light scattering degree of an emulsion layer using the tabular silver halide emulsion is small is not clear. However, it can be considered that a major surface of the tabular silver halide emulsion grain is oriented parallel to the surface of a support.

The average grain size of the tabular silver halide grains subjected to reduction sensitization in the presence of a thiosulfonic acid compound used in the present invention is 0.2 to 10.0 μm, preferable, 0.3 to 5.0 μm, and more preferably, 0.4 to 3.0 μm. The average grain thickness is preferably 0.5 μm or less. In a most preferable silver halide photographic emulsion, the average grain size is 0.4 to 3.0 μm, the average grain thickness is 0.5 μm or less, and 85% or more of a total projected area of all silver halide grains are occupied by tabular grains.

The tabular silver halide grain subjected to reduction sensitization in the presence of a thiosulfonic acid compound used in the present invention can comprise any of silver chloride, silver bromide, silver chlorobromide, silver iodobromide, and silver chloroiodobromide. More preferable examples are silver bromide, silver iodobromide having 20 mol % or less of silver iodide, and silver chloroiodobromide and silver chlorobromide having 50 mol % or less of silver chloride and 2 mol % or less of silver iodide. In a mixed silver halide, a composition distribution can be uniform or localized.

A grain size distribution can be narrow or wide.

Tabular silver halide emulsions which can be reduction sensitized in the presence of a thiosulfonic acid compound used in the present invention are described in reports by Cugnac and Chateau, Duffin, "Photographic Emulsion Chemistry" (Focal Press, New York, 1966), PP. 66 to 72, and A. P. H. Trivelli, W. F. Smith ed., "Phot. Journal" 80 (1940), P. 285. However, these emulsions can be easily prepared by methods described in JP-A-58-113927, JP-A-58-113928, and JP-A-58-127921.

For example, the emulsion can be prepared by forming a seed crystal comprising 40% (by weight) or more of tabular grains in a comparatively-high-pAg atmosphere in which a pBr is 1.3 or less, and simultaneously adding silver and halogen solutions to grow the seed crystal while the pBr value is maintained at the substantially same level. In this grain precipitation process, it is preferred to add the silver and halogen solutions so that no new crystal nucleus is generated.

The size of the tabular silver halide grain subjected to reduction sensitization in the presence of a thiosulfonic acid compound used in the present invention can be adjusted by controlling a temperature, selecting the type or quality of a solvent, and controlling the rates of additives of silver salts and halides used in grain precipitation.

A silver halide which can be used in combination with a light-sensitive material of the present invention can be any of silver bromide, silver iodobromide, silver iodochlorobromide, silver chlorobromide, and silver chloride. A preferable silver halide is silver iodobromide containing 30 mol % or less of silver iodide, silver bromide, or silver chlorobromide.

A silver halide grain which can be used in combination with the silver halide emulsion of the present invention can be selected from a regular crystal not including a twined crystal plane and grain including a twined crystal plane described in Japan Photographic Society ed., "Silver Salt Photographs, Basis of Photographic Industries", (Corona Co., P. 163) such as a single twined crystal including one twined crystal face, a parallel multiple twined crystal including two or more parallel twined crystal faces, and a nonparallel multiple twined crystal including two or more non-parallel twined crystal faces in accordance with its application. In the case of a regular crystal, a cubic grain comprising (100) faces, an octahedral grain comprising (111) faces, and a dodecahedral grain comprising (110) faces disclosed in JP-B-55-42737 and JP-A-60-222842 can be used. In addition, a grain comprising (h11), e.g., (211) faces, a grain comprising (hh1), e.g., (331) faces, a grain comprising (hk0), e.g., (210) faces, and a grain comprising (hk1), e.g., (321) faces as reported in "Journal of Imaging Science", Vol. 30, P. 247, 1986 can be selectively used in accordance with an application although a preparation method must be improved. A grain including two or more types of faces, e.g., a tetradecahedral grain comprising both (100) and (111) faces, a grain comprising both (100) and (110) faces, and a grain comprising both (111) and (110) faces can be selectively used in accordance with an application.

These silver halide grains can be fine grains having a grain size of 0.1 microns or less or large grains having a projected area diameter of up to 10 microns. The emulsion can be a monodisperse emulsion having a narrow distribution or a polydisperse emulsion having a wide distribution.

A so-called monodisperse silver halide emulsion having a narrow size distribution, i.e., in which 80% or more (the number or weight of grains) of all grains fall within the range of ±30% of an average grain size can be used in the present invention. In order to obtain a target gradation of a light-sensitive material, two or more types of monodisperse silver halide emulsions having different grain sizes can be coated in a single layer or overlapped in different layers in emulsion layers having substantially the same color sensitivity. Alternatively, two or more types of polydisperse silver halide emulsions or a combination of monodisperse and polydisperse emulsions can be mixed or overlapped.

The photographic emulsions for use in the present invention can be prepared using the methods described in, for example, P. Glafkides, "Chimie et Physique Photographique", Paul Montel, 1967; Duffin, "Photographic Emulsion Chemistry", Focal Press, 1966; and V. L. Zelikman et al., "Making and Coating the photographic emulsion can be prepared by, for example, an acid method, a neutralization method, and an ammonia method. Also, as a system for reacting a soluble silver salt and a soluble halide, a single mixing method, a double mixing method, or a combination thereof can be used. Also, a so-called back mixing method for forming silver halide grains in the presence of excessive silver ions can be used. As one system of the double mixing method, a so-called controlled double jet method, wherein the pAg in the liquid phase in which the silver halide is generated is kept at a constant value can be used. According to this method, a silver halide emulsion having a regular crystal form and almost uniform grain sizes is obtained.

The silver halide emulsion containing the above-described regular silver halide grains can be obtained by controlling the pAg and pH during grain formation. More specifically, such a method is described in "Photographic Science and Engineering", Vol. 6, 159–165 (1962); "Journal of Photographic Science", Vol. 12, 242–251 (1964); U.S. Pat. No. 3,655,394, and British Patent 1,413,748.

A tabular grain having an aspect ratio of 3 or more and not being subjected to reduction sensitization in the presence of the thiosulfonic acid compound, can also be used in the present invention. The tabular grain can be easily prepared by methods described in, for example, Cleve, "Photography Theory Science and Engineering", Vol. 14, PP. 248 to 257, (1970); and U.S. Pat. Nos. 4,434,226, 4,414,310, 4,433,048 and 4,439,520 and British Patent 2,112,157. When the tabular grain is used, sharpness, covering power and a color sensitizing efficiency of a sensitizing dye can be advantageously improved as described in detail e.g. U.S. Pat. No. 4,434,226.

The silver halide emulsion of the present invention preferably has a distribution or structure of a halogen composition in its grain. A typical example is a core-shell type or double structured grain having different halogen compositions in the interior and surface layer of the grain as disclosed in, e.g., JP-B-43-13162, JP-A-61-215540, JP-A-60-222845, and JP-A-61-75337. In such a grain, the shape of a core portion is sometimes identical to or sometimes different from that of the entire grain with a shell. More specifically, while the core portion is cubic, the grain with a shell is sometimes cubic or sometimes octahedral. On the contrary, while the core portion is octahedral, the grain with a shell is sometimes cubic or sometimes octahedral. In addition, while the core portion is a clear regular grain, the grain with a shell is sometimes slightly deformed or sometimes does not have any definite shape. Furthermore, not a simple double structure but a triple structure as disclosed in JP-A-60-222844 or a multilayered structure of more layers can be formed, or a thin film of a silver halide having a different composition can be formed on the surface of a core-shell double structure grain.

In order to give a structure inside the grain, a grain having not only the above surrounding structure but a so-called junction structure can be made. Examples of such a grain are disclosed in, e.g., JP-A-59-133540, JP-A-58-108526, EP 199290A2, JP-B-58-24772, and JP-A-59-16254. A crystal to be bonded having a composition different from that of a host crystal can be produced and bonded to an edge, corner, or face portion of the host crystal. Such a junction crystal can be formed regardless of whether the host crystal has a homogeneous halogen composition or a core-shell structure.

The junction structure can be naturally made by a combination of silver halides. In addition, the junction structure can be made by combining a silver salt compound not having a rock salt structure, e.g., silver rhodanate or silver carbonate with a silver halide. A non-silver salt compound such as PbO can also be used as long as the junction structure can be made.

In a silver iodobromide grain having the above structure, e.g., in a core-shell type grain, the silver iodide content may be high at a core portion and low at a shell portion or vice versa. Similarly, in a grain having the junction structure, the silver iodide content may be high in a host crystal and relatively low in a junction crystal or vice versa.

In a grain having the above structure, a boundary portion between different halogen compositions may be clear or unclear due to a crystal mixture formed by a composition difference. Alternatively, a continuous structural change may be positively made.

The silver halide emulsion for use in the present invention can be subjected to a treatment for rounding a grain as disclosed in, e.g., EP-0096727B1 and EP-0064412B1 or a treatment of modifying the surface of a grain as disclosed in DE-2306447C2 and JP-A-60-221320.

The silver halide emulsion for use in the present invention is preferably a surface latent image type. An internal latent image type emulsion, however, can be used by selecting a developing solution or development conditions as disclosed in JP-A-59-133542. In addition, a shallow internal latent image type emulsion covered with a thin shell can be used in accordance with an application.

A silver halide solvent can be effectively used to promote ripening. For example, in a known conventional method, an excessive amount of halogen ions are supplied in a reaction vessel in order to promote ripening. Therefore, it is apparent that ripening can be promoted by only supplying a silver halide solution into a reaction vessel. In addition, another ripening agent can be used. In this case, a total amount of these ripening agents can be mixed in a dispersion medium in the reaction vessel before a silver salt and a halide are added therein, or they can be added in the reaction vessel together with one or more halides, a silver salt or a deflocculant. Alternatively, the ripening agents can be added in separate steps together with a halide and a silver salt.

Examples of the ripening agent other than the halogen ion are ammonium, an amine compound and a thiocyanate such as an alkali metal thiocyanate, especially sodium or potassium thiocyanate and ammonium thiocyanate.

In the present invention, it is very important to perform chemical sensitization, typically sulfur sensitization or gold sensitization. A timing of the chemical sensitization differs depending on the composition, structure, or shape of an emulsion grain or an application of the emulsion. That is, a chemical sensitized nucleus is embedded either inside a grain or in a shallow portion from the grain surface or formed on the surface of a grain. Although the present invention is effective in any case, the chemical sensitized nucleus is most preferably formed in a portion near the surface. That is, the present invention is more effective in the surface sensitive emulsion than in the internally sensitive emulsion.

Chemical sensitization can be performed by using active gelatin as described in T. H. James, "The Theory of the Photographic Process", 4th ed., Macmillan, 1977, PP. 67 to 76. Alternatively, chemical sensitization can be performed at a pAg of 5 to 10, a pH of 5 to 8 and a temperature of 30° to 80° C. by using sulfur, selenium, tellurium, gold, platinum, palladium or irridium, or a combination of a plurality of these sensitizers as described in Research Disclosure Vol. 120, No. 12,008 (April, 1974), Research Disclosure Vol. 34, No. 13,452 (June, 1975), U.S. Pat. Nos. 2,642,361, 3,297,446, 3,772,031, 3,857,711, 3,901,714, 4,266,018, and 3,904,415, and British Patent 1,315,755. Chemical sensitization is optimally performed in the presence of a gold compound and a thiocyanate compound, a sulfur-containing compound described in U.S. Pat. Nos. 3,857,711, 4,266,018 and 4,054,457 or a sulfur-containing compound such as a hypo, thiourea compound and a rhodanine compound. Chemical sensitization can also be performed in the presence of a chemical sensitization aid. An example of the chemical aid is a compound known to suppress fogging and increase sensitivity in the chemical sensitization process such as azaindene, azapyridazine, and azapyrimidine. Examples of a chemical sensitization aid modifier are described in U.S. Pat. Nos. 2,131,038, 3,411,914, 3,554,757, JP-A-58-126526 and G. F. Duffin, "Photographic Emulsion Chemistry", PP. 138 to 143.

The photographic emulsion of the present invention can contain various compounds in order to prevent fogging during manufacture, storage, or a photographic process of the light-sensitive material or to stabilize photographic properties. Examples of the compound known as an antifoggant or stabilizer are azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially, 1-phenyl-5-mercaptotetrazole); mercaptopyrimidines; mercaptotriadines; a thioketo compound such as oxadrinthione; azaindenes, e.g., triazaindenes, tetraazaindenes (especially, 4-hydroxy-substituted(1,3,3a,7)tetraazaindenes), and pentaazaindenes. Examples are described in U.S. Pat. Nos. 3,954,474 and 3,982,947 and JP-B-52-28660.

The photographic emulsion of the present invention can be spectrally sensitized by, e.g., methine dyes. Examples of the dye are a cyanine dye, merocyanine dye, a composite cyanine dye, a composite merocyanine dye, a holopolar cyanine dye, a hemicyanine dye, a styryl dye, and a hemioxonol dye. Most effective dyes are those belonging to a cyanine dye, a merocyanine dye, and a composite merocyanine dye. In these dyes, any nucleus normally used as a basic heterocyclic nucleus in cyanine dyes can be used. Examples of the nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus obtained by condensation of an alicyclic hydrocarbon ring to each of the above nuclei; and a nucleus obtained by condensation of an aromatic hydrocarbon ring to each of the above nuclei, e.g., an indolenine nucleus, a benzindolenine nucleus, an indole nucleus, a benzoxadole nucleus, a naphthooxazole nucleus, a benzothiazole nucleus, a naphthothiazole nucleus, a benzoselenazole nucleus, a benzimidazole nucleus, and a quinoline nucleus. These nuclei can have a substituent group on a carbon atom.

For a merocyanine dye or composite merocyanine dye, a 5- or 6-membered heterocyclic nucleus, e.g., a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus can be used as a nucleus having a ketomethylene structure.

These sensitizing dyes can be used singly or in a combination of two or more thereof. A combination of the sensitizing dyes is often used especially in order to perform supersensitization. Typical examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281 and 1,507,803, JP-B-43-4936 and JP-B-53-12375, and JP-A-52-110618 and JP-A-52-109925.

The emulsion can contain, in addition to the sensitizing dye, a dye not having a spectral sensitizing effect or a substance substantially not absorbing visible light and having supersensitization.

The dye can be added in the emulsion at any timing conventionally known to be effective in emulsion preparation. Most ordinarily, the dye is added after completion of chemical sensitization and before coating. However, the dye can be added at the same time as a chemical sensitizer to simultaneously perform spectral sensitization and chemical sensitization as described in U.S. Pat. Nos. 3,628,969 and 4,225,666, added before chemical sensitization as described in JP-A-58-113928, or added before completion of silver halide grain precipitation to start spectral sensitization. In addition, as described in U.S. Pat. No. 4,225,666, the above compound can be separately added such that a portion of the compound is added before chemical sensitization and the remaining portion is added thereafter. That is, as described in U.S. Pat. No. 4,183,756, the compound can be added at any timing during silver halide grain formation.

An addition amount can be $4\times10^{-6}$ to $8\times10^{-3}$ mol per mol of a silver halide. When silver halide grains have a preferable size of 0.2 to 1.2 μm, an addition amount of about $5\times10^{-5}$ to $2\times10^{-3}$ mol is more effective.

The above various additives are used in the light-sensitive material of the present invention. In addition to the above additives, however, various additives can be used in accordance with the desired applications.

These additives are described in Research Disclosures, Item 17643 (Dec. 1978) and Item 18716 (Nov. 1979) and they are summarized in the following table.

| | Additives | RD No. 17643 | RD No. 18716 |
|---|---|---|---|
| 1. | Chemical sensitizers | page 23 | page 648, right column |
| 2. | Sensitivity increasing agents | | page 648, right column |
| 3. | Spectral sensitizers, super sensitizers | pages 23–24 | page 648, right column to page 649, right column |
| 4. | Brighteners | page 24 | |
| 5. | Antifoggants and stabilizers | pages 24–25 | page 649, right column |
| 6. | Light absorbent, filter dye, ultraviolet absorbents | pages 25–26 | page 649, right column to page 650, left column |
| 7. | Stain preventing agents | page 25, right column | page 650, left to right columns |
| 8. | Dye image stabilizer | page 25 | |
| 9. | Hardening agents | page 26 | page 651, left column |
| 10. | Binder | page 26 | page 651, left column |
| 11. | Plasticizers, lubricants | page 27 | page 650, right column |
| 12. | Coating aids, surface active agents | pages 26–27 | page 650, right column |
| 13. | Antistatic agents | page 27 | page 650, right column |

In this invention, various color couplers can be used in the light-sensitive material. Specific examples of these couplers are described in above-described Research Disclosure, No. 17643, VII-C to G as patent references.

Preferred examples of a yellow coupler are described in, e.g., U.S. Pat. Nos. 3,933,501, 4,022,620, 4,326,024, and 4,401,752, JP-B-58-10739, and British Patents 1,425,020 and 1,476,760.

Preferred examples of a magenta coupler are 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,752,067, Research Disclosure No. 24220 (June 1984), JP-A-60-33552, Research Disclosure No. 24230 (June 1984), JP-A-60-43659, and U.S. Pat. Nos. 4,500,630 and 4,540,654.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EP 121,365A, U.S. Pat. Nos. 3,446,622, 4,333,999, 4,451,559, and 4,427,767, and EP 161,626A.

Preferable examples of a colored coupler for correcting additional, undesirable absorption of colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,211, and 4,367,282, and British Patent 2,102,173.

Couplers releasing a photographically useful residue upon coupling are also preferably used in the present invention. Preferable DIR couplers, i.e., couplers releasing a development inhibitor are described in the patents cited in the above-described Research Disclosure No. 17643, VII-F, JP-A-57-151944, JP-A-57-154234, JP-A-60-184243, and U.S. Pat. No. 4,248,962.

Preferable examples of a coupler imagewise releasing a nucleating agent or a development accelerator upon development are those described in British Patent 2,097,140, 2,131,188, and JP-A 59-157638 and JP-A-59-170840.

Other examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; DIR redox compound or DIR coupler described in, e.g., JP-A-60-185950 and JP-A-62-24252; couplers releasing a dye which turns to a colored form after being released described in European Patent No. 173,302A; bleaching accelerator releasing couplers described in, e.g., R.D. Nos. 11449 and 24241 and JP-A-61-201247; and a ligand releasing coupler described in, e.g., U.S. Pat. No. 4,553,477.

Although examples of the color coupler which can be used in the present invention will be presented in Table B, the color coupler is not limited to these examples.

The couplers for use in this invention can be used in the light-sensitive materials by various known dispersion methods.

Examples of a high-boiling solvent used in an oil-in-water dispersion method are described in, e.g., U.S. Pat. No. 2,322,027.

Examples of a high-boiling organic solvent to be used in the oil-in-water dispersion method and having a boiling point of 175° C. or more at normal pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthlate, and bis(1,1-diethylpropyl)phthalate), esters of phosphoric acid or phosphonic acid (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, di-2-ethylhexylphenylphosphonate), esters of benzoic acid (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), esters of aliphatic carboxylic acid (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of an loadable latex are described in U.S. Pat.

No. 4,199,363, West German Patent Application (OLS) Nos. 2,541,274 and 2,541,230, and the like.

The present invention can be applied to various color light-sensitive materials. Typical examples of the material are a color negative film for a general purpose or a movie, a color reversal film for a slide or a television, color paper, a color positive film, and color reversal paper.

When the present invention is used as a material for color photographing, the present invention can be applied to light-sensitive materials having various structures and to light-sensitive materials having combinations of various layer structures and special color materials.

Typical examples are: light-sensitive materials, in which a coupling speed of a color coupler or diffusibility is combined with a layer structure, as disclosed in, e.g., JP-B-47-49031, JP-B-49-3843, JP-B-50-21248, JP-A-59-58147, JP-A-59-60437, JP-A-60-227256, JP-A-61-4043, JP-A-61-43743, and JP-A-61-42657; light sensitive materials, in which a same-color-sensitive layer is divided into two or more layers, as disclosed in JP-B-49-15495 and U.S. Pat. No. 3843469; and light-sensitive materials, in which an arrangement of high- and low-sensitivity layers or layers having different color sensitivities is defined, as disclosed in JP-B-53-37017, JP-B-53-37018, JP-A-51-49027, JP-A-52-143016, JP-A-53-97424, JP-A-53-97831, JP-A-62-200350, and JP-A-59-177551.

Examples of a support suitable for use in this invention are described in the above-mentioned RD. No. 17643, page 28 and ibid., No. 18716, page 647, right column to page 648, left column.

The color photographic light-sensitive materials of this invention can be processed by the ordinary processes as described, for example, in above-described Research Disclosure, No. 17643, pages 28 to 29 and ibid., No. 18716, page 651, left column to right column.

A color developer used in developing of the light-sensitive material of the present invention is, preferably, an aqueous alkaline solution containing, as a main component, an aromatic primary amine-based color developing agent. As the color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides and p-toluenesulfonates thereof. These compounds can be used in a combination of two or more thereof in accordance with applications.

In general, the color developer contains a pH buffering agent such as a carbonate, a borate or a phosphate of an alkali metal, and a development restrainer or antifoggant such as a bromide, an iodide, a benzimidazole, a benzothiazole or a mercapto compound. If necessary, the color developer can also contain a preservative such as hydroxylamine, diethylhydroxylamine, a hydrazine sulfite, a phenylsemicarbazide, triethanolamine, a catechol sulfonic acid or a triethylenediamine(1,4-diazabicyclo[2,2,2]octane); an organic solvent such as ethyleneglycol or diethyleneglycol; a development accelerator such as benzylalcohol, polyethyleneglycol, a quaternary ammonium salt or an amine; a dye forming coupler; a competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N'N'-tetramethylenephosphonic acid and ethylenediamine-di(o-hydroxyphenylacetic acid), and salts thereof.

In order to perform reversal development, generally, black-and-white development is performed and then color development is performed. For a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The pH of the color developer and the black-and-white developer is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing a bromide ion concentration in a replenishing solution. In the case of decreasing the replenishment the contact area of a processing tank with air is preferably decreased to prevent evaporation and oxidation of the solution upon contact with air. The replenishment amount can be also decreased by using a means capable of suppressing an accumulation amount of bromide ions in the developer.

The color development time is normally set between 2 to 5 minutes. The processing time, however, can be shortened by using a high temperature and a high pH and using the color developing agent at a high concentration.

The photographic emulsion layer is generally subjected to beaching after color development. The bleaching can be performed either simultaneously with fixing (bleach-fixing) or independently thereof. In addition, in order to increase processing speed, bleach-fixing can be performed after bleaching. Also, processing can be performed in a bleach-fixing bath having two continuous tanks, fixing can be performed before bleach-fixing, or bleaching can be performed after bleach-fixing, in accordance with the desired applications. Examples of the bleaching agent are a compound of a multivalent metal such as iron (III), cobalt (III), chromium (VI) and copper (II); a peroxide; a quinone; a nitro compound. Typical examples of the bleaching agent are a ferricyanide; a dichromate; an organic complex salt of iron (III) or cobalt (III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, or a complex salt of citric acid, tartaric acid or malic acid; a persulfate; a bromate; a permanganate; and a nitrobenzene. Of these compounds, an iron (III) complex salt of aminopolycarboxylic acid such as an iron (III) complex salt of ethylenediaminetetraacetic acid, and a persulfate are preferred because they can increase processing speed and prevent environmental contamination. Especially, the iron (III) complex salt of aminopolycarboxylic acid is effective in both the bleaching solution and bleach-fixing solution. The pH of the bleaching solution or the bleach-fixing solution using the iron (III) complex salt of aminopolycarboxylic acid is normally 5.5 to 8. In order to increase the processing speed, however, processing can be performed at a lower pH.

A bleaching accelerator can be used in the bleaching solution, the bleach-fixing solution and their pre-bath, if necessary. Examples of the effective bleaching accelerator are described in the following patent specifications: compounds having a mercapto group or a disulfide group described in. e.g., U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, and Research Disclosure No. 17,129 (July, 1978); a thiazolidine derivative described in JP-A-50-140129; thiourea derivatives described in JP-B-45-8506, JP-A-52-20832 and JP-A-53-32735, and U.S. Pat. No. 3,706,561; iodides described in West German Patent No. 1,127,715 and JP-A-58-16235; polyoxyethylene compounds described in West German Patent Nos. 966,410 and 2,748,430; a polyamine compound described in JP-B-45-8836; compounds described in JP-A-49-42434, JP-A-49-59644, JP-A-53-94927, JP-A-54-35727, JP-A-55-26506 and JP-A-58-163940; and a bromide ion. Of the above compounds, a compound having a mercapto group or a disulfide group is preferable because it has a good accelerating effect. In particular, the compounds described in U.S. Pat. No. 3,893,858, West German Patent No. 1,290,812, and JP-A-53-95630 are preferable. The compound described in U.S. Pat. No. 4,552,834 is also preferable. These bleaching accelerators can be added in the light-sensitive material. These bleaching accelerators are effective especially in bleach-fixing of a color light-sensitive material for photography.

Examples of the fixing agent are a thiosulfate, a thiocyanate, a thioether-based compound, a thiourea and a large amount of an iodide. Of these compounds, a thiosulfate, especially, ammonium thiosulfate can be used in a widest range of applications. As a preservative of the bleach-fixing solution, a sulfite, a bisulfite or a carbonyl bisulfite adduct is preferred.

The silver halide color photographic light-sensitive material of the present invention is normally subjected to washing and/or stabilizing steps after desilvering. An amount of water used in the washing step can be arbitrarily determined over a broad range depending on the properties of the light-sensitive material (e.g., a property determined by used substance such as a coupler), the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248–253 (May, 1955).

According to the above-described multi-stage counter-current scheme, the amount of water used for washing can be greatly decreased. Since washing water stays in the tanks for a long period of time, however, bacteria multiply and floating substances can be undesirably attached to the light-sensitive material. In order to solve this problem in the process of the color photographic light-sensitive material of the present invention, a method of decreasing calcium and magnesium ions can be very effectively utilized, as described in Japanese Patent Application No. 61-131632. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi, "Chemistry of Antibacterial and Antifungal Agents", Eiseigijutsu-Kai ed., "Sterilization, Antibacterial, and Antifungal Techniques for Microorganisms", and Nippon Bokin Bokabi Gakkai ed., "Cyclopedia of Antibacterial and Antifungal Agents".

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° to 45° C., and preferably, 30 seconds to 5 minutes at 25° to 40° C. The light-sensitive material of the present invention can be processed directly by a stabilizing solution in place of washing. All known methods described in JP-A-57-8543, JP-A-58-14834 and JP-A-60-220345 can be used in such stabilizing processing.

Further, stabilizing is sometimes performed subsequently to washing. An example is a stabilizing bath containing formalin and a surface-active agent to be used as a final bath of the color light-sensitive material for photographing. Various chelating agents and antifungal agents can be added also in the stabilizing bath.

An overflow liquid produced upon replenishment of the washing and/or stabilizing solution can be reused in another step such as a desilvering step.

The silver halide color light-sensitive material of the present invention can contain a color developing agent in order to simplify processing and increase the processing speed. For this purpose, it is preferred to use various precursors of the color developing agent. Examples are an indoaniline-based compound described in U.S. Pat. No. 3,342,597; Schiff base compounds described in U.S. Pat. No. 3,342,599 and Research Disclosure Nos. 14,850 and 15,159; an aldol compound described in Research Disclosure No. 13,924; a metal complex salt described in U.S. Pat. No. 3,719,492; and a urethane-based compound described in JP-A-53-135628.

The silver halide color light-sensitive material of the present invention can contain various 1-phenyl-3-pyrazolidones in order to accelerate color development, if necessary. Typical examples of the compound are described in JP-A-56-64339, JP-A-57-144547 and JP-A-58-115438.

Each processing solution in the present invention is used at a temperature of 10° to 50° C. Although a normal solution temperature is 33° to 38° C., processing can be accelerated at the higher temperature to shorten a processing time, or quality of image or stability of a processing solution can be improved at a lower temperature. In order to save silver for the light-sensitive material, processing using cobalt intensification or hydrogen peroxide intensification described in West German Patent No. 2,226,770 or U.S. Pat. No. 3,674,499 can be performed.

The silver halide light-sensitive material of the present invention can also be applied to heat development light-sensitive materials described in, e.g., U.S. Pat. No.

4,500,626, JP-A-60-133449, JP-A-59-218443, JP-A-61-238056, and EP 210,660A2.

The present invention will be described in more detail below by way of the following examples.

EXAMPLES

Example 1

A double twined crystal grain having an average iodide content of 20 mol % and an average sphere-equivalent diameter of 0.8 μm was used as a seed crystal to form an emulsion in an aqueous gelatin solution by a controlled double jet method, the emulsion comprising twined crystals having a core/shell ratio of 1:2, a shell iodide iode content of 2 mol %, and an average sphere-equivalent diameter of 1.2 μm.

After grain formation, the emulsion was subjected to a normal desalting/washing step and redispersed under conditions of 40° C., a pAg of 8.9, and a pH of 6.3, thereby preparing an emulsion Em-1. On the other hand, when grain formation was performed following the same procedures as for Em-1, thiosulfonic acid compounds 1-10, 1-6, 1-2, 1-16, and 1-21 were individually added in a reaction vessel in the amounts listed in Table 1-1, one minute before shell formation was started, thereby preparing emulsions Em-2 to Em-6.

TABLE 1-1

| Emulsion No. | Thiosulfonic Acid Compound | Addition Amount per Mol of Ag |
|---|---|---|
| Em-2 | 1-10 | $3 \times 10^{-5}$ mol |
| Em-3 | 1-6 | " |
| Em-4 | 1-2 | " |
| Em-5 | 1-16 | " |
| Em-6 | 1-21 | " |

When grain formation was performed following the same procedures as for Em-1, reduction sensitizers 2-A, 2-B, and 2-C were individually added in the amounts listed in Table 1-2 one minute after shell formation was started, thereby preparing emulsions Em-7 to Em-15.

TABLE 1-2

| Emulsion No. | Reduction Sensitizer | Addition Amount per Mol of Ag |
|---|---|---|
| Em-7 | 2-A | $1 \times 10^{-5}$ mol |
| Em-8 | " | $3 \times 10^{-5}$ mol |
| Em-9 | " | $1 \times 10^{-4}$ mol |
| Em-10 | 2-B | $1 \times 10^{-6}$ mol |

TABLE 1-2-continued

| Emulsion No. | Reduction Sensitizer | Addition Amount per Mol of Ag |
|---|---|---|
| Em-11 | " | $3 \times 10^{-6}$ mol |
| Em-12 | " | $1 \times 10^{-5}$ mol |
| Em-13 | 2-C | $3 \times 10^{-6}$ mol |
| Em-14 | " | $1 \times 10^{-5}$ mol |
| Em-15 | " | $3 \times 10^{-5}$ mol |

Reduction Sensitizers:
2-A Thiourea Dioxide
2-B Dimethylamineborane
2-C Tin Chloride When grain formation was performed following the same procedures as for Em-1, thiosulfonic acid compounds 1-10, 1-6, 1-2, 1-16, and 1-21 were added one minute before shell formation was started, and optimal amounts of reduction sensitizers 2-A, 2-B, and 2-C were added one minute after shell formation was started, thereby preparing emulsions Em-16 to Em-30 of the present invention listed in Table 1-3.

TABLE 1-3

| | Thiosulfonic Acid | | Reduction Sensitizer | |
|---|---|---|---|---|
| Emulsion No. | Compound | Addition Amount (per Mol of Ag) | Compound | Addition Amount (per Mol of Ag) |
| Em-16 | 1-10 | $3 \times 10^{-5}$ mol | 2-A | $1 \times 10^{-4}$ mol |
| Em-17 | " | " | 2-B | $1 \times 10^{-5}$ |
| Em-18 | " | " | 2-C | $3 \times 10^{-5}$ |
| Em-19 | 1-6 | " | 2-A | $1 \times 10^{-4}$ |
| Em-20 | " | " | 2-B | $1 \times 10^{-5}$ |
| Em-21 | " | " | 2-C | $1 \times 10^{-5}$ |
| Em-22 | 1-2 | " | 2-A | $1 \times 10^{-4}$ |
| Em-23 | " | " | 2-B | $1 \times 10^{-5}$ |
| Em-24 | " | " | 2-C | $3 \times 10^{-5}$ |
| Em-25 | 1-16 | " | 2-A | $3 \times 10^{-5}$ |
| Em-26 | " | " | 2-B | $1 \times 10^{-5}$ |
| Em-27 | " | " | 2-C | $3 \times 10^{-5}$ |
| Em-28 | 1-21 | " | 2-A | $1 \times 10^{-4}$ |
| Em-29 | " | " | 2-B | $1 \times 10^{-5}$ |
| Em-30 | " | " | 2-C | $1 \times 10^{-5}$ |

The emulsions Em-16 to Em-30 of the present invention prepared as described above and the emulsions 1 to 15 of comparative examples were subjected to chemical sensitization of optimal gold-plus-sulfur-sensitization by using sodium thiosulfate and chloroauric acid.

Emulsion and protective layers in the amounts as listed in Table 1-4 were coated on triacetylcellulose film supports having undercoating layers.

TABLE 1-4

(1) Emulsion Layer

Emulsion . . . chemically sensitized emulsions 1 to 30 (silver $1.7 \times 10^{-2}$ mol/m$^2$)

Coupler ($1.5 \times 10^{-3}$ mol/m$^2$)

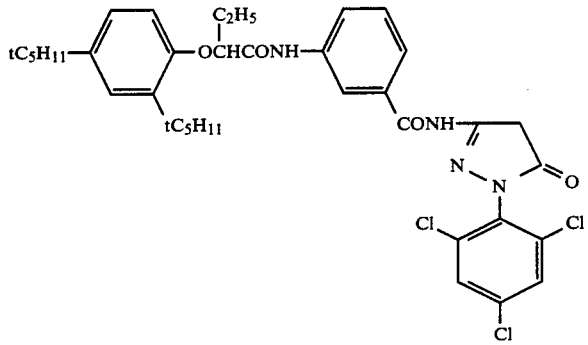

Tricresylphosphate (1.10 g/m$^2$)

Gelatin (2.30 g/m$^2$)

TABLE 1-4-continued

| | |
|---|---|
| (2) Protective Layer | |
| 2,4-dichlorotriazine-6-hydroxy-s-triazine sodium salt | (0.08 g/m$^2$) |
| Gelatin | (1.80 g/m$^2$) |

These samples were subjected to sensitometry exposure, and then to the following color development.

The processed samples were subjected to density measurement by using a green filter. The obtained photographic performance results are listed in Table 1-5.

Development was performed under the following conditions at a temperature of 38° C.

| | |
|---|---|
| 1. Color Development | 2 min. 45 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilizing | 3 min. 15 sec. |

The compositions of the processing solutions used in the above steps were as follows.

| | |
|---|---|
| Color Developer: | |
| Sodium Nitrilotriacetic Acid | 1.4 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-ethyl-N-β-hydroxyethylamino)-2-methyl-aniline Sulfate | 4.5 g |
| Water to make | 1 l |
| Bleaching Solution: | |
| Ammonium Bromide | 160.0 g |
| Ammonium Water (28% w/w) | 25.0 ml |
| Iron (III) Sodium Ethylene-diaminetetraacetate trihydrate | 130 g |
| Glacial Acetic Acid | 14 ml |
| Water to make | 1 l |
| Fixing Solution: | |
| Sodium Tetrapolyphosphate | 2.0 g |
| Sodium Sulfite | 4.0 g |
| Ammonium Thiosulfate (70% w/v) | 175.0 ml |
| Sodium Bisulfite | 4.6 g |
| Water to make | 1 l |
| Stabilizing Solution: | |
| Formalin | 8.0 ml |
| Water to make | 1 l |

In this case, normal wedge exposure was performed for one and 1/100 seconds.

A light source was adjusted at a color temperature of 4,800° K. by using a filter, and blue light was extracted by using a blue filter (BPN42: available from Fuji Photo Film Co. Ltd.). Sensitivities were compared using density at a point from a fog by an optical density of 0.2. The sensitivities are listed as relative sensitivities assuming that the sensitivity of a sample using the emulsion Em-1 is 100 (100 for both 1/100" and 1").

TABLE 1-5

| Emulsion No. | 1-sec Exposure Sensitivity | 1/100-sec Exposure Sensititvity | Fog | Remarks |
|---|---|---|---|---|
| Em- 1 | 100 | 100 | 0.20 | Comparative Example |
| 2 | 75 | 80 | 0.19 | Comparative Example |
| 3 | 76 | 81 | 0.19 | Comparative Example |
| 4 | 79 | 83 | 0.18 | Comparative Example |
| 5 | 70 | 75 | 0.18 | Comparative Example |
| 6 | 70 | 73 | 0.18 | Comparative Example |
| 7 | 106 | 103 | 0.23 | Comparative Example |
| 8 | 104 | 100 | 0.26 | Comparative Example |
| 9 | 90 | 85 | 0.31 | Comparative Example |
| 10 | 106 | 103 | 0.26 | Comparative Example |
| 11 | 106 | 100 | 0.31 | Comparative Example |
| 12 | 90 | 80 | 0.41 | Comparative Example |
| 13 | 106 | 103 | 0.25 | Comparative Example |
| 14 | 104 | 100 | 0.29 | Comparative Example |
| 15 | 95 | 85 | 0.34 | Comparative Example |
| 16 | 132 | 126 | 0.20 | Present Invention |
| 17 | 132 | 126 | 0.24 | Present Invention |
| 18 | 126 | 120 | 0.22 | Present Invention |
| 19 | 126 | 120 | 0.21 | Present Invention |
| 20 | 132 | 126 | 0.24 | Present Invention |
| 21 | 126 | 120 | 0.22 | Present Invention |
| 22 | 135 | 126 | 0.22 | Present Invention |
| 23 | 140 | 132 | 0.25 | Present Invention |
| 24 | 126 | 120 | 0.23 | Present Invention |
| 25 | 120 | 112 | 0.22 | Present Invention |
| 26 | 120 | 115 | 0.26 | Present Invention |
| 27 | 123 | 112 | 0.24 | Present Invention |
| 28 | 123 | 115 | 0.21 | Present Invention |
| 29 | 117 | 112 | 0.24 | Present Invention |
| 30 | 117 | 112 | 0.23 | Present Invention |

As is apparent from Table 1-5, each emulsion of the present invention has low fog and high sensitivity (especially in the case of low intensity).

Example 2

Following the emulsion preparing method described in Example 1, a reduction sensitizer 2-B was added one minute after shell formation was started. In this case, thiosulfonic acid compounds 1-6 and 1-16 were individually added; one minute before shell formation was started; 10 minutes before shell formation was completed (after about 83% of a shell portion were formed); immediately after shell formation was completed, and immediately before chemical sensitization was started, thereby preparing emulsions Em-31 to Em-38, as shown in Table 2-1, which were optimally subjected to gold-plus-sulfur sensitization.

Addition Timing of Thiosulfonic Acid Compound:

a: One minute before shell formation was started
b: Ten minutes before shell formation was completed
c: Immediately after shell formation was completed
d: Immediately before chemical sensitization was started

TABLE 2-1

| Emulsion No. | Thiosulfonic Acid Compound | Addition Timing | Addition Amount (per mol of Ag) | Reduction Sensitizer 2-B Addition Amount (per mol of Ag) |
|---|---|---|---|---|
| 31 | 1-6 | a | $3 \times 10^{-5}$ mol | $1 \times 10^{-5}$ mol |
| 32 | " | b | " | " |
| 33 | " | c | " | " |
| 34 | " | d | " | " |
| 35 | 1-16 | a | " | " |
| 36 | " | b | " | " |
| 37 | " | c | " | " |
| 38 | " | d | " | " |

These emulsions were coated following the same procedures as in Example 1 to perform sensitometry estimation, thereby obtaining the results shown in Table 2-2. Similar to Example 1, sensitivities were estimated as relative sensitivities assuming that the sensitivity of Em-1 optimally subjected to gold-plus-sulfur sensitization is 100.

TABLE 2-2

| Emulsion No. | 1-sec Exposure Sensitivity | 1/100-sec Exposure Sensitivity | Fog | Remarks |
|---|---|---|---|---|
| Em-1 | 100 | 100 | 0.20 | Comparative Example |
| 31 | 132 | 126 | 0.24 | Present Invention |
| 32 | 126 | 120 | 0.27 | Present Invention |
| 33 | 120 | 116 | 0.30 | Present Invention |
| 34 | 120 | 116 | 0.30 | Present Invention |
| 35 | 120 | 115 | 0.26 | Present Invention |
| 36 | 116 | 112 | 0.26 | Present Invention |
| 37 | 114 | 111 | 0.28 | Present Invention |
| 38 | 115 | 110 | 0.27 | Present Invention |

In this case, Em-31 and Em-35 are substantially equal to Em-20 and Em-26.

As is apparent from Table 2-2, emulsions subjected to reduction sensitization in the presence of a thiosulfonic acid compound have preferable photographic properties.

Example 3

The following dyes were added to the chemically sensitized emulsions prepared in Example 1 as shown in Table 3-1, thereby preparing spectrally sensitized emulsions.

The prepared emulsions were coated following the same procedures as in Example 1 to perform a sensitometry.

| | |
|---|---|
| Dye Group 1 (Red-Sensitive Dye) | |
| Sensitizing Dye IX | $5.4 \times 10^{-5}$ mol/mol of Ag |
| Sensitizing Dye II | $1.4 \times 10^{-5}$ mol/mol of Ag |
| Sensitizing Dye III | $2.4 \times 10^{-4}$ mol/mol of Ag |
| Sensitizing Dye IV | $3.1 \times 10^{-5}$ mol/mol of Ag |
| Dye Group 2 (Green-Sensitive Dye) | |
| Sensitizing Dye V | $3.5 \times 10^{-5}$ mol/mol of Ag |
| Sensitizing Dye VI | $8.0 \times 10^{-5}$ mol/mol of Ag |
| Sensitizing Dye VII | $3.0 \times 10^{-4}$ mol/mol of Ag |
| Dye Group 3 (Blue-Sensitive Dye) | |
| Sensitizing Dye VIII | $2.2 \times 10^{-4}$ mol/mol of Ag |

Structures of the sensitizing dyes II to IX are shown in Table C to be presented later.

TABLE 3-1

| Spectrally Sensitized Emulsion | Dye Group | Emulsion | Remarks |
|---|---|---|---|
| Em-39 | 1 (Red-Sensitive Dye) | Em-1 | Comparative Example |
| 40 | 2 (Green-Sensitive Dye) | " | Comparative Example |
| 41 | 3 (Blue-Sensitive Dye) | " | Comparative Example |
| 42 | 1 | Em-7 | Comparative Example |
| 43 | 2 | " | Comparative Example |
| 44 | 3 | " | Comparative Example |
| 45 | 1 | Em-13 | Comparative Example |
| 46 | 2 | " | Comparative Example |
| 47 | 3 | " | Comparative Example |
| 48 | 1 | Em-16 | Present Invention |
| 49 | 2 | " | Present Invention |
| 50 | 3 | " | Present Invention |
| 51 | 1 | Em-20 | Present Invention |
| 52 | 2 | " | Present Invention |
| 53 | 3 | " | Present Invention |
| 54 | 1 | Em-23 | Present Invention |
| 55 | 2 | " | Present Invention |
| 56 | 3 | " | Present Invention |
| 57 | 1 | Em-27 | Present Invention |
| 58 | 2 | " | Present Invention |
| 59 | 3 | " | Present Invention |

The sensitometry was performed following the same procedures as in Example 1 except that the emulsions added with the red- and green-sensitive dyes were exposed by using a yellow filter (SC-52: available from Fuji Photo Film Co. Ltd.) in place of the blue filter used in Example 1 and the emulsions added with the blue-sensitive dye were exposed without using a filter. Table 3-2 shows sensitivities of Em-39 to Em-59 as relative sensitivities assuming that sensitivities of Em-39, Em-40, and Em-41 of one-sec and 1/100 sec exposures are 100.

TABLE 3-2

| Spectrally Sensitized Emulsion | 1-sec Exposure Sensitivity | 1/100-sec Exposure Sensitivity | Fog | Remarks |
|---|---|---|---|---|
| Em-39 | 100 | 100 | 0.21 | Comparative Example |
| 40 | 100 | 100 | 0.21 | Comparative Example |
| 41 | 100 | 100 | 0.20 | Comparative Example |
| 42 | 101 | 100 | 0.25 | Comparative Example |
| 43 | 102 | 102 | 0.23 | Comparative Example |
| 44 | 102 | 103 | 0.23 | Comparative Example |
| 45 | 102 | 99 | 0.28 | Comparative Example |
| 46 | 102 | 100 | 0.26 | Comparative Example |
| 47 | 102 | 102 | 0.26 | Comparative Example |
| 48 | 125 | 120 | 0.25 | Present Invention |
| 49 | 130 | 125 | 0.23 | Present Invention |
| 50 | 140 | 130 | 0.24 | Present Invention |
| 51 | 126 | 122 | 0.24 | Present Invention |
| 52 | 128 | 125 | 0.23 | Present Invention |
| 53 | 136 | 128 | 0.22 | Present Invention |
| 54 | 126 | 122 | 0.26 | Present Invention |
| 55 | 128 | 124 | 0.25 | Present Invention |
| 56 | 131 | 125 | 0.24 | Present Invention |
| 57 | 115 | 112 | 0.26 | Present Invention |
| 58 | 118 | 113 | 0.25 | Present Invention |
| 59 | 119 | 115 | 0.23 | Present Invention |

Example 4

Grain information was performed following the procedures of in Example 1 except that the pH and pAg during shell growth were changed to perform reduction sensitization. In this case, a thiosulfonic acid compound was added one minute before shell formation was started. The adjusted pH and pAg values and amounts of the thiosulfonic acid compound are listed in Table 4-1. The pH and pAg values in redispersion after a desalting/washing step are the same as those in Example 1.

TABLE 4-1

| Emulsion No. | pH | pAg | Thio-sulfonic Acid Compound | Addition Amount (per mol of Ag) | Remarks |
|---|---|---|---|---|---|
| Em-60 | 6.0 | 8.9 | — | — | Comparative Example |
| 61 | " | " | 1-2 | $1 \times 10^{-5}$ mol | Comparative Example |
| 62 | " | " | 1-21 | " | Comparative Example |
| 63 | 6.0 | 6.7 | — | — | Comparative Example |
| 64 | " | " | 1-2 | $1 \times 10^{-5}$ mol | Present Invention |
| 65 | " | " | 1-21 | " | Present Invention |
| 66 | 9.0 | 8.9 | — | — | Comparative Example |
| 67 | " | " | 1-2 | $1 \times 10^{-5}$ mol | Present Invention |
| 68 | " | " | 1-21 | " | Present Invention |
| 69 | 9.0 | 6.7 | — | — | Comparative Example |
| 70 | " | " | 1-2 | $3 \times 10^{-5}$ mol | Present Invention |
| 71 | " | " | 1-21 | " | Present Invention |

Emulsions 60 to 71 prepared as described above were optimally, chemically sensitized following the same procedures as in Example 1, coating samples were prepared following the same procedures as in Example 1, and the sensitometry was performed following the same procedures as in Example 1. The results are shown in Table 4-2.

TABLE 4-2

| Emulsion No. | 1-sec Exposure Sensitivity | 1/100-sec Exposure Sensitivity | Fog | Remarks |
|---|---|---|---|---|
| Em-60 | 100 | 100 | 0.20 | Comparative Example |
| 61 | 79 | 83 | 0.18 | Comparative Example |
| 62 | 70 | 73 | 0.18 | Comparative Example |
| 63 | 103 | 103 | 0.31 | Comparative Example |
| 64 | 115 | 112 | 0.22 | Present Invention |
| 65 | 112 | 111 | 0.24 | Present Invention |
| 66 | 103 | 102 | 0.33 | Comparative Example |
| 67 | 114 | 112 | 0.23 | Present Invention |
| 68 | 112 | 110 | 0.25 | Present Invention |
| 69 | 102 | 98 | 0.40 | Comparative Example |
| 70 | 116 | 111 | 0.28 | Present Invention |
| 71 | 113 | 110 | 0.30 | Present Invention |

In Table 4-2, the sensitivities are represented as relative sensitivities assuming that the sensitivity of Em-60 is 100 for both one and 1/100 second exposures. As is apparent from Table 4-2, the present invention is effective in reduction sensitization performed by controlling the pH and pAg in a grain formation process in the presence of gelatin.

Example 5

A plurality of layers having the following compositions were coated on an undercoated triacetylcellulose film support to prepare a sample 501 as a multilayer color light-sensitive material.

Light-Sensitive Layer Composition

Numerals corresponding to the respective components indicate coating amounts in units of g/m$^2$. The silver halide is represented in a silver amount. A coating amount of the sensitizing dye is represented in units of mols per mol of the silver halide in the same layer.

Sample 501

| | |
|---|---|
| Layer 1: Antihalation Layer | |
| Black Colloid Silver | silver 0.18 |
| Gelatin | 1.40 |
| Layer 2: Interlayer | |
| 2,5-di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Layer 3: 1st Red-Sensitive Emulsion Layer | |
| Monodisperse Silver Iodobromide Emulsion (silver iodide = 6 mol %, average grain size = 0.6/μm, variation coefficient of grain size = 0.15) | silver 0.55 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.20 |
| Layer 4: 2nd Red-Sensitive Emulsion Layer | |
| Tabular Silver Iodobromide Emulsion (silver iodide = 10 mol %, average grain size = 0.7 μm, average aspect ratio = 5.5, average thickness = 0.2 μm) | silver 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| EX-10 | 0.015 |
| Gelatin | 1.30 |
| Layer 5: 3rd Red-Sensitive Emulsion Layer | |
| Silver Iodobromide Emulsion I | silver 1.60 |
| EX-3 | 0.240 |
| EX-4 | 0.120 |
| HBS-1 | 0.22 |
| HBS-2 | 0.10 |
| Gelatin | 1.63 |
| Layer 6: Interlayer | |
| EX-5 | 0.040 |
| HBS-1 | 0.020 |
| Gelatin | 0.80 |
| Layer 7: 1st Green-Sensitive Emulsion Layer | |
| Tabular Silver Iodobromide Emulsion (silver iodide = 6 mol %, average grain size = 0.6 μm, average aspect ratio = 6.0, average thickness = 0.15 μm) | silver 0.40 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| Layer 8: 2nd Green-Sensitive Emulsion Layer | |
| Monodisperse Silver Iodobromide Emulsion (silver iodide = 9 mol %, average grain size = 0.7 μm, variation coefficient of grain size = 0.18) | silver 0.80 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |

-continued

| | |
|---|---|
| HBS-1 | 0.160 |
| HBS-4 | 0.008 |
| Gelatin | 1.10 |
| Layer 9: 3rd Green-Sensitive Emulsion Layer | |
| Silver Iodobromide Emulsion II | silver 1.2 |
| EX-6 | 0.065 |
| EX-11 | 0.030 |
| EX-1 | 0.025 |
| HBS-1 | 0.25 |
| HBS-2 | 0.10 |
| Gelatin | 1.74 |
| Layer 10: Yellow Filter Layer | |
| Yellow Colloid Silver | silver 0.05 |
| EX-5 | 0.08 |
| HBS-3 | 0.03 |
| Gelatin | 0.95 |
| Layer 11: 1st Blue-Sensitive Emulsion Layer | |
| Tabular Silver Iodobromide Emulsion (silver iodide = 6 mol %, average grain size = 0.6 μm, average aspect ratio = 5.7, average thickness = 0.15 μm) | silver 0.24 |
| Sensitizing Dye VIII | $3.5 \times 10^{-4}$ |
| EX-9 | 0.85 |
| EX-8 | 0.12 |
| HBS-1 | 0.28 |
| Gelatin | 1.28 |
| Layer 12: 2nd Blue-Sensitive Emulsion Layer | |
| Monodisperse Silver Iodobromide Emulsion (silver iodide = 10 mol %, average grain size = 0.8 μm, variation coefficient of grain size = 0.16) | silver 0.45 |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |
| Layer 13: 3rd Blue-Sensitive Emulsion Layer | |
| Silver Iodobromide Emulsion III | silver 0.77 |
| EX-9 | 0.20 |
| HBS-1 | 0.07 |
| Gelatin | 0.69 |
| Layer 14: 1st Protective Layer | |
| Silver Iodobromide Emulsion (silver iodide = 1 mol %, average grain size = 0.07 μm) | silver 0.5 |
| U-4 | 0.11 |
| U-5 | 0.17 |
| HBS-1 | 0.90 |
| Gelatin | 1.00 |
| Layer 15: 2nd Protective Layer | |
| Polymethylacrylate Grains (grain size = about 1.5 μm) | 0.54 |
| S-1 | 0.15 |
| S-2 | 0.05 |
| Gelatin | 0.72 |

In addition to the above components, a gelatin hardener H-1 and/or a surfactant were added to each layer.

Names or chemical structures of the compounds used in the sample 501 are listed in Table D to be presented later.

Samples 502 to 505 were prepared following the same procedures as for the sample 501 except that the silver iodobromide emulsion I in the layer 5, the silver iodobromide emulsion II in the layer 9, and the silver iodobromide emulsion III in the layer 13 were changed.

These samples were subjected to sensitometry exposure to perform the following color development.

The processed samples were subjected to density measurement by using red, green, and blue filters. The obtained results are shown in Table 5-1.

The results of photographic performance are represented by relative sensitivities of the red-, green-, and blue-sensitive layers assuming that the sensitivity of the sample 501 is 100.

Processing Method

The color development process was performed at 38° C. in accordance with the following process steps.

| | |
|---|---|
| Color Development | 3 min. 15 sec. |
| Bleaching | 6 min. 30 sec. |
| Washing | 2 min. 10 sec. |
| Fixing | 4 min. 20 sec. |
| Washing | 3 min. 15 sec. |
| Stabilization | 1 min. 05 sec. |

The processing solution compositions used in the respective steps were as follows.

| | |
|---|---|
| Color Developing Solution | |
| Diethylenetriaminepentaacetic Acid | 1.0 g |
| 1-hydroxyethylidene-1,1-diphosphonic acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxyamine Sulfate | 2.4 g |
| 4-(N-ethyl-N-β-hydroxyethylamino)-2-methylanilinesulfate | 4.5 g |
| Water to make | 1.0 l |
| pH | 10.0 |
| Bleaching Solution | |
| Ferric Ammonium Ethylenediaminetetraacetate (Dihydrate) | 100.0 g |
| Disodium Ethylenediaminetetraacetate | 10.0 g |
| Ammonium Bromide | 150.0 g |
| Ammonium Nitrate | 10.0 g |
| Water to make | 1.0 l |
| pH | 6.0 |
| Fixing Solution | |
| Disodium Ethylenediaminetetraacetate | 1.0 g |
| Sodium Sulfite | 4.0 g |
| Ammonium Thiosulfate Aqueous Solution (70%) | 175.0 ml |
| Sodium Bisulfite | 4.6 g |
| Water to make | 1.0 l |
| pH | 6.6 |
| Stabilizing Solution | |
| Formalin (40%) | 2.0 ml |
| Polyoxyethylene-p-monononyl-phenylether (average polymerization degree = 10) | 0.3 g |
| Water to make | 1.0 l |

TABLE 5-1

| Sample No. | Layer 5 Silver Iodobromide Emulsion I | Layer 9 Silver Iodobromide Emulsion II | Layer 13 Silver Iodobromide Emulsion III | Red-Sensitive Layer | | Green-Sensitive Layer | | Blue-Sensitive Layer | |
|---|---|---|---|---|---|---|---|---|---|
| | | | | Sensitivity | Fog | Sensitivity | Fog | Sensitivity | Fog |
| 501 (Comparative Example) | Em-39 | Em-40 | Em-41 | 100 | 0.12 | 100 | 0.13 | 100 | 0.20 |
| 502 (Present Invention) | Em-48 | Em-49 | Em-50 | 110 | 0.13 | 112 | 0.14 | 114 | 0.21 |
| 503 (Present Invention) | Em-51 | Em-52 | Em-53 | 110 | 0.13 | 111 | 0.13 | 113 | 0.20 |
| 504 (Present Invention) | Em-54 | Em-55 | Em-56 | 112 | 0.14 | 112 | 0.15 | 115 | 0.23 |
| 505 (Present Invention) | Em-57 | Em-58 | Em-59 | 107 | 0.15 | 108 | 0.15 | 110 | 0.22 |

As is apparent from Table 5-1, in the emulsions of the present invention, an effect of increasing the sensitivity with almost no increase in fog is shown.

Example 6

The sample 501 of the comparative example and the samples 502 to 505 of the present invention were exposed following the same procedures as in Example 5 and processed as follows by using an automatic developing machine.

| Step | Processing Method Time | Temperature |
|---|---|---|
| Color Development | 3 min. 15 sec. | 38° C. |
| Bleaching | 1 min. 00 sec. | 38° C. |
| Bleach-Fixing | 3 min. 15 sec. | 38° C. |
| Washing (1) | 40 sec. | 35° C. |
| Washing (2) | 1 min. 00 sec. | 35° C. |
| Stabilizing | 40 sec. | 38° C. |
| Dry | 1 min. 15 sec. | 55° C. |

the processing solution compositions will be described below.

| | |
|---|---|
| Color Developing Solution: | g |
| Diethylenetriaminepentaacetic Acid | 1.0 |
| 1-hydroxyethylidene-1,1 diphosphonic acid | 3.0 |
| Sodium Sulfite | 4.0 |
| Potassium Carbonate | 30.0 |
| Potassium Bromide | 1.4 |
| Potassium Iodide | 1.5 mg |
| Hydroxyamine Sulfate | 2.4 |
| 4-[N-ethyl-N-(β-hydroxyethyl)amino]-2-methylanilinesulfate | 4.5 |
| Water to make | 1.0 L |
| pH | 10.05 |
| Bleaching Solution: | g |
| Ferric Ammonium Ethylenediaminetetraacetate (Dihydrate) | 120.0 |
| Disodium Ethylenediaminetetraacetate | 10.0 |
| Ammonium Bromide | 100.0 |
| Ammonium Nitrate | 10.0 |
| Bleaching Accelerator | 0.005 mol |

-continued

| | |
|---|---|
| Water to make | 1.0 l |

-continued

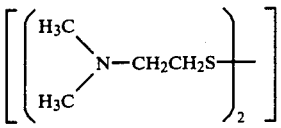

| | |
|---|---|
| Ammonia Aqueous Solution (27%) | 15.0 ml |
| Water to make | 1.0 L |
| pH | 6.3 |
| Bleach-Fixing Solution: | g |
| Ferric Ammonium Ethylenediaminetetraacetate (Dihydrate) | 50.0 |
| Disodium Ethylenediaminetetraacetate | 5.0 |
| Sodium Sulfite | 12.0 |
| Ammonium Thiosulfate Aqueous Solution (70%) | 240.0 ml |
| Ammonia Aqueous Solution (27%) | 6.0 ml |
| Water to make | 1.0 L |
| pH | 7.2 |
| Washing Solution: | |
| Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of of sodium isocyanuric acid dichloride and 1.5 g/L of sodium sulfate were added. The pH of the solution fell within the range of 6.5 to 7.5. | |
| Stabilizing Solution: | g |
| Formalin (37%) | 2.0 ml |
| Polyoxyethylene-p-monononyl-phenylether (average poly-merization degree = 10) | 0.3 |
| Disodium Ethylenediaminetetraacetate | 0.05 |
| Water to make | 1.0 L |
| pH | 5.0 to 8.0 |

The samples 502 to 505 of the present invention provided the good results as in Example 5 after they were subjected to the above processing.

Example 7

The sample 501 of the comparative example and the samples 502 to 505 of the present invention were exposed following the same procedures as in Example 5 and processed as follows by using an automatic developing machine.

| Step | Processing Method Time | Temperature |
|---|---|---|
| Color Development | 2 min. 30 sec. | 40° C. |
| Bleach-Fixing | 3 min. 00 sec. | 40° C. |
| Washing (1) | 20 sec. | 35° C. |
| Washing (2) | 20 sec. | 35° C. |
| Stabilizing | 20 sec. | 35° C. |
| Drying | 50 sec. | 65° C. |

The processing solution compositions will be described below.

| Color Developing Solution: | g |
|---|---|
| Diethylenetriaminepentaacetic Acid | 2.0 |
| 1-hydroxyethylidene-1,1-diphosphonic acid | 3.0 |
| Sodium Sulfite | 4.0 |
| Potassium Carbonate | 30.0 |
| Potassium Bromide | 1.4 |
| Potassium Iodide | 1.5 mg |

-continued

| | |
|---|---|
| Hydroxylamine Sulfate | 2.4 |
| 4-[N-ethyl-N-(β-hydroxyethyl)amino]-2-methylaniline Sulfate | 4.5 |
| Water to make | 1.0 L |
| pH | 10.05 |
| Bleach-Fixing Solution: | g |
| Ferric Ammonium Ethylenediaminetetraacetate (Dihydrate) | 50.0 |
| Disodium Ethylenediaminetetraacetate | 5.0 |
| Sodium Sulfite | 12.0 |
| Ammonium Thiosulfate Aqueous Solution (70%) | 260.0 ml |
| Acetic Acid (98%) | 5.0 ml |
| Bleaching Accelerator | 0.01 mol |

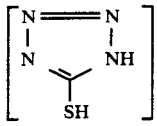

| | |
|---|---|
| Water to make | 1.0 L |
| pH | 6.0 |
| Washing Solution: | |
| Tap water was supplied to a mixed-bed column filed with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 1.5 g/L of sodium sulfate were added. The pH of the solution fell within the range of 6.5 to 7.5. | |
| Stabilizing Solution: | g |
| Formalin (37%) | 2.0 ml |
| Polyoxyethylen-p-monononylphenylether (average polymerization degree = 10) | 0.3 |
| Disodium Ethylenediaminetetraacetate | 0.05 |
| Water to make | 1.0 L |
| pH | 5.0 to 8.0 |

The samples 502 to 505 of the present invention provided the good results as in Example 5 after they were subjected to the above processing.

Example 8

Layers having the following compositions were formed on an undercoated cellulose triacetate film support, thereby preparing sample 601 as a multilayered color light-sensitive material.

Compositions of Light-Sensitive Layers

The coating amount of couplers are represented in grams and the amount of a silver halide and colloid silver are represented in units of $g/m^2$ of silver, and that of sensitizing dyes is represented by the number of mols per mol of the silver halide in the same layer.

| | |
|---|---|
| Layer 1: Antihalation Layer | |
| Black Colloid Silver coating silver amount | 0.2 |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Layer 2: Interlayer | |
| Fine Silver Bromide Grain (sphere-equivalent diameter = 0.07 μm) coating silver amount | 0.15 |

-continued

| | |
|---|---|
| Gelatin | 1.0 |
| Cpd-2 | 0.2 |
| Layer 3: 1st Red-Sensitive Emulsion Layer | |
| Silver Iodobromide Emulsion (AgI = 10.0 mol %, internally high AgI type, sphere-equivalent diameter = 0.7 μm, variation coefficient of sphere-equivalent diameter = 14%, tetra-decahedral grain) coating silver amount | 0.26 |
| Silver Iodobromide Emulsion (AgI = 4.0 mol %, internally high AgI type, sphere-equivalent diameter = 0.4 μm, variation coefficient of sphere-equivalent diameter = 22%, tetra-decahedral grain) coating silver amount | 0.2 |
| Gelatin | 1.0 |
| ExS-1 | $4.5 \times 10^{-4}$ |
| ExS-2 | $1.5 \times 10^{-4}$ |
| ExS-3 | $0.4 \times 10^{-4}$ |
| ExS-4 | $0.3 \times 10^{-4}$ |
| ExC-1 | 0.33 |
| ExC-2 | 0.009 |
| ExC-3 | 0.023 |
| ExC-6 | 0.14 |
| Layer 4: 2nd Red-Sensitive Emulsion Layer | |
| Silver Iodobromide Emulsion (AgI = 16 mol %, internally high AgI type, sphere-equivalent diameter = 1.0 μm, variation coefficient of sphere-equivalent diameter = 25%, tabular grain, diameter/thickness ratio = 4.0) coating silver amount | 0.55 |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-3 | 0.05 |
| ExC-4 | 0.10 |
| ExC-6 | 0.08 |
| Layer 5: 3rd Red-Sensitive Emulsion Layer | |
| Silver Iodobromide Emulsion I (internally high AgI type, sphere-equivalent diameter = 1.2 μm, variation coefficient of sphere-equivalent diameter = 28%) coating silver amount | 0.9 |
| Gelatin | 0.6 |
| ExS-1 | $2 \times 10^{-4}$ |
| ExS-2 | $0.6 \times 10^{-4}$ |
| ExS-3 | $0.2 \times 10^{-4}$ |
| ExC-4 | 0.07 |
| ExC-5 | 0.06 |
| Solv-1 | 0.12 |
| Solv-2 | 0.12 |
| Layer 6: Interlayer | |
| Gelatin | 1.0 |
| Cpd-4 | 0.1 |
| Layer 7: 1st Green-Sensitive Emulsion Layer | |
| Silver Iodobromide Emulsion (AgI = 10.0 mol %, internally high AgI type, sphere-equivalent diameter = 0.7 μm, variation coefficient of sphere-equivalent diameter = 14%, tetra-decahedral grain) coating silver amount | 0.2 |
| Silver Iodobromide Emulsion (AgI = 4.0 mol %, internally high AgI type, sphere-equivalent diameter = 0.4 μm, variation coefficient of sphere-equivalent diameter = 22%, tetra-decahedral grain) coating silver amount | 0.1 |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.41 |
| ExM-2 | 0.10 |
| ExM-5 | 0.03 |
| Solv-1 | 0.2 |
| Solv-5 | 0.03 |
| Layer 8: 2nd Green-Sensitive Emulsion Layer | |
| Silver Iodobromide Emulsion (AgI = 10 mol %, internally high iodide type, sphere-equivalent diameter = 1.0 μm, variation coefficient of sphere-equivalent diameter = 25%, tabular grain, diameter/thickness ratio = 3.0) coating silver amount | 0.4 |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| Solv-1 | 0.15 |
| Solv-5 | 0.03 |
| Layer 9: Interlayer | |
| Gelatin | 0.5 |
| Layer 10: 3rd Green-Sensitive Emulsion Layer | |
| Silver Iodobromide Emulsion II (internally high AgI type, sphere-equivalent diameter = 1.2 μm, variation coefficient of sphere-equivalent diameter = 28%) coating silver amount | 1.0 |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |
| ExC-4 | 0.005 |
| Solv-1 | 0.2 |
| Layer 11: Yellow Filter Layer | |
| Cpd-3 | 0.05 |
| Gelatin | 0.5 |
| Solv-1 | 0.1 |
| Layer 12: Interlayer | |
| Gelatin | 0.5 |
| Cpd-2 | 0.1 |
| Layer 13: 1st Blue-Sensitive Emulsion Layer | |
| Silver Iodobromide Emulsion (AgI = 10 mol %, internally high iodide type, sphere-equivalent diameter = 0.7 μm, variation coefficient of sphere-equivalent diameter = 14%, tetra-decahedral grain) coating silver amount | 0.1 |
| Silver Iodobromide Emulsion (AgI = 4.0 mol %, internally high iodide type, sphere-equivalent diameter = 0.4 μm, variation coefficient of sphere-equivalent diameter = 22%, tetra-decahedral grain) coating silver amount | 0.05 |
| Gelatin | 1.0 |
| ExS-8 | $3 \times 10^{-4}$ |
| ExY-1 | 0.53 |
| ExY-2 | 0.02 |
| Solv-1 | 0.15 |
| Layer 14: 2nd Blue-Sensitive Emulsion Layer | |
| Silver Iodobromide Emulsion (AgI = 19.0 mol %, internally high AgI type, sphere-equivalent diameter = 1.6 μm, variation coefficient of sphere-equivalent diameter = 16%, tetra-decahedral grain) coating silver amount | 0.19 |
| Gelatin | 0.3 |
| ExS-8 | $2 \times 10^{-4}$ |
| ExY-1 | 0.22 |
| Solv-1 | 0.07 |
| Layer 15: Interlayer | |
| Fine Silver Iodobromide Grain (AgI = 2 mol %, homogeneous type, sphere-equivalent diameter = 0.13 μm) coating silver amount | 0.2 |
| Gelatin | 0.36 |
| Layer 16: 3rd Blue-Sensitive Emulsion Layer | |
| Silver Iodobromide Emulsion III (internally high AgI type, sphere-equivalent diameter = 1.2 μm, variation coefficient of sphere-equivalent diameter = 28%) coating silver amount | 1.0 |
| Gelatin | 0.5 |
| ExS-8 | $1.5 \times 10^{-4}$ |
| ExY-1 | 0.2 |
| Solv-1 | 0.07 |

-continued

| | |
|---|---|
| Layer 17: 1st Protective Layer | |
| Gelatin | 1.8 |
| UV-1 | 0.1 |
| UV-2 | 0.2 |
| Solv-1 | 0.01 |
| Solv-2 | 0.01 |
| Layer 18: 2nd Protective Layer | |
| Fine Silver Bromide Grain (sphere-equivalent diameter = 0.07 μm) coating silver amount | 0.18 |
| Gelatin | 0.7 |
| Polymethylmethacrylate Grain (diameter = 1.5 μm) | 0.2 |
| W-1 | 0.02 |
| H-1 | 0.4 |
| Cpd-5 | 1.0 |

Names of chemical structures of the compounds used in the sample 601 are listed in Table E to be presented later.

Samples 602 to 605 were prepared following the same procedures as for the sample 601 except that the silver iodobromide emulsion I in the layer 5, the silver iodobromide emulsion II in the layer 10, and the silver iodobromide emulsion III in the layer 16 were changed.

These samples were left under conditions of a temperature of 40° C. and a relative humidity of 70% for 14 hours and then subjected to sensitometry exposure to perform color development following the same procedures as in Example 5.

The processed samples were subjected to density measurement by using red, green, and blue filters. The obtained results are shown in Table 6-1.

The results of photographic performance are represented by relative sensitivities of the red-, green-, and blue-sensitive layers assuming that the sensitivity of the sample 601 is 100.

As is apparent from Table 6-1, in the emulsions of the present invention an effect of increasing the sensitivity with almost no increase in fog is shown.

TABLE 6-1

| Sample No. | Layer 5 Silver Iodobromide Emulsion I | Layer 10 Silver Iodobromide Emulsion II | Layer 16 Silver Iodobromide Emulsion III | Red-Sensitive Layer Sensitivity | Red-Sensitive Layer Fog | Green-Sensitive Layer Sensitivity | Green-Sensitive Layer Fog | Blue-Sensitive Layer Sensitivity | Blue-Sensitive Layer Fog |
|---|---|---|---|---|---|---|---|---|---|
| 601 (Comparative Example) | Em-1 | Em-1 | Em-1 | 100 | 0.08 | 100 | 0.10 | 100 | 0.12 |
| 602 (Present Invention) | Em-16 | Em-16 | Em-16 | 110 | 0.08 | 112 | 0.11 | 116 | 0.13 |
| 603 (Present Invention) | Em-20 | Em-20 | Em-20 | 111 | 0.09 | 114 | 0.11 | 120 | 0.12 |
| 604 (Present Invention) | Em-27 | Em-27 | Em-27 | 110 | 0.10 | 110 | 0.12 | 112 | 0.14 |
| 605 (Present Invention) | Em-28 | Em-28 | Em-28 | 106 | 0.09 | 107 | 0.12 | 108 | 0.13 |

Example 9

Layers having the following compositions were formed on an undercoated triacetyl cellulose film support, thereby preparing sample 701 as a multilayered color light-sensitive material.

Compositions of Light-Sensitive Layers

The coating amounts of a silver halide and colloid silver are represented in units of $g/m^2$ of silver, that of couplers, additives, and gelatin are represented in units of $g/m^2$, and that of sensitizing dyes are represented by the number of mols per mol of the silver halide in the same layer. Symbols representing additives have the following meanings. Note that if an additive has a plurality of effects, only one of the effects is shown.

UV: ultraviolet absorbent, Solv; high-boiling organic solvent, ExF; dye, ExS; sensitizing dye, ExC: cyan coupler, ExM; magenta coupler, ExY: yellow coupler, Cpd: additive

| | |
|---|---|
| Layer 1: Antihalation Layer | |
| Black Colloid Silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |
| Layer 2: Low-Sensitivity Red-Sensitive Emulsion Layer | |
| Silver Iodobromide Emulsion (AgI = 4 mol %, homogeneous type, sphere-equivalent diameter = 0.4 μm, variation coefficient of sphere-equivalent diameter = 37%, tabular grain, diameter/thickness ratio = 3.0) coating silver amount | 0.4 |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |
| ExC-2 | 0.03 |
| ExC-3 | 0.13 |
| Layer 3: Intermediate-Sensitivity Red-Sensitive Emulsion Layer | |
| Silver Iodobromide Emulsion (AgI = 6 mol %, internally high AgI type having core/shell ratio of 2:1, sphere-equivalent diameter = 0.65 μm, variation coefficient of sphere-equivalent diameter = 25%, tabular grain, diameter/thickness ratio = 2.0) coating silver amount | 0.65 |
| Silver Iodobromide Emulsion (AgI = 4 mol %, homogeneous AgI type, sphere-equivalent diameter = 0.4 μm, variation coefficient of sphere-equivalent diameter = 37%, tabular grain, diameter/thickness ratio = 3.0) | 0.1 |

-continued

| | |
|---|---|
| coating silver amount | |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-2 | 0.01 |
| ExC-3 | 0.06 |
| Layer 4: High-Sensitivity Red-Sensitive Emulsion Layer | |
| Silver Iodobromide Emulsion I (internally high AgI type having core/shell ratio of 1:2, sphere-equivalent diameter = 0.75 μm, variation coefficient of sphere-equivalent diameter = 25%) | 0.9 |
| coating silver amount | |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |
| Layer 5: Interlayer | |
| Gelatin | 0.6 |
| UV-4 | 0.03 |
| UV-5 | 0.04 |
| Cpd-1 | 0.1 |
| Polyethylacrylate Latex | 0.08 |
| Solv-1 | 0.05 |
| Layer 6: Low-Sensitivity Green-Sensitive Emulsion Layer | |
| Silver Iodobromide Emulsion (AgI = 4 mol %, homogeneous type, sphere-equivalent diameter = 0.4 μm, sphere-equivalent diameter = 0.7 μm, variation coefficient of sphere equivalent diameter =37%, tabular grain, diameter/thickness ratio = 2.0) | 0.18 |
| coating silver amount | |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |
| Layer 7: Intermediate-Sensitivity Green-Sensitive Emulsion Layer | |
| Silver Iodobromide Emulsion (AgI = 4 mol %, surface high AgI type having core/shell ratio of 1:1, sphere-equivalent diameter = 0.5 μm, variation coefficient of sphere-equivalent diameter = 20%, tabular grain, diameter/thickness ratio = 4.0) | 0.27 |
| coating silver amount | |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| Layer 8: High-Sensitivity Green-Sensitive Emulsion Layer | |
| Silver Iodobromide Emulsion II (internally high AgI type having core/shell ratio of 1:2, sphere-equivalent diameter = 0.75 μm, variation coefficient of sphere-equivalent diameter = 25%) | 0.7 |
| coating silver amount | |
| Gelatin | 0.8 |
| ExS-4 | $5.2 \times 10^{-4}$ |
| ExS-5 | $1 \times 10^{-4}$ |

-continued

| | |
|---|---|
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |
| Layer 9: Interlayer | |
| Gelatin | 0.6 |
| Cpd-1 | 0.04 |
| Polyethylacrylate Latex | 0.12 |
| Solv-1 | 0.02 |
| Layer 10: Donor Layer having Interlayer Effect on Red-Sensitive Layer | |
| Silver Iodobromide Emulsion (AgI = 6 mol %, internally high AgI type having core/shell ratio of 2:1, sphere-equivalent diameter = 0.7 μm, variation coefficient of sphere-equivalent diameter = 25%, tabular grain, diameter/thickness ratio = 2.0) | 0.68 |
| coating silver amount | |
| Silver Iodobromide Emulsion (AgI = 4 mol %, homogeneous type, variation coefficient of sphere-equivalent diameter = 37%, tabular grain, diameter/thickness ratio = 3.0) | 0.19 |
| coating silver amount | |
| Gelatin | 1.0 |
| ExS-3 | $6 \times 10^{-4}$ |
| ExM-10 | 0.19 |
| Solv-1 | 0.20 |
| Layer 11: Yellow Filter Layer | |
| Yellow Colloid Silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| Layer 12: Low-Sensitivity Blue-Sensitive Emulsion Layer | |
| Silver Iodobromide Emulsion (AgI = 4.5 mol %, homogeneous AgI type, sphere-equivalent diameter = 0.7 μm, variation coefficient of sphere-equivalent diameter = 15%, tabular grain, diameter/thickness ratio = 7.0) | 0.3 |
| coating silver amount | |
| Silver Iodobromide Emulsion (AgI = 3 mol %, homogeneous AgI type, sphere-equivalent diameter = 0.3 μm, variation coefficient of sphere-equivalent diameter = 30%, tabular grain, diameter/thickness ratio = 7.0) | 0.15 |
| coating silver amount | |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| Layer 13: Interlayer | |
| Gelatin | 0.7 |
| ExY-12 | 0.20 |
| Solv-1 | 0.34 |
| Layer 14: High-Sensitivity Blue-Sensitive Emulsion Layer | |
| Silver Iodobromide Emulsion III (internally high AgI type having core/shell ratio of 1:2, sphere-equivalent diameter = 0.75 μm, variation coefficient of sphere-equivalent diameter = 25%) | 0.5 |
| coating silver amount | |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |

-continued

| | |
|---|---|
| Layer 15: 1st Protective Layer | |
| Fine Grain Silver Bromide Emulsion (AgI = 2 mol %, homogeneous AgI type, sphere-equivalent diameter = 0.07 μm) coating silver amount | 0.12 |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethylacrylate Latex | 0.09 |
| Layer 16: 2nd Protective Layer | |
| Fine Grain Silver Bromide Emulsion (AgI = 2 mol %, homogeneous AgI type, sphere-equivalent diameter = 0.07 μm) coating silver amount | 0.36 |
| Gelatin | 0.55 |
| Polymethylmethacrylate Grain (diameter = 1.5 μm) | 0.2 |
| H-1 | 0.17 |

In addition to the above components, a stabilizer Cpd-3 (0.07 g/m$^2$) for an emulsion and a surfactant Cpd-4 (0.03 g/m$^2$) were added as coating aids to each layer.

Names or chemical structures of the compounds used in the sample 701 are listed in Table F to be presented layer.

An emulsion Em-201 was prepared following the same procedures as for Em-1 in Example 1 except that the average sphere-equivalent diameter of a seed crystal was 0.5 μm and therefore the average sphere-equivalent diameter of a finally formed grain was 0.75 μm.

When grain formation was performed following the same procedures as for Em-201, a thiosulfonic acid compound and a reduction sensitizer were added, as in Example 1, in the amounts listed in Table 7-1, thereby preparing emulsions Em-202 to Em-207.

TABLE 7-1

| Emulsion | Thio-sulfonic Acid Compound | Addition Amount (per mol of Ag) | Reduction Sensitizer | Addition Amount (per mol of Ag) |
|---|---|---|---|---|
| 202 | 1-10 | $5 \times 10^{-5}$ mol | 2-A | $3 \times 10^{-5}$ mol |
| 203 | " | " | 2-B | " |
| 204 | 1-6 | " | 2-A | " |
| 205 | " | " | 2-B | " |
| 206 | 1-16 | " | 2-A | " |
| 207 | " | " | 2-B | " |

The emulsions 202 to 207 of the present invention prepared as described above and comparative example 201 were optimally gold-plus-sulfur sensitized by using sodium thiosulfate and chloroauric acid.

Samples 702 to 707 were prepared following the same procedures as for the sample 701 except that the silver iodobromide emulsion I in the layer 4, the silver iodobromide emulsion II in the layer 8, and the silver iodobromide emulsion III in the layer 14 were changed.

These samples were left under conditions of a temperature of 40° C. and a relative humidity of 70% for 14 hours and then subjected to sensitometry exposure to perform color development following the same procedures as in Example 5.

The processed samples were subjected to density measurement by using red, green, and blue filters. The obtained results are shown in Table 7-2.

The results of photographic performance are represented by relative sensitivities of the red-, green-, and blue-sensitive layers assuming that the sensitivity of the sample 701 is 100.

TABLE 7-2

| Sample No. | Layer 4 Silver Iodobromide Emulsion I | Layer 8 Silver Iodobromide Emulsion II | Layer 14 Silver Iodobromide Emulsion III | Red-Sensitive Layer | | Green-Sensitive Layer | | Blue-Sensitive Layer | |
|---|---|---|---|---|---|---|---|---|---|
| | | | | Sensitivity | Fog | Sensitivity | Fog | Sensitivity | Fog |
| 701 (Comparative Example) | Em-201 | Em-201 | Em-201 | 100 | 0.06 | 100 | 0.07 | 100 | 0.08 |
| 702 (Present Invention) | Em-202 | Em-202 | Em-202 | 110 | 0.06 | 113 | 0.08 | 115 | 0.09 |
| 703 (Present Invention) | Em-203 | Em-203 | Em-203 | 112 | 0.06 | 115 | 0.07 | 118 | 0.08 |
| 704 (Present Invention) | Em-204 | Em-204 | Em-204 | 110 | 0.08 | 112 | 0.09 | 116 | 0.10 |
| 705 (Present Invention) | Em-205 | Em-205 | Em-205 | 110 | 0.07 | 112 | 0.09 | 117 | 0.10 |
| 706 (Present Invention) | Em-206 | Em-206 | Em-206 | 107 | 0.07 | 108 | 0.08 | 108 | 0.09 |
| 707 (Present Invention) | Em-207 | Em-207 | Em-207 | 106 | 0.06 | 109 | 0.09 | 109 | 0.10 |

As is apparent from Table 7-2, the emulsions of the present invention have an effect of increasing the sensitivity with almost no increase in fog.

Example 10

An aqueous solution obtained by dissolving 30 g of inactive gelatin and 6 g of potassium bromide in 1 liter of distilled water was stirred at 75° C., and 35 cc of an aqueous solution containing 5.0 g of silver nitrate and 35 cc of an aqueous solution containing 0.98 g of potassium iodide were added each at a rate of 70 cc/min for 30 seconds. Then the pAg increased to 10 and ripening was performed, thereby preparing a seed emulsion.

A predetermined amount of 1 liter of an aqueous solution, the solution containing 145 g of silver nitrate in 1 liter, and a solution of mixture of potassium bromide and potassium iodide were added in equimolar amounts, at a predetermined temperature, a predetermined pAg, and an adding rate close to a critical growth rate, thereby preparing a tabular core emulsion. Subsequently, the remaining aqueous silver nitrate solution and an aqueous solution of a mixture of potassium bromide and potassium iodide having a different composition from that used in core emulsion preparation were added in equimolar amounts, at an adding rate close to a critical growth rate to cover the core, thereby covering the core and preparing silver iodobromide tabular emulsions Em-101 to Em-104 of core/shell type.

The aspect ration was adjusted by selecting the pAg upon core and shell preparations. The results are shown in Table 8-1. The average sphere-equivalent diameter was 1.2 μm. in each of the emulsions Em-101 to Em-104, 85% or more of a total projected area of all grains were tabular grains.

TABLE 8-1

| Emulsion No. | Average Aspect Ratio | Average Grain Size (μm) | Average Grain Thickness (μm) | Average Iodide Content (mol %) |
|---|---|---|---|---|
| Em-101 | 2.8 | 1.21 | 0.55 | 7.6 |
| Em-102 | 6.7 | 1.74 | 0.30 | 7.6 |
| Em-103 | 9.8 | 2.10 | 0.25 | 7.6 |
| Em-104 | 17.4 | 2.75 | 0.18 | 7.6 |

Average Aspect Ratio: An arithmetical means of aspect ratios of grains obtained by extracting 1,000 emulsion grains at random, measuring aspect rations of the grains, and selecting grains corresponding to 50% of a total projected surface area from those having larger aspect ratios.

In grain formation following the same procedures as for Em-101 to Em-104, a thiosulfonic acid compound 1-2 was added in amounts listed in Table 8-2 in a reaction vessel one minute before shell formation was started, thereby preparing emulsions Em-105 to Em-108. IN grain formation following the same procedures as for Em-105 to Em-108, a thiosulfonic acid compound 1-16 was used in place of the thiosulfonic acid compound 1-2, thereby preparing emulsions Em-109 to 112.

TABLE 8-2

| Emulsion No. | Thiosulfonic Acid Compound | Addition Amount (per mol of silver) | Basic Emulsion |
|---|---|---|---|
| Em-105 | 1-2 | $3 \times 10^{-5}$ mol | Em-101 |
| Em-106 | " | " | Em-102 |
| Em-107 | " | " | Em-103 |
| Em-108 | " | " | Em-104 |
| Em-109 | 1-16 | $3 \times 10^{-5}$ mol | Em-101 |
| Em-110 | " | " | Em-102 |
| Em-111 | " | " | Em-103 |
| Em-112 | " | " | Em-104 |

In grain formation following the same procedures as for Em-101 to Em-104, thiourea dioxide was added as a reduction sensitizer in the amounts listed in Table 8-3 one minute after shell formation was started, thereby preparing emulsions Em-113 to Em-116. Dimethylamineborane and tin chloride were added in place of thiourea dioxide as a reduction sensitizer in Em-113 to Em-116, thereby preparing emulsions Em-117 to Em-120 and emulsions Em-121 to Em-125.

TABLE 8-3

| Emulsion No. | Reduction Sensitizer | Addition Amount (per mol of silver) | Basic Emulsion |
|---|---|---|---|
| Em-113 | Thiourea Dioxide | $1 \times 10^{-4}$ mol | Em-101 |
| Em-114 | " | " | Em-102 |
| Em-115 | " | " | Em-103 |
| Em-116 | " | " | Em-104 |
| Em-117 | Dimethylamineborane | $1 \times 10^{-5}$ mol | Em-101 |
| Em-118 | " | " | Em-102 |
| Em-119 | " | " | Em-103 |
| Em-120 | " | " | Em-104 |
| Em-121 | Tin Chloride | $3 \times 10^{-5}$ mol | Em-101 |
| Em-122 | " | " | Em-102 |
| Em-123 | " | " | Em-103 |
| Em-124 | " | " | Em-104 |

In grain formation following the same procedures as for Em-101 to Em-104, a thiosulfonic acid compound was added in the amounts listed in table 8-4 one minute before shell formation was started, and a reduction sensitizer was added in the amounts as listed in Table 8-4 one minute after shell formation was started, thereby preparing emulsions Em-125 to Em-148.

TABLE 8-4

| Emulsion No. | Thiosulfonic Acid Compound: Compound | Thiosulfonic Acid Compound: Addition Amount (per mol of silver) | Reduction Sensitizer: Compound | Reduction Sensitizer: Addition Amount (per mol of silver) | Basic Emulsion |
|---|---|---|---|---|---|
| Em-125 | 1-2 | $3 \times 10^{-5}$ mol | Thiourea Dioxide | $1 \times 10^{-4}$ mol | Em-101 |
| Em-126 | " | " | Thiourea Dioxide | " | Em-102 |
| Em-127 | " | " | Thiourea Dioxide | " | Em-103 |
| Em-128 | " | " | Thiourea Dioxide | " | Em-104 |
| Em-129 | " | " | Dimethyl-amineborane | $1 \times 10^{-5}$ mol | Em-101 |
| Em-130 | " | " | Dimethyl-amineborane | " | Em-102 |
| Em-131 | " | " | Dimethyl-amineborane | " | Em-103 |
| Em-132 | " | " | Dimethyl-amineborane | " | Em-104 |
| Em-133 | " | " | Tin | $3 \times 10^{-5}$ mol | Em-101 |

TABLE 8-4-continued

| Emulsion No. | Thiosulfonic Acid Compound: Compound | Thiosulfonic Acid Compound: Addition Amount (per mol of silver) | Reduction Sensitizer: Compound | Reduction Sensitizer: Addition Amount (per mol of silver) | Basic Emulsion |
|---|---|---|---|---|---|
| Em-134 | " | " | Chloride Tin Chloride | " | Em-102 |
| Em-135 | " | " | Chloride Tin Chloride | " | Em-103 |
| Em-136 | " | " | Chloride Tin Chloride | " | Em-104 |
| Em-137 | 1-16 | $3 \times 10^{-5}$ mol | Thiourea Dioxide | $1 \times 10^{-4}$ mol | Em-101 |
| Em-138 | " | " | Thiourea Dioxide | " | Em-102 |
| Em-139 | " | " | Thiourea Dioxide | " | Em-103 |
| Em-140 | " | " | Thiourea Dioxide | " | Em-104 |
| Em-141 | " | " | Dimethylamineborane | $1 \times 10^{-5}$ mol | Em-101 |
| Em-142 | " | " | Dimethylamineborane | " | Em-102 |
| Em-143 | " | " | Dimethylamineborane | " | Em-103 |
| Em-144 | " | " | Dimethylamineborane | " | Em-104 |
| Em-145 | " | " | Tin Chloride | $3 \times 10^{-5}$ mol | Em-101 |
| Em-146 | " | " | Tin Chloride | " | Em-102 |
| Em-147 | " | " | Tin Chloride | " | Em-103 |
| Em-148 | " | " | Tin Chloride | " | Em-104 |

Em-101 to Em-148 prepared as described above were optimally subjected to sulfur-plus-gold sensitization using sodium thiosulfate and chloroauric acid, and the following dyes were added just before coating, thereby preparing spectrally sensitized emulsions.

Dye Group (Green-Sensitive Dye)

Sensitizing Dye I $4.2 \times 10^{-5}$ mol/mol of Ag
Sensitizing Dye II $9.6 \times 10^{-5}$ mol/mol of Ag
Sensitizing Dye III $3.6 \times 10^{-4}$ mol/mol of Ag

I

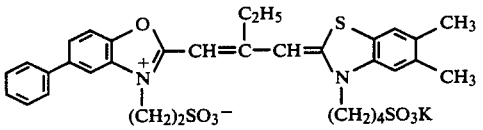

II

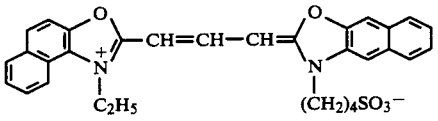

III

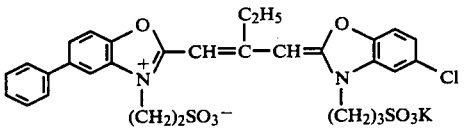

An emulsion layer and a protective layer in the amounts as described below were coated on triacetylcellulose film supports having undercoating layers.

(1) Emulsion Layer
Emulsion . . . spectrally sensitized emulsions Em-101 to Em-148 listed in Tables 8-1 to 8-4

-continued

| | |
|---|---|
| silver | $1.7 \times 10^{-2}$ mol/m$^2$ |
| Coupler | $1.5 \times 10^{-3}$ mol/m$^2$ |

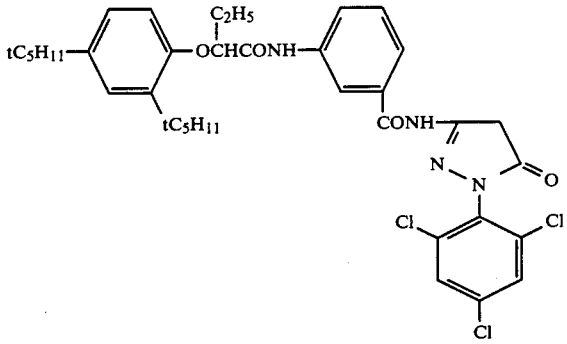

| | |
|---|---|
| Tricresylphosphate | 1.10 g/m$^2$ |
| Gelatin | 2.30 g/m$^2$ |
| (2) Protective Layer | |
| 2,4-dichlorotriazine-6-hydroxy-s-triazine sodium salt | 0.08 g/m$^2$ |
| Gelatin | 1.80 g/m$^2$ |

These samples were subjected to sensitometry exposure, and then to the following color development.

The processed samples were subjected to density measurement by using a green filter. The obtained photographic performance results are listed in Table 8-5.

Development was performed under the following conditions at a temperature of 38° C.

| | |
|---|---|
| 1. Color Development | 2 min. 45 sec. |
| 2. Bleaching | 6 min. 30 sec. |

-continued

| | |
|---|---|
| 3. Washing | 3 min. 15 sec. |
| 4. Fixing | 6 min. 30 sec. |
| 5. Washing | 3 min. 15 sec. |
| 6. Stabilizing | 3 min. 15 sec. |

The compositions of processing solutions used in the above steps were as follows.

| | |
|---|---|
| Color Developer: | |
| Sodium Nitrilotriacetic Acid | 1.4 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-ethyl-N-β-hydroxyethylamino)-2-methyl-aniline Sulfate | 4.5 g |
| Water to make | 1 l |
| Bleaching Solution: | |
| Sodium Bromide | 160.0 g |
| Aqueous Ammonia (28%) | 25.0 ml |
| Sodium Iron (II) Ethylenediaminetetraacetate | 130 g |
| Glacial Acetic Acid Trihydrate | 14 ml |
| Water to make | 1 l |
| Fixing Solution: | |
| Sodium Tetrapolyphosphate | 2.0 g |
| Sodium Sulfite | 4.0 g |
| Ammonium Thiosulfate (700 g/l) | 175.0 ml |
| Sodium Bisulfite | 4.6 g |

-continued

| | |
|---|---|
| Water to make | 1 l |
| Stabilizing Solution: | |
| Formalin | 8.0 ml |
| Water to make | 1 l |

In this case, normal wedge exposure was performed for one and 1/100 seconds.

A light source was adjusted at a color temperature of 4,800° K. by using a filter, and a yellow filter (SC-52 (tradename): available from Fuji Photo Film Co. Ltd.) was used. Sensitivities were compared at a point from a fog by an optical density of 0.2. The sensitivities are listed assuming that the sensitivity of a sample using the emulsion Em-101 is 100 (100 for both 1/100" and 1").

A response to stress of each sample was evaluated as follows. That is, each sample was wound around a columnar rod having a diameter of 6 mm so that the emulsion surface of the sample faces inward and held in this state for 10 seconds. Thereafter, wedge exposure was performed under the same conditions as described above for 1/100 seconds, and development and density measurement were performed following the same procedures as described above. The results of sensitivity and fog are listed in Table 8-5. An emulsion having low desensitization caused by stress or a small change in fog is preferable.

TABLE 8-5

| | Not Bent | | | Bent | | |
|---|---|---|---|---|---|---|
| Emulsion No. | 1-sec Exposure Sensitivity | 1/100-sec Exposure Sensitivity | Fog | 1/100-sec Exposure Sensitivity | Fog | Remarks |
| Em-101 | 100 | 100 | 0.21 | 100 | 0.23 | Comparative Example |
| Em-102 | 102 | 102 | 0.22 | 98 | 0.24 | Comparative Example |
| Em-103 | 100 | 102 | 0.22 | 93 | 0.28 | Comparative Example |
| Em-104 | 100 | 101 | 0.23 | 87 | 0.30 | Comparative Example |
| Em-105 | 92 | 94 | 0.18 | 94 | 0.19 | Comparative Example |
| Em-106 | 94 | 95 | 0.19 | 92 | 0.22 | Comparative Example |
| Em-107 | 90 | 92 | 0.18 | 89 | 0.22 | Comparative Example |
| Em-108 | 91 | 94 | 0.20 | 86 | 0.24 | Comparative Example |
| Em-109 | 80 | 83 | 0.19 | 83 | 0.20 | Comparative Example |
| Em-110 | 83 | 85 | 0.19 | 82 | 0.22 | Comparative Example |
| Em-111 | 80 | 83 | 0.18 | 80 | 0.22 | Comparative Example |
| Em-112 | 78 | 81 | 0.19 | 79 | 0.22 | Comparative Example |
| Em-113 | 102 | 102 | 0.25 | 100 | 0.26 | Comparative Example |
| Em-114 | 105 | 104 | 0.27 | 99 | 0.29 | Comparative Example |

TABLE 8-5-continued

| Emulsion No. | Not Bent 1-sec Exposure Sensitivity | Not Bent 1/100-sec Exposure Sensitivity | Not Bent Fog | Bent 1/100-sec Exposure Sensitivity | Bent Fog | Remarks |
|---|---|---|---|---|---|---|
| Em-115 | 104 | 104 | 0.28 | 94 | 0.32 | Comparative Example |
| Em-116 | 102 | 101 | 0.30 | 89 | 0.35 | Comparative Example |
| Em-117 | 101 | 102 | 0.30 | 101 | 0.31 | Comparative Example |
| Em-118 | 103 | 102 | 0.32 | 98 | 0.35 | Comparative Example |
| Em-119 | 102 | 102 | 0.35 | 93 | 0.39 | Comparative Example |
| Em-120 | 101 | 101 | 0.37 | 88 | 0.41 | Comparative Example |
| Em-121 | 103 | 102 | 0.28 | 100 | 0.30 | Comparative Example |
| Em-122 | 104 | 103 | 0.30 | 98 | 0.33 | Comparative Example |
| Em-123 | 102 | 102 | 0.31 | 93 | 0.35 | Comparative-Example |
| Em-124 | 102 | 102 | 0.33 | 89 | 0.36 | Comparative Example |
| Em-125 | 123 | 120 | 0.23 | 118 | 0.24 | Comparative Example |
| Em-126 | 128 | 125 | 0.23 | 122 | 0.25 | Present Invention |
| Em-127 | 130 | 128 | 0.24 | 126 | 0.26 | Present Invention |
| Em-128 | 130 | 128 | 0.25 | 123 | 0.27 | Present Invention |
| Em-129 | 128 | 124 | 0.25 | 124 | 0.26 | Comparative Example |
| Em-130 | 133 | 130 | 0.25 | 129 | 0.26 | Present Invention |
| Em-131 | 137 | 133 | 0.26 | 131 | 0.27 | Present Invention |
| Em-132 | 138 | 132 | 0.26 | 127 | 0.28 | Present Invention |
| Em-133 | 118 | 115 | 0.24 | 114 | 0.26 | Comparative Example |
| Em-134 | 121 | 119 | 0.25 | 118 | 0.28 | Present Invention |
| Em-135 | 123 | 121 | 0.26 | 119 | 0.28 | Present Invention |
| Em-136 | 125 | 122 | 0.26 | 116 | 0.29 | Present Invention |
| Em-137 | 115 | 111 | 0.22 | 110 | 0.24 | Comparative Example |
| Em-138 | 119 | 115 | 0.23 | 115 | 0.25 | Present Invention |
| Em-139 | 121 | 117 | 0.23 | 115 | 0.25 | Present Invention |
| Em-140 | 122 | 118 | 0.23 | 113 | 0.26 | Present Inven- |

TABLE 8-5-continued

| Emulsion No. | Not Bent 1-sec Exposure Sensitivity | Not Bent 1/100-sec Exposure Sensitivity | Not Bent Fog | Bent 1/100-sec Exposure Sensitivity | Bent Fog | Remarks |
|---|---|---|---|---|---|---|
| | | | | | | tion |
| Em-141 | 120 | 116 | 0.24 | 115 | 0.25 | Comparative Example |
| Em-142 | 123 | 120 | 0.24 | 118 | 0.26 | Present Invention |
| Em-143 | 126 | 123 | 0.25 | 120 | 0.26 | Present Invention |
| Em-144 | 126 | 123 | 0.25 | 117 | 0.27 | Present Invention |
| Em-145 | 112 | 109 | 0.23 | 107 | 0.24 | Comparative Example |
| Em-146 | 116 | 113 | 0.23 | 111 | 0.25 | Present Invention |
| Em-147 | 118 | 115 | 0.23 | 112 | 0.26 | Present Invention |
| Em-148 | 120 | 116 | 0.24 | 111 | 0.26 | Present Invention |

As is apparent from Table 8-5, each emulsion subjected reduction sensitization in the presence of a thiosulfonic acid compound 1-2 or 1-16 during grain formation had high sensitivity especially in low-intensity exposure and low fog. In addition, a degree of desensitization or an increase in fogging density were small after the emulsion was bent.

In Em-101 to Em-104, when the average aspect ratio was large, photographic properties were largely degraded after the emulsion was bent. In Em-125 to Em-148, however, degradation in response to stress was suppressed when the average aspect ratio was increased. In addition, in Em-125 to Em-148, emulsions (having an average aspect ratio of 3 or more) of the present invention had slightly higher sensitivities.

Therefore, the emulsion of the present invention has the advantage of: (1) high sensitivity and (2) high response to stress (equivalent to that of a low-aspect-ratio emulsion) although it has a high aspect ratio.

Example 11

A plurality of layers having the following compositions were coated on an undercoated triacetylcellulose film support to prepare a sample 1201 as a multilayer color light-sensitive material.

Light-Sensitive Layer Composition

Numerals corresponding to the respective components indicate coating amounts in units of g/m$^2$ except that the silver halide and colloid silver are represented in a silver-converted coating amount, and that a coating amount of the sensitizing dye is represented in units of mols per mol of the silver halide in the same layer. Symbols representing additives have the following meanings. Note that if an additive has a plurality of effects, only one of the effects is shown.

U: ultraviolet absorbent, HBS: high-boiling organic solvent, Ex: coupler, S: additive

Sample 1201

| | |
|---|---|
| Layer 1: Antihalation Layer | |
| Black Colloid Silver | silver 0.18 |
| Gelatin | 1.40 |
| Layer 2: Interlayer | |
| 2,5-di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Layer 3: 1st Red-Sensitive Emulsion Layer | |
| Monodisperse Silver Iodobromide Emulsion (silver iodide = 6 mol %, average grain size = 0.6 μm, variation coefficient of grain size = 0.15) | silver 0.55 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.20 |
| Layer 4: 2nd Red-Sensitive Emulsion Layer | |
| Tabular Silver Iodobromide Emulsion (silver iodide = 10 mol %, average grain size = 0.7 μm, average aspect ratio = 5.5, average thickness = 0.2 μm) | silver 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| EX-10 | 0.015 |
| Gelatin | 1.30 |
| Layer 5: 3rd Red-Sensitive Emulsion Layer | |
| Silver Iodobromide Emulsion XI | silver 1.60 |
| Sensitizing Dye IX | $5.4 \times 10^{-5}$ |
| Sensitizing Dye II | $1.4 \times 10^{-5}$ |

-continued

| | |
|---|---|
| Sensitizing Dye III | $2.4 \times 10^{-4}$ |
| Sensitizing Dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| Layer 6: Interlayer | |
| EX-5 | 0.040 |
| HBS-1 | 0.020 |
| Gelatin | 0.80 |
| Layer 7: 1st Green-Sensitive Emulsion Layer | |
| Tabular Silver Iodobromide Emulsion (silver iodide = 6 mol %, average grain size = 0.6 μm, average aspect ratio = 6.0, average thickness = 0.15 μm) | silver 0.40 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| Layer 8: 2nd Green-Sensitive Emulsion Layer | |
| Monodisperse Silver Iodobromide Emulsion (silver iodide = 9 mol %, average grain size = 0.7 μm, variation coefficient of grain size = 0.18) | silver 0.80 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| Layer 9: 3rd Green-Sensitive Emulsion Layer | |
| Silver Iodobromide Emulsion XI | silver 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| Layer 10: Yellow Filter Layer | |
| Yellow Colloid Silver | silver 0.05 |
| EX-5 | 0.08 |
| HBS-3 | 0.03 |
| Gelatin | 0.95 |
| Layer 11: 1st Blue-Sensitive Emulsion Layer | |
| Tabular Silver Iodobromide Emulsion (silver iodide = 6 mol %, average grain size = 0.6 μm, average aspect ratio = 5.7, average thickness = 0.15 μm) | silver 0.24 |
| Sensitizing Dye VIII | $3.5 \times 10^{-4}$ |
| EX-9 | 0.85 |
| EX-8 | 0.12 |
| HBS-1 | 0.28 |
| Gelatin | 1.28 |
| Layer 12: 2nd Blue-Sensitive Emulsion Layer | |
| Monodisperse Silver Iodobromide Emulsion (silver iodide = 10 mol %, average grain size = 0.8 μm, variation coefficient of grain size = 0.16) | silver 0.45 |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |
| Layer 13: 3rd Blue-Sensitive Emulsion Layer | |
| Silver Iodobromide Emulsion XI | silver 0.77 |
| Sensitizing Dye VIII | $2.2 \times 10^{-4}$ |

-continued

| | |
|---|---|
| EX-9 | 0.20 |
| HBS-1 | 0.07 |
| Gelatin | 0.69 |
| Layer 14: 1st Protective Layer | |
| Silver Iodobromide Emulsion (silver iodide = 1 mol %, average grain size = 0.07 μm) | silver 0.5 |
| U-4 | 0.11 |
| U-5 | 0.17 |
| HBS-1 | 0.90 |
| Gelatin | 1.00 |
| Layer 15: 2nd Protective Layer | |
| Polymethylacrylate Grains (grain size = about 1.5 μm) | 0.54 |
| S-1 | 0.15 |
| S-2 | 0.05 |
| Gelatin | 0.72 |

In addition to the above components, a gelatin hardener H-1 and/or a surfactant were added to each layer. Structures of the used compounds are listed in Table D to be presented later.

Samples 1202 to 1208 were prepared following the same procedures as for the sample 1201 except that the silver iodobromide emulsion XI in the layers 5, 9, and 3 was changed. The emulsion subjected to gold-plus-sulfur sensitization in Example 1 was used.

These samples were subjected to sensitometry exposure to perform the following color development.

The processed samples were subjected to density measurement by using red, green, and blue filters. The obtained results are shown in Table 9-1.

The results of photographic performance are represented by relative sensitivities of the red-, green-, and blue-sensitive layers assuming that the sensitivities of the sample 1201 are each 100.

Processing Method

The color development process was performed at 38° C. in accordance with the following process steps.

| | |
|---|---|
| Color Development | 3 min. 15 sec. |
| Bleaching | 6 min. 30 sec. |
| Washing | 2 min. 10 sec. |
| Fixing | 4 min. 20 sec. |
| Washing | 3 min. 15 sec. |
| Stabilization | 1 min. 05 sec. |

The processing solution compositions used in the respective steps were as follows.

| | |
|---|---|
| Color Developing Solution: | |
| Diethylenetriaminepentaacetic Acid | 1.0 g |
| 1-hydroxyethylidene-1,1-diphosphonic acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-ethyl-N-β-hydroxyethylamino)-2-methylanilinesulfate | 4.5 g |
| Water to make | 1.0 l |
| pH | 10.0 |
| Bleaching Solution: | |
| Ferric Ammonium Ethylenediaminetetraacetate | 100.0 g |
| Disodium Ethylenediaminetetraacetate | 10.0 g |
| Ammonium Bromide | 150.0 g |
| Ammonium Nitrate | 10.0 g |

-continued

| | |
|---|---|
| Water to make | 1.0 l |
| pH | 6.0 |
| Fixing Solution: | |
| Disodium Ethylenediaminetetraacetate | 1.0 g |
| Sodium Sulfite | 4.0 g |
| Ammonium Thiosulfate Aqueous Solution (70%) | 175.0 ml |
| Sodium Bisulfite | 4.6 g |
| Water to make | 1.0 l |
| pH | 6.6 |
| Stabilizing Solution: | |
| Formalin (40%) | 2.0 ml |
| Polyoxyethylene-p-monononyl-phenylether (average polymerization degree = 10) | 0.3 g |
| Water to make | 1.0 l |

The response to stress was evaluated following the same procedures as in Example 10 such that each sample was bent and subjected to sensitometry exposure as described above. Similar color development was performed (3 min. 15 sec.) and then density was measured by using a blue filter, thereby measuring fog and sensitivity of a blue-sensitive layer. Sensitivities are represented by relative sensitivities assuming that the sensitivity of the sample 1201 is 100.

The sharpness was evaluated by measuring the MTF of the red-sensitive layer. The MTF value was measured in accordance with a method described in "The Theory of Photographic Process", 3rd ed., Macmillan. Exposure was performed by white light, and cyan colored density was measured by using a red filter. The MTF value with respect to a spacial frequency of 25 cycle/mm at cyan colored density of 1.0 is shown as a typical value. Larger MTF values are more preferable.

TABLE 9-1

| Sample No. | Silver Iodide Emulsion XI | Red-sensitive Layer Sensitivity | Red-sensitive Layer Fog | Green-sensitive Layer Sensitivity | Green-sensitive Layer Fog | Blue-sensitive Layer Sensitivity | Blue-sensitive Layer Fog | After Bent (Blue) Sensitivity | After Bent (Blue) Fog | MTF (Red) |
|---|---|---|---|---|---|---|---|---|---|---|
| 1201 (Comparative Example) | Em-101 | 100 | 0.13 | 100 | 0.15 | 100 | 0.23 | 100 | 0.24 | 0.53 |
| 1202 (Comparative Example) | Em-102 | 102 | 0.13 | 101 | 0.15 | 101 | 0.24 | 97 | 0.25 | 0.58 |
| 1203 (Comparative Example) | Em-103 | 104 | 0.14 | 102 | 0.15 | 101 | 0.24 | 91 | 0.27 | 0.61 |
| 1204 (Comparative Example) | Em-104 | 104 | 0.14 | 102 | 0.16 | 100 | 0.24 | 85 | 0.28 | 0.62 |
| 1205 (Comparative Example) | Em-129 | 118 | 0.15 | 116 | 0.18 | 117 | 0.26 | 116 | 0.26 | 0.52 |
| 1206 (Present Invention) | Em-130 | 122 | 0.15 | 123 | 0.18 | 121 | 0.26 | 119 | 0.26 | 0.59 |
| 1207 (Present Invention) | Em-131 | 125 | 0.15 | 123 | 0.18 | 123 | 0.27 | 120 | 0.28 | 0.61 |
| 1208 (Present Invention) | Em-132 | 128 | 0.16 | 127 | 0.18 | 125 | 0.26 | 119 | 0.28 | 0.63 |

As is apparent from Table 9-1, the color photographic light-sensitive material of the present invention has high sensitivity and good sharpness and response to stress.

Example 12

A plurality of layers having the following compositions were coated on an undercoated cellulose triacetate film support to prepare sample 1301 as a multilayer color light-sensitive material.

Compositions of Light-Sensitive Layers

The coating amounts are represented in units of g/m$^2$ except that the coating amounts of a silver halide and colloid silver are represented in units of g/m$^2$ of silver, and that of sensitizing dyes is represented by the number of mols per mol of the silver halide in the same layer. Symbols representing additives have the following meanings. Note that if an additive has a plurality of effects, only one of the effects is shown.

UV: ultraviolet absorbent, Solv: high-boiling organic solvent, W: coating aid, H: hardener, ExS: sensitizing dye, ExC: cyan coupler, ExM: magenta coupler ExY: yellow coupler, Cpd: additive

| | |
|---|---|
| Layer 1: Antihalation Layer | |
| Black Colloid Silver coating silver amount | 0.2 |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Layer 2: Interlayer | |
| Fine Silver Bromide Grain (sphere-equivalent diameter = 0.07 μm) coating silver amount | 0.15 |
| Gelatin | 1.0 |
| Cpd-2 | 0.2 |
| Layer 3: 1st Red-Sensitive Emulsion Layer | |
| Silver Iodobromide Emulsion (AgI = 10.0 mol %, internally high AgI type, sphere-equivalent diameter = 0.7 μm, variation coefficient of sphere-equivalent diameter = 14%, tetradecahedral grain) | 0.26 |

-continued

| | |
|---|---|
| coating silver amount | |
| Silver Iodobromide Emulsion (AgI = 4.0 mol %, internally high AgI type, sphere-equivalent diameter = 0.4 μm, variation coefficient of sphere-equivalent diameter = 22%, tetradecahedral grain) | 0.2 |
| coating silver amount | |
| Gelatin | 1.0 |
| ExS-1 | $4.5 \times 10^{-4}$ |
| ExS-2 | $1.5 \times 10^{-4}$ |
| ExS-3 | $0.4 \times 10^{-4}$ |
| ExS-4 | $0.3 \times 10^{-4}$ |
| ExC-1 | 0.33 |
| ExC-2 | 0.009 |
| ExC-3 | 0.023 |
| ExC-6 | 0.14 |
| Layer 4: 2nd Red-Sensitive Emulsion Layer | |
| Silver Iodobromide Emulsion (AgI = 16 mol %, internally high AgI type, sphere-equivalent diameter = 1.0 μm, variation coefficient of sphere-equivalent diameter = 25%, tabular grain, diameter/thickness ratio = 4.0) | 0.55 |
| coating silver amount | |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-3 | 0.05 |
| ExC-4 | 0.10 |
| ExC-6 | 0.08 |
| Layer 5: 3rd Red-Sensitive Emulsion Layer | |
| Silver Iodobromide Emulsion XI (internally high AgI type, sphere-equivalent diameter = 1.2 μm, variation coefficient of sphere-equivalent diameter = 28%) | 0.9 |
| coating silver amount | |
| Gelatin | 0.6 |
| ExS-1 | $2 \times 10^{-4}$ |
| ExS-2 | $0.6 \times 10^{-4}$ |
| ExS-3 | $0.2 \times 10^{-4}$ |
| ExC-4 | 0.07 |
| ExC-5 | 0.06 |
| Solv-1 | 0.12 |
| Solv-2 | 0.12 |
| Layer 6: Interlayer | |
| Gelatin | 1.0 |
| Cpd-4 | 0.1 |
| Layer 7: 1st Green-Sensitive Emulsion Layer | |
| Silver Iodobromide Emulsion (AgI = 10.0 mol %, internally high AgI type, sphere-equivalent diameter = 1.7 μm, variation coefficient of sphere-equivalent diameter = 14%, tetradecahedral grain) | 0.2 |
| coating silver amount | |
| Silver Iodobromide Emulsion (AgI = 4.0 mol %, internally high AgI type, sphere-equivalent diameter = 0.4 μm, variation coefficient of sphere-equivalent diameter = 22%, tetradecahedral grain) | 0.1 |
| coating silver amount | |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.41 |
| ExM-2 | 0.10 |
| ExM-5 | 0.03 |
| Solv-1 | 0.2 |
| Solv-5 | 0.03 |
| Layer 8: 2nd Green-Sensitive Emulsion Layer | |
| Silver Iodobromide Emulsion (AgI = 10 mol %, internally high iodide type, sphere-equivalent diameter = 1.0 μm, variation coefficient of sphere-equivalent diameter = 25%, tabular grain, diameter/thickness ratio = 3.0) | 0.4 |
| coating silver amount | |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |

-continued

| | |
|---|---|
| ExM-1 | 0.09 |
| ExM-3 | 0.01 |
| Solv-1 | 0.15 |
| Solv-5 | 0.03 |
| Layer 9: Interlayer | |
| Gelatin | 0.5 |
| Layer 10: 3rd Green-Sensitive Emulsion Layer | |
| Silver Iodobromide Emulsion XI (internally high AgI type, sphere-equivalent diameter = 1.2 μm) | 1.0 |
| coating silver amount | |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |
| ExC-4 | 0.005 |
| Solv-1 | 0.2 |
| Layer 11: Yellow Filter Layer | |
| Cpd-3 | 0.05 |
| Gelatin | 0.5 |
| Solv-1 | 0.1 |
| Layer 12: Interlayer | |
| Gelatin | 0.5 |
| Cpd-2 | 0.1 |
| Layer 13: 1st Blue-Sensitive Emulsion Layer | |
| Silver Iodobromide Emulsion (AgI = 10 mol %, internally high iodide type, sphere-equivalent diameter = 0.7 μm, variation coefficient of sphere-equivalent diameter = 14%, tetradecahedral grain) | 0.1 |
| coating silver amount | |
| Silver Iodobromide Emulsion (AgI = 4.0 mol %, internally high iodide type, sphere-equivalent diameter = 0.4 μm, variation coefficient of sphere-equivalent diameter = 22%, tetradecahedral grain) | 0.05 |
| coating silver amount | |
| Gelatin | 1.0 |
| ExS-8 | $3 \times 10^{-4}$ |
| ExY-1 | 0.53 |
| ExY-2 | 0.02 |
| Solv-1 | 0.15 |
| Layer 14: 2nd Blue-Sensitive Emulsion Layer | |
| Silver Iodobromide Emulsion (AgI = 19.0 mol %, internally high AgI type, sphere-equivalent diameter = 1.0 μm, variation coefficient of sphere-equivalent diameter = 16%, tetradecahedral grain) | 0.19 |
| coating silver amount | |
| Gelatin | 0.3 |
| ExS-8 | $2 \times 10^{-4}$ |
| ExY-1 | 0.22 |
| Solv-1 | 0.07 |
| Layer 15: Interlayer | |
| Fine Silver Iodobromide Grain (AgI = 2 mol %, homogeneous, sphere-equivalent diameter = 0.13 μm) | 0.2 |
| coating silver amount | |
| Gelatin | 0.36 |
| Layer 16: 3rd Blue-Sensitive Emulsion Layer | |
| Silver Iodobromide Emulsion XI (internally high AgI type, sphere-equivalent diameter = 1.2 μm) | 1.0 |
| coating silver amount | |
| Gelatin | 0.5 |
| ExS-8 | $1.5 \times 10^{-4}$ |
| ExY-1 | 0.2 |
| Solv-4 | 0.07 |
| Layer 17: 1st Protective Layer | |
| Gelatin | 1.8 |
| UV-1 | 0.1 |
| UV-2 | 0.2 |
| Solv-1 | 0.01 |
| Solv-2 | 0.01 |
| Layer 18: 2nd Protective Layer | |
| Fine Silver Bromide Grain (sphere-equivalent diameter = 0.07 μm) | 0.18 |
| coating silver amount | |

-continued

| | |
|---|---|
| Gelatin | 0.7 |
| Polymethylmethacrylate Grain (diameter = 1.5 μm) | 0.2 |
| W-1 | 0.02 |
| H-1 | 0.4 |
| Cpd-5 | 1.0 |

Formulas of the above compounds used in the sample 1301 will be listed in Table E to be presented later.

Samples 1302 to 1308 were prepared following the same procedures as for the sample 1301 except that the silver iodobromide emulsion XI in the layers 5, 10, and 16 was changed. The emulsion subjected to gold-plus-sulfur sensitization in Example 1 was used.

These samples were subjected to sensitometry exposure to perform color development following the same procedures as in Example 11.

The processed samples were subjected to density measurement by using red, green, and blue filters. The obtained results are shown in Table 10-1.

The results of photographic performance are represented by relative sensitivities of the red-, green-, and blue-sensitive layers assuming that the sensitivities of the sample 1301 are each 100.

The response to stress and sharpness were evaluated following the same procedures as in Example 11. The shown MTF value is the value with respect a spacial frequency of 25 cycle/mm at cyan colored density of 1.2. These results are shown in Table 10-1.

TABLE 10

| Sample No. | Silver Iodide Emulsion XI | Red-sensitive Layer Sensitivity | Red-sensitive Layer Fog | Green-sensitive Layer Sensitivity | Green-sensitive Layer Fog | Blue-sensitive Layer Sensitivity | Blue-sensitive Layer Fog | After Bent (Blue) Sensitivity | After Bent (Blue) Fog | MTF (Red) |
|---|---|---|---|---|---|---|---|---|---|---|
| 1301 (Comparative Example) | Em-101 | 100 | 0.09 | 100 | 0.12 | 100 | 0.14 | 100 | 0.15 | 0.41 |
| 1302 (Comparative Example) | Em-102 | 104 | 0.10 | 102 | 0.13 | 102 | 0.15 | 98 | 0.17 | 0.46 |
| 1303 (Comparative Example) | Em-103 | 102 | 0.10 | 102 | 0.14 | 101 | 0.15 | 90 | 0.19 | 0.49 |
| 1304 (Comparative Example) | Em-104 | 102 | 0.11 | 102 | 0.14 | 101 | 0.15 | 84 | 0.20 | 0.50 |
| 1305 (Comparative Example) | Em-137 | 110 | 0.10 | 110 | 0.13 | 109 | 0.15 | 107 | 0.16 | 0.40 |
| 1306 (Present Invention) | Em-138 | 115 | 0.11 | 115 | 0.14 | 113 | 0.15 | 111 | 0.16 | 0.46 |
| 1307 (Present Invention) | Em-139 | 117 | 0.11 | 115 | 0.14 | 115 | 0.16 | 113 | 0.17 | 0.48 |
| 1308 (Present Invention) | Em-140 | 117 | 0.12 | 116 | 0.14 | 115 | 0.16 | 110 | 0.18 | 0.50 |

As is apparent from Table 10-1, the color photographic light-sensitive material of the present invention has high sensitivity and good sharpness and response to stress.

Example 13

A plurality of layers having the following compositions were coated on an undercoated cellulose triacetate film support to prepare sample 1401 as a multilayer color light-sensitive material.

Compositions of Light-Sensitive Layers

The coating amount of a silver halide and colloid silver is represented in units of $g/m^2$ of silver, that of couplers, additives, and gelatin is represented in units of $g/m^2$, and that of sensitizing dyes is represented by the number of mols per mol of the silver halide in the same layer. Symbols representing additives have the following meanings. Note that if an additive has a plurality of effects, only one of the effects is shown.

UV: ultraviolet absorbent, Solv: high-boiling organic solvent, ExF: dye, ExS: sensitizing dye, ExC: cyan coupler, ExM: magenta coupler, ExY: yellow coupler, Cpd: additive

| | |
|---|---|
| Layer 1: Antihalation Layer | |
| Black Colloid Silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |
| Layer 2: Low-Sensitivity Red-Sensitive Emulsion Layer | |
| Silver Iodobromide Emulsion (AgI = 4 mol %, homogeneous type, sphere-equivalent diameter = 0.4 μm, variation coefficient of sphere-equivalent diameter = 37%, tabular grain, diameter/thickness ratio = 3.0) coating silver amount | 0.4 |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |
| ExC-2 | 0.03 |
| ExC-3 | 0.13 |
| Layer 3: Intermediate-Sensitivity Red-Sensitive Emulsion Layer | |
| Silver Iodobromide Emulsion (AgI = 6 mol %, internally high AgI type having core/shell ratio of 2:1, sphere-equivalent diameter = | 0.65 |

-continued

| | |
|---|---|
| 0.65 μm, variation coefficient of sphere-equivalent diameter = 25%, tabular grain, diameter/thickness ratio = 2.0) | |
| coating silver amount | |
| Silver Iodobromide Emulsion (AgI = 4 mol %, homogeneous AgI type, sphere-equivalent diameter = 0.4 μm, variation coefficient of sphere-equivalent diameter = 37%, tabular grain, diameter/thickness ratio = 3.0) | 0.1 |
| coating silver amount | |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-4}$ |
| ExC-1 | 0.31 |
| ExC-2 | 0.01 |
| ExC-3 | 0.06 |
| Layer 4: High-Sensitivity Red-Sensitive Emulsion Layer | |
| Silver Iodobromide Emulsion XI (internally high AgI type, sphere-equivalent diameter = 1.2 μm) | 0.9 |
| coating silver amount | |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |
| Layer 5: Interlayer | |
| Gelatin | 0.6 |
| UV-4 | 0.03 |
| UV-5 | 0.04 |
| Cpd-1 | 0.1 |
| Polyethylacrylate Latex | 0.08 |
| Solv-1 | 0.05 |
| Layer 6: Low-Sensitivity Green-Sensitive Emulsion Layer | |
| Silver Iodobromide Emulsion (AgI = 4 mol %, homogeneous type, sphere-equivalent diameter = 0.7 μm, variation coefficient of sphere equivalent diameter = 37%, tabular grain, diameter/thickness ratio = 2.0) | 0.18 |
| coating silver amount | |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |
| Layer 7: Intermediate-Sensitivity Green-Sensitive Emulsion Layer | |
| Silver Iodobromide Emulsion (AgI = 4 mol %, surface high AgI type having core/shell ratio of 1:1, sphere-equivalent diameter = 0.5 μm, variation coefficient of sphere-equivalent diameter = 20%, tabular grain, diameter/thickness ratio = 4.0) | 0.27 |
| coating silver amount | |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| Layer 8: High-Sensitivity Green-Sensitive Emulsion Layer | |
| Silver Iodobromide Emulsion XI (internally high AgI type, sphere-equivalent diameter = 1.2 μm) | 0.7 |

-continued

| | |
|---|---|
| coating silver amount | |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |
| Layer 9: Interlayer | |
| Gelatin | 0.6 |
| Cpd-1 | 0.04 |
| Polyethylacrylate Latex | 0.12 |
| Solv-1 | 0.02 |
| Layer 10: Donor Layer having Interlayer Effect on Red-Sensitive Layer | |
| Silver Iodobromide Emulsion (AgI = 6 mol %, internally high AgI type having core/shell ratio of 2:1, sphere-equivalent diameter = 0.7 μm, variation coefficient of sphere-equivalent diameter = 25%, tabular grain, diameter/thickness ratio = 2.0) | 0.68 |
| coating silver amount | |
| Silver Iodobromide Emulsion (AgI = 4 mol %, homogeneous type, variation coefficient of sphere-equivalent diameter = 37%, tabular grain, diameter/thickness ratio = 3.0) | 0.19 |
| coating silver amount | |
| Gelatin | 1.0 |
| ExS-3 | $6 \times 10^{-4}$ |
| ExM-10 | 0.19 |
| Solv-1 | 0.20 |
| Layer 11: Yellow Filter Layer | |
| Yellow Colloid Silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| Layer 12: Low-Sensitivity Blue-Sensitive Emulsion Layer | |
| Silver Iodobromide Emulsion (AgI = 4.5 mol %, homogeneous AgI type, sphere-equivalent diameter = 0.7 μm, variation coefficient of sphere-equivalent diameter = 15%, tabular grain, diameter/thickness ratio = 7.0) | 0.3 |
| coating silver amount | |
| Silver Iodobromide Emulsion (AgI = 3 mol %, homogeneous AgI type, sphere-equivalent diameter = 0.3 μm, variation coefficient of sphere-equivalent diameter = 30%, tabular grain, diameter/thickness ratio = 7.0) | 0.15 |
| coating silver amount | |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| Layer 13: Interlayer | |
| Gelatin | 0.7 |
| ExY-12 | 0.20 |
| Solv-1 | 0.34 |
| Layer 14: High-sensitivity Blue-Sensitive Emulsion Layer | |
| Silver Iodobromide Emulsion XI (internally high AgI type, sphere-equivalent diameter = 1.2 μm) | 0.5 |
| coating silver amount | |
| Gelatin | 0.5 |
| ExS-6 | $1 \times 10^{-4}$ |
| ExY-9 | 0.01 |
| ExY-11 | 0.20 |
| ExC-1 | 0.02 |

-continued

| | |
|---|---|
| Solv-1 | 0.10 |
| Layer 15: 1st Protective Layer | |
| Fine Grain Silver Bromide Emulsion (AgI = 2 mol %, homogeneous AgI type, sphere-equivalent diameter = 0.07 μm) coating silver amount | 0.12 |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethylacrylate Latex | 0.09 |
| Layer 16: 2nd Protective Layer | |
| Fine Grain Silver Bromide Emulsion (AgI = 2 mol %, homogeneous AgI type, sphere-equivalent diameter = 0.07 μm) coating silver amount | 0.36 |
| Gelatin | 0.55 |
| Polyethylmethacrylate Grain (diameter = 1.5 μm) | 0.2 |
| H-1 | 0.17 |

In addition to the above components, a stabilizer Cpd-3 (0.07 g/m$^2$) for an emulsion and a surfactant Cpd-4 (0.03 g/m$^2$) were added as coating aids to each layer. Formulas of the used compounds will be listed in Table F to be presented below.

Emulsions 1402 to 1408 were prepared following the same procedures as for the sample 1402 except that the silver iodobromide emulsion XI in the layers 4, 8 and 14 was changed. The emulsion subjected to gold-plus-sulfur sensitization in Example 10 was used.

These samples were subjected to sensitometry exposure to perform color development following the same procedures as in Example 11.

The processed samples were subjected to density measurement by using red, green, and blue filters. The obtained results are shown in Table 11-1.

The results of photographic performance are represented by relative sensitivities of the red-, green-, and blue-sensitive layers assuming that the sensitivities of the sample 1401 are each 100.

The response to stress and sharpness were evaluated following the same procedures as in Example 11. The shown MTF value is the value with respect to a spacial frequency of 25 cycle/mm at cyan colored density of 1.3. These results are also listed in Table 11-1.

TABLE 11

| Sample No. | Silver Iodide Emulsion XI | Red-sensitive Layer Sensitivity | Red-sensitive Layer Fog | Green-sensitive Layer Sensitivity | Green-sensitive Layer Fog | Blue-sensitive Layer Sensitivity | Blue-sensitive Layer Fog | After Bent (Blue) Sensitivity | After Bent (Blue) Fog | MTF (Red) |
|---|---|---|---|---|---|---|---|---|---|---|
| 1401 (Comparative Example) | Em-101 | 100 | 0.07 | 100 | 0.09 | 100 | 0.10 | 100 | 0.11 | 0.55 |
| 1402 (Comparative Example) | Em-102 | 101 | 0.07 | 101 | 0.09 | 100 | 0.11 | 96 | 0.13 | 0.61 |
| 1403 (Comparative Example) | Em-103 | 102 | 0.08 | 102 | 0.09 | 101 | 0.11 | 92 | 0.15 | 0.63 |
| 1404 (Comparative Example) | Em-104 | 102 | 0.08 | 100 | 0.09 | 100 | 0.11 | 86 | 0.16 | 0.65 |
| 1405 (Comparative Example) | Em-125 | 116 | 0.08 | 110 | 0.10 | 113 | 0.11 | 112 | 0.12 | 0.54 |
| 1406 (Present Invention) | Em-126 | 120 | 0.08 | 115 | 0.10 | 117 | 0.11 | 117 | 0.13 | 0.60 |
| 1407 (Present Invention) | Em-127 | 122 | 0.08 | 117 | 0.11 | 120 | 0.12 | 118 | 0.14 | 0.62 |
| 1408 (Present Invention) | Em-128 | 121 | 0.09 | 118 | 0.11 | 120 | 0.12 | 115 | 0.14 | 0.65 |

As is apparent from Table 11-1, the color photographic light-sensitive material of the present invention has high sensitivity and good sharpness and response to stress.

Example 14

Emulsions were manufactured following the same procedures as for Em-130 except that a compound 2-9 or 3-8 was used in place of a thiosulfonic acid compound 1-2, thereby preparing two types of samples to be tested. Fog and sensitivity of the samples were measured following the same procedures as in Example 10. As a result, in the two types of samples, the effect that was suppressed and the sensitivity that was increased is shown.

TABLE A

| | |
|---|---|
| (1-1) | $CH_3SO_2SNa$ |
| (1-2) | $C_2H_5SO_2SNa$ |
| (1-3) | $C_3H_7SO_2SK$ |
| (1-4) | $C_4H_9SO_2SLi$ |
| (1-5) | $C_6H_{13}SO_2SNa$ |
| (1-6) | $C_8H_{17}SO_2SNa$ |
| (1-7) | $CH_3(CH_2)_3CH(C_2H_5)CH_2SO_2S.NH_4$ |
| (1-8) | $C_{10}H_{21}SO_2SNa$ |
| (1-9) | $C_{12}H_{25}SO_2SNa$ |
| (1-10) | $C_{16}H_{33}SO_2SNa$ |
| (1-11) | $(CH_3)_2CH-SO_2SK$ |

TABLE A-continued
(1-12) $t\text{-}C_4H_9SO_2SNa$
(1-13) $CH_3OCH_2CH_2SO_2SNa$
(1-14)
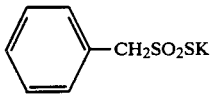
(1-15) $CH_2{=}CHCH_2SO_2Na$
(1-16)
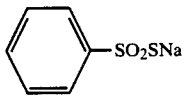
(1-17)
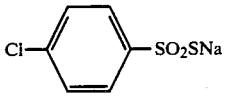
(1-18)
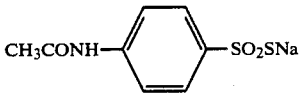
(1-19)
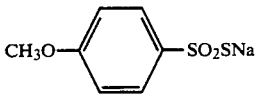
(1-20)
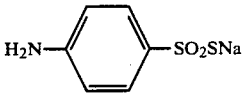
(1-21)
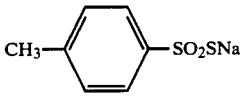
(1-22)
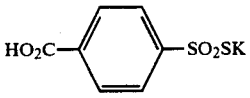
(1-23)
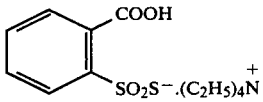
(1-24)
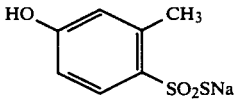
(1-25)
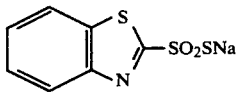
(1-26)
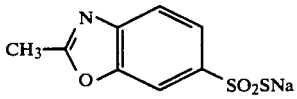
TABLE A-continued
(1-27)
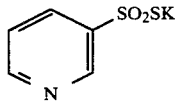
(1-28)
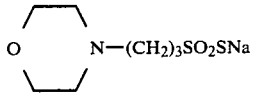
(1-29) $KSSO_2(CH_2)_2SO_2SK$
(1-30) $NaSSO_2(CH_2)_4SO_2SNa$
(1-31) $NaSSO_2(CH_2)_4S(CH_2)_4SO_2SNa$
(1-32)
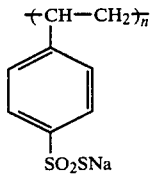
(1-33)
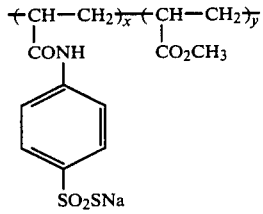
x:y = 1/1 (mole ratio)
(2-1) $C_2H_5SO_2SCH_3$
(2-2) $C_8H_{17}SO_2SCH_2CH_3$
(2-3)
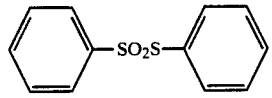
(2-4)
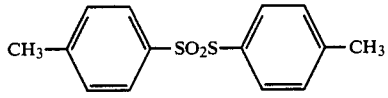
(2-5) $C_2H_5SO_2SCH_2CH_2CN$
(2-6)
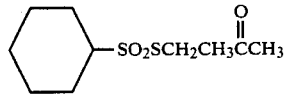
(2-7)
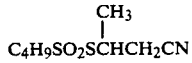
(2-8)
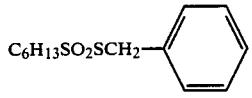
(2-9)
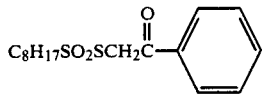

TABLE A-continued
(2-10)
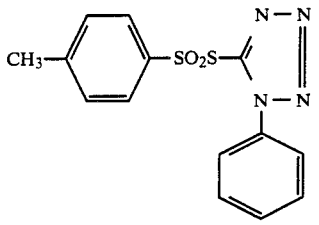
(2-11)
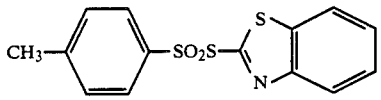
(2-12)
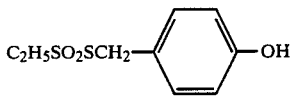
(2-13)
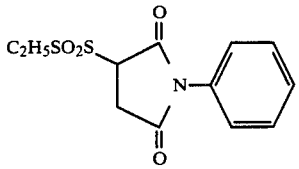
(2-14)
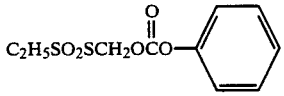
(2-15)
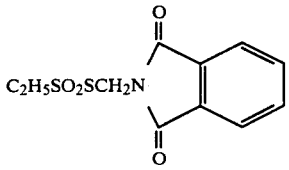
(2-16)
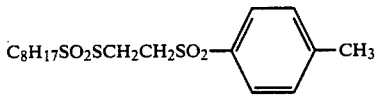
(2-17)
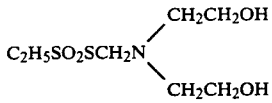
(2-18) $C_2H_5SO_2SCH_2CH_2CH_2CH_2OH$
(2-19)
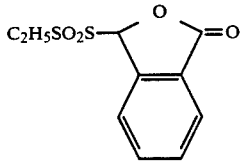
TABLE A-continued
(2-20)
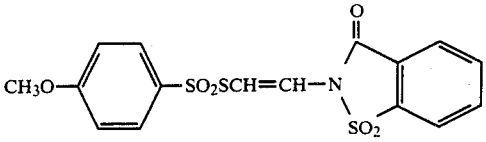
(2-21) $CH_3SSO_2(CH_2)_4SO_2SCH_3$
(2-22) $CH_3SSO_2(CH_2)_2SO_2SCH_3$
(2-23)
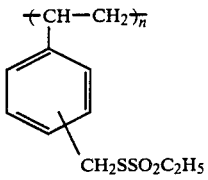
(2-24)
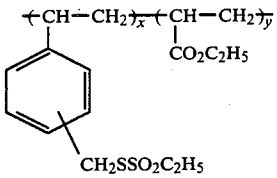
x:y = 2:1 (mole ratio)
(2-25)
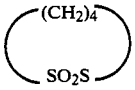
(3-1)
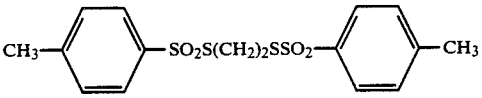
(3-2) $C_2H_5SO_2SCH_2CH_2SO_2CH_2CH_2SSO_2C_2H_5$
(3-3)
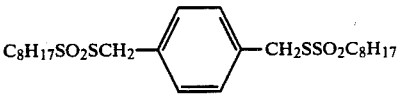
(3-4)
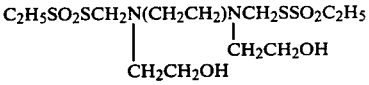
(3-5)
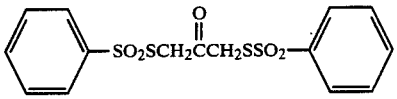
(3-6)
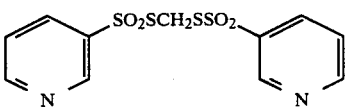
(3-7) $C_2H_5SO_2SSSO_2C_2H_5$
(3-8) $(n)C_3H_7SO_2SSSO_2C_3H_7(n)$
(3-9)
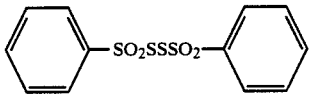

TABLE B
C-(1)
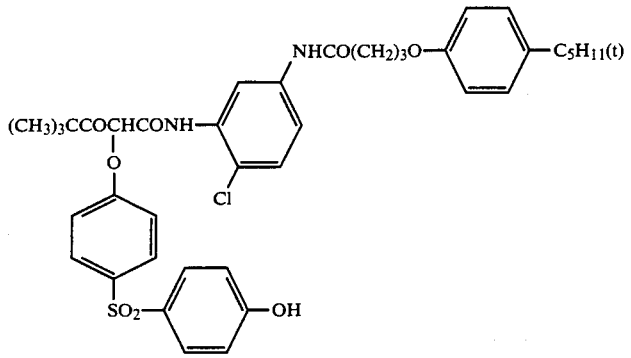
C-(2)
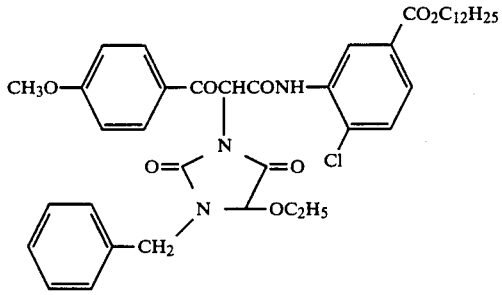
C-(3)
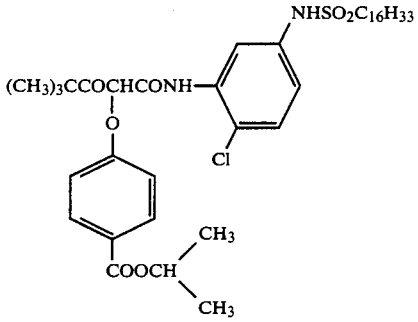
C-(4)
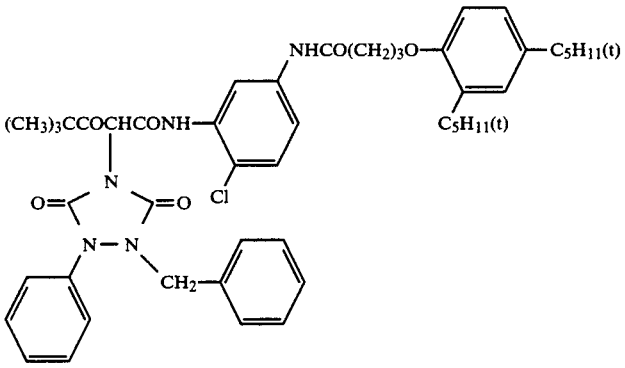
C-(5)
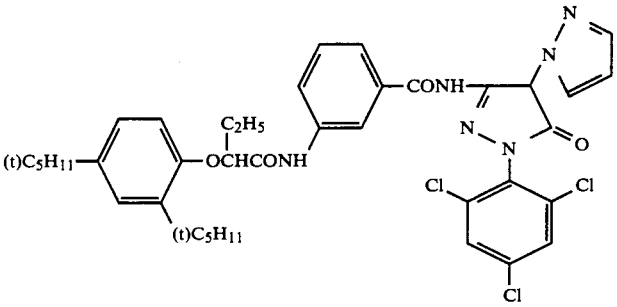

TABLE B-continued
C-(6)
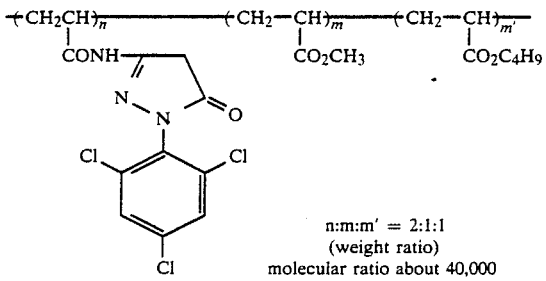
n:m:m' = 2:1:1
(weight ratio)
molecular ratio about 40,000
C-(7)
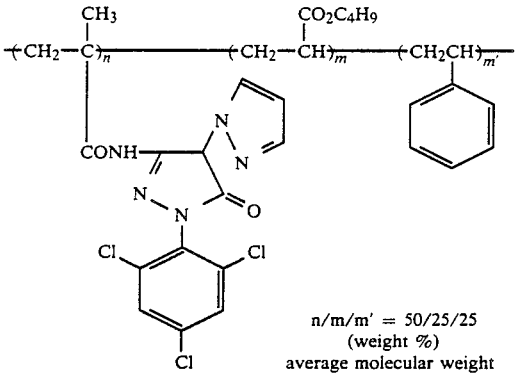
n/m/m' = 50/25/25
(weight %)
average molecular weight
about 30,000
C-(8)
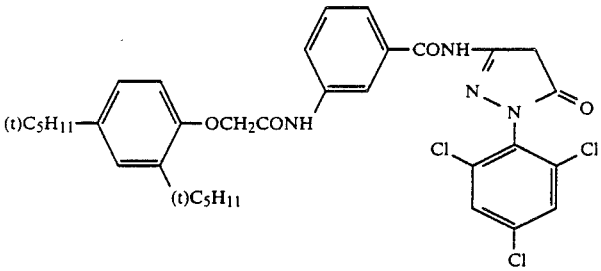
C-(9)
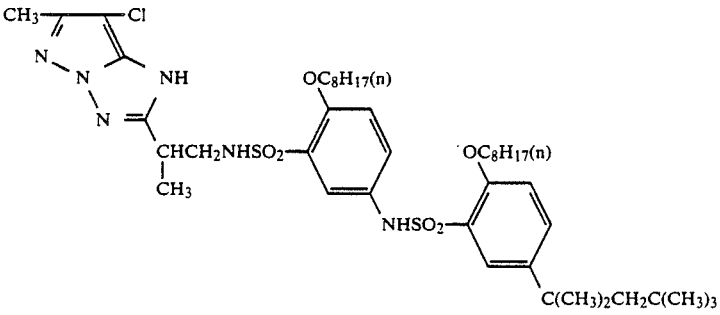
C-(10)
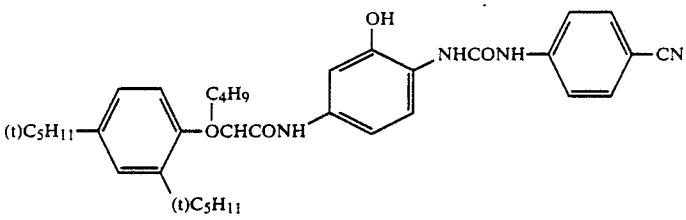

TABLE B-continued
C-(11)
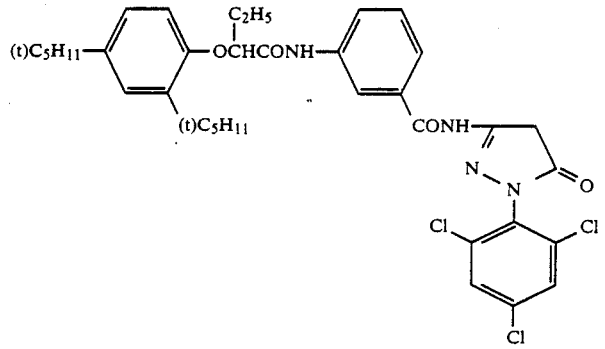
C-(12)
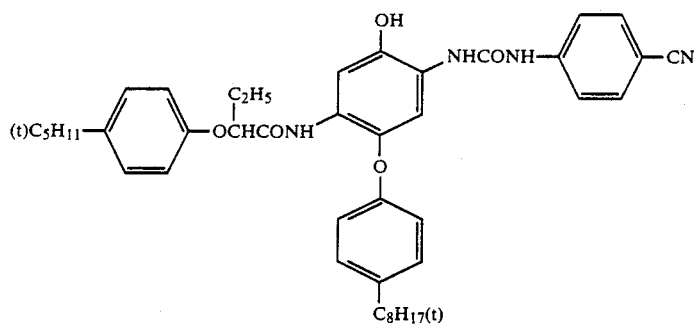
C-(13)
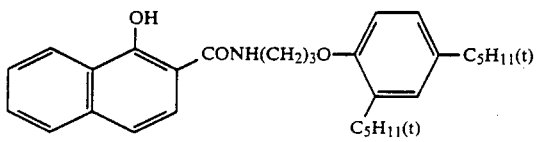
C-(14)
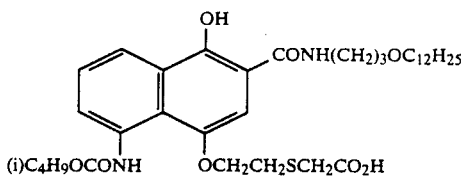
C-(15)
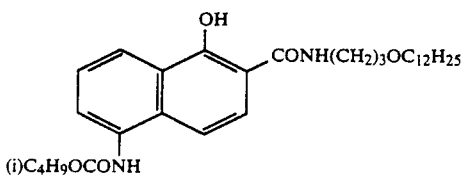
C-(16)
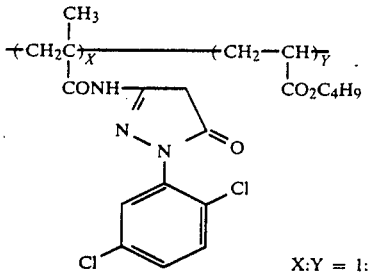
X:Y = 1:1 (weight ratio)

TABLE B-continued
C-(17)
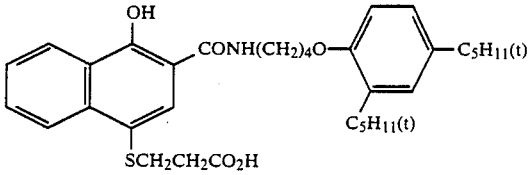
C-(18)
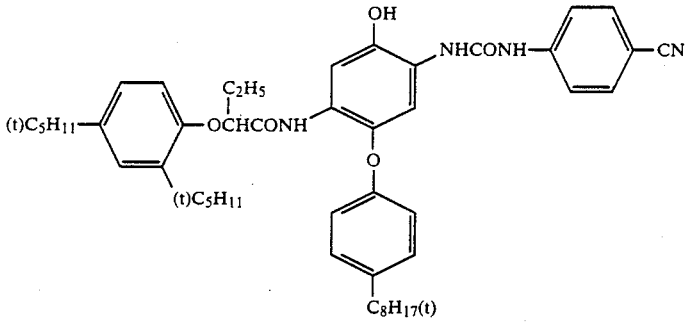
C-(19)
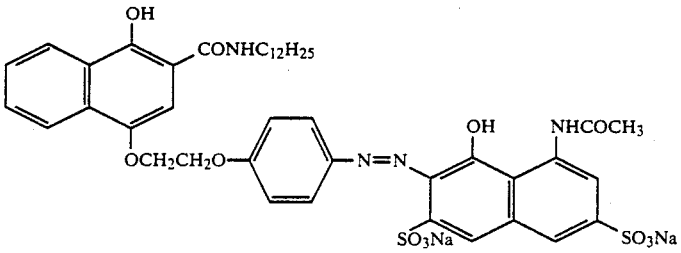
C-(20)
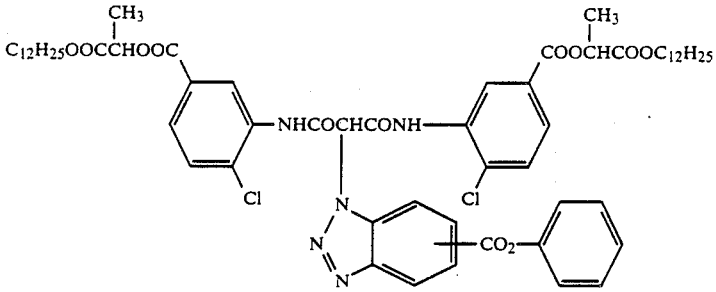
C-(21)
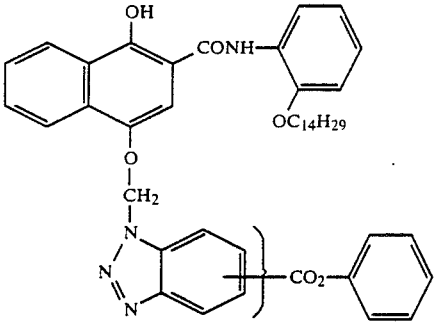

TABLE B-continued
C-(22)
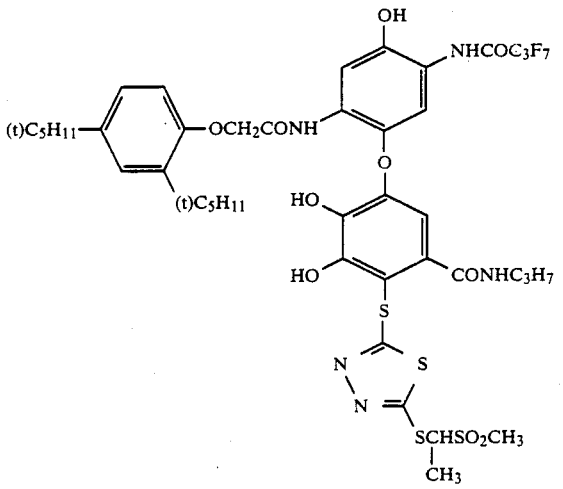
C-(23)
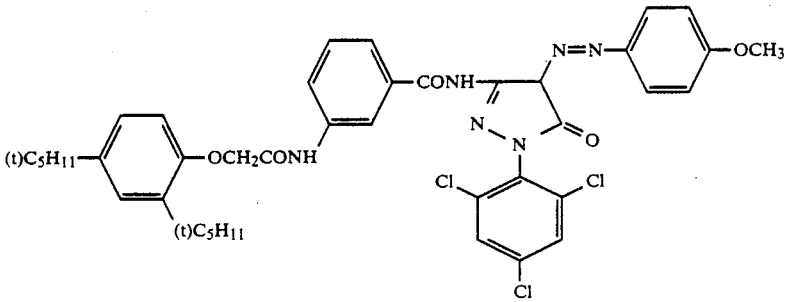
C-(24)
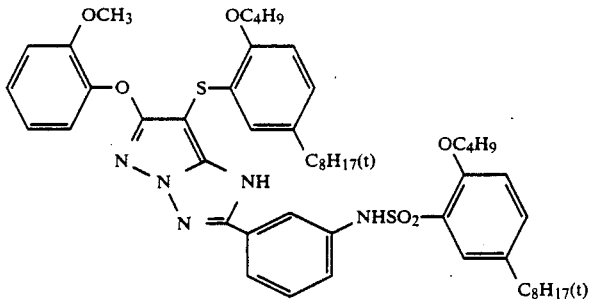
C-(25)
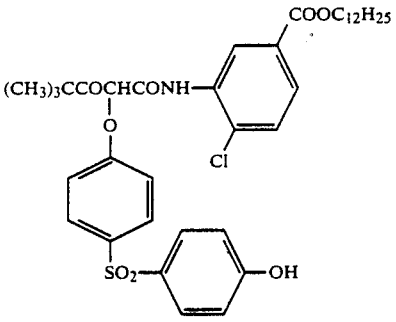

TABLE B-continued
C-(26)
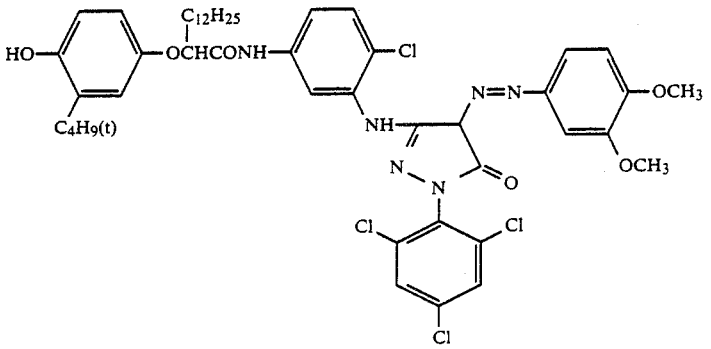
C-(27)
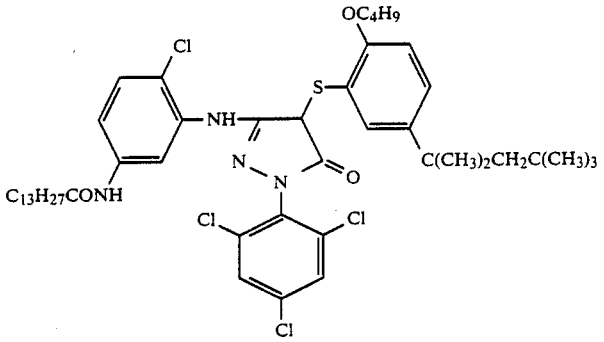
C-(28)
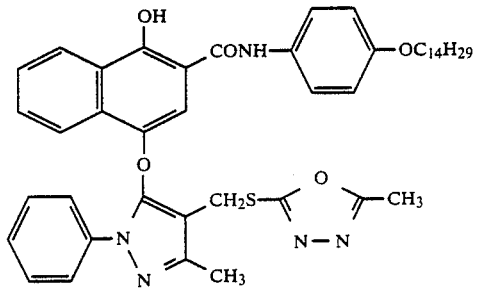
C-(29)
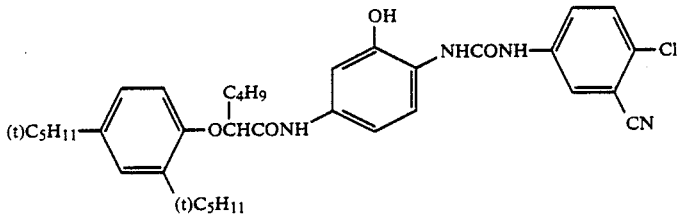
C-(30)
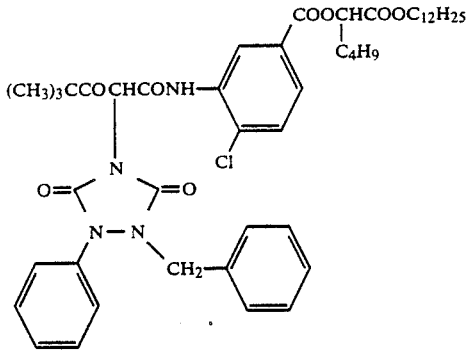

TABLE B-continued
C-(31)
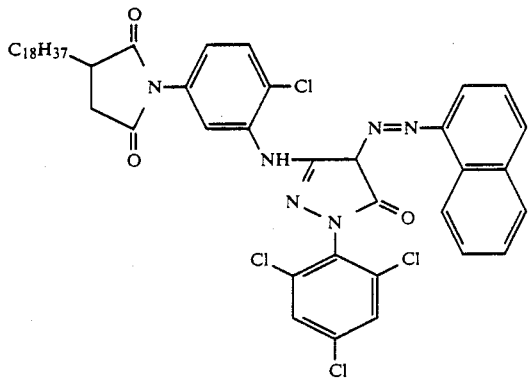
C-(32)
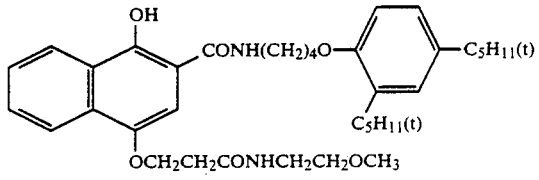
C-(33)
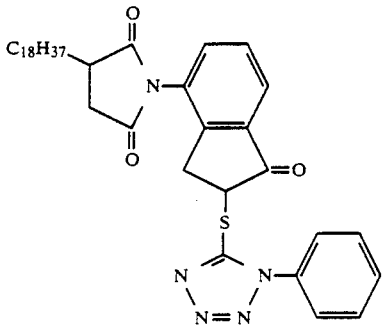
C-(34)
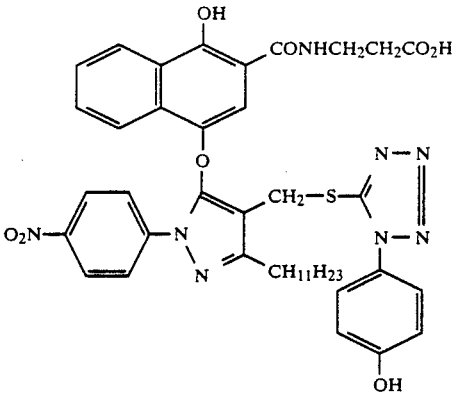
C-(35)
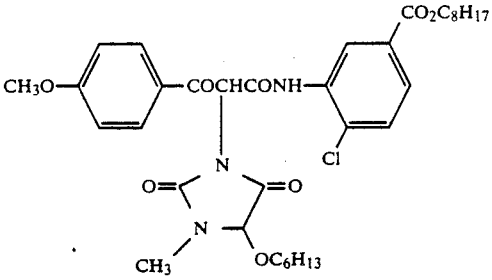

TABLE B-continued
C-(36)
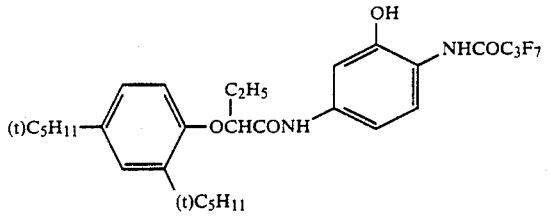
C-(37)
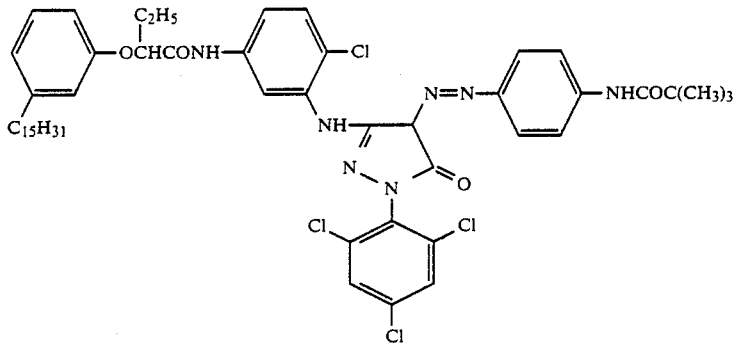
C-(38)
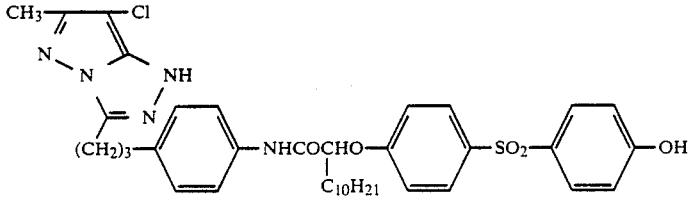
C-(39)
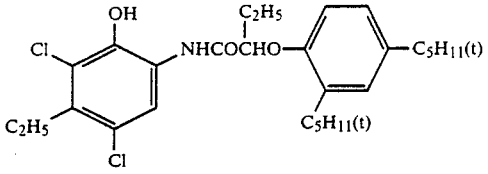
C-(40)
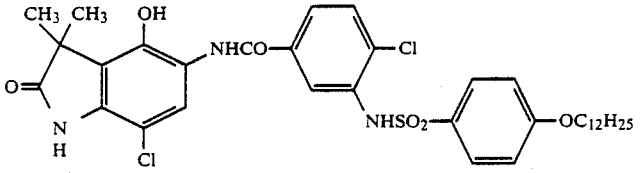
C-(41)
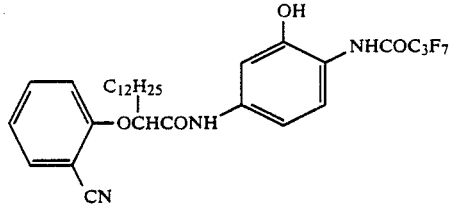

TABLE B-continued
C-(42)
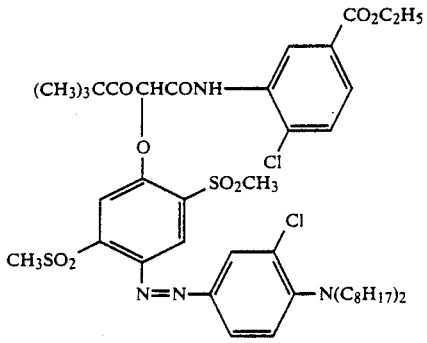
C-(43)
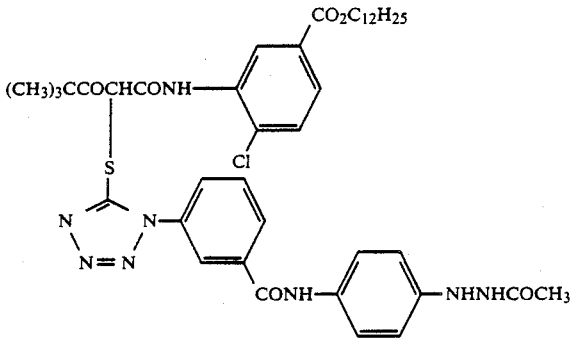
C-(44)
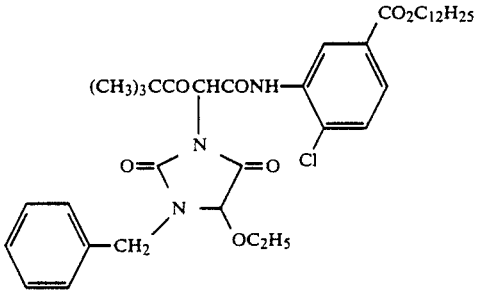
C-(45)
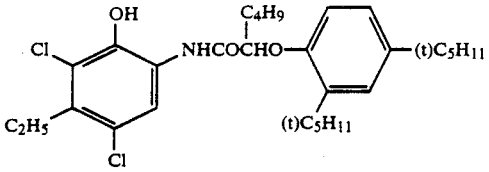
C-(46)
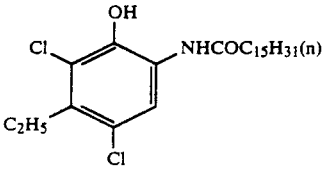
C-(47)
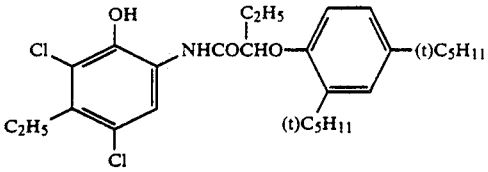

TABLE B-continued
C-(48)
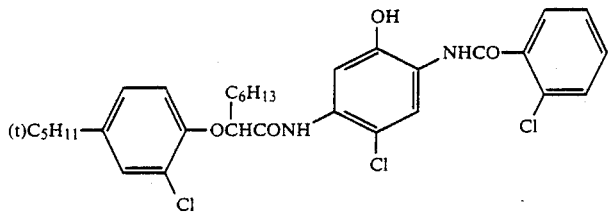
C-(49)
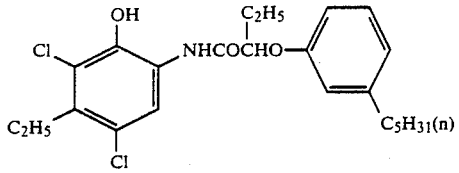
C-(50)
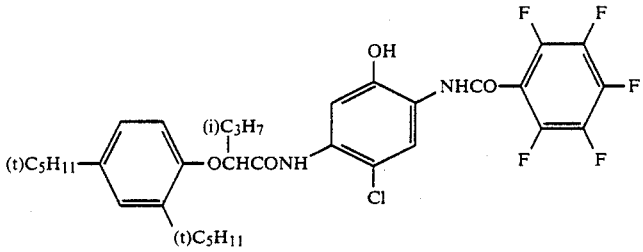
C-(51)
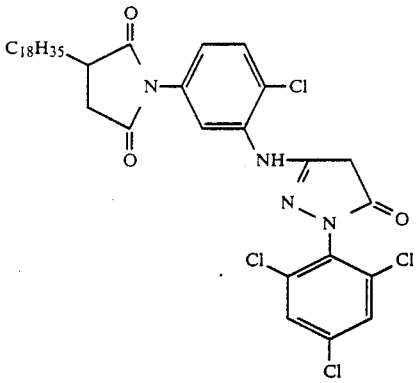
C-(52)
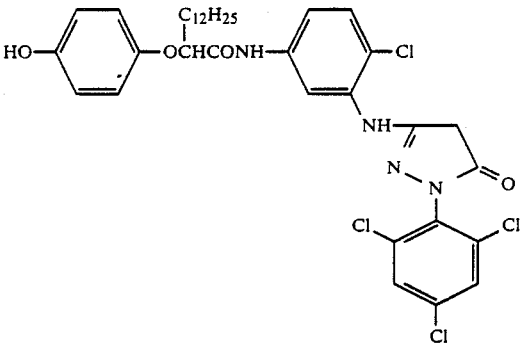

TABLE B-continued
C-(53)
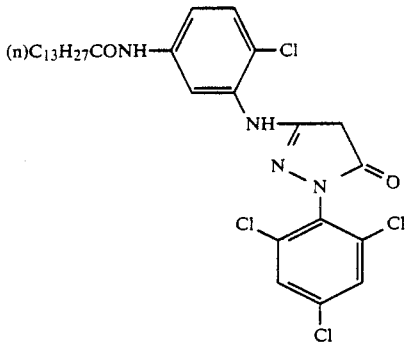
C-(54)
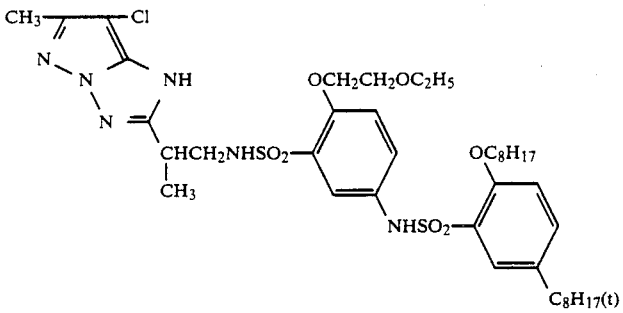
C-(55)
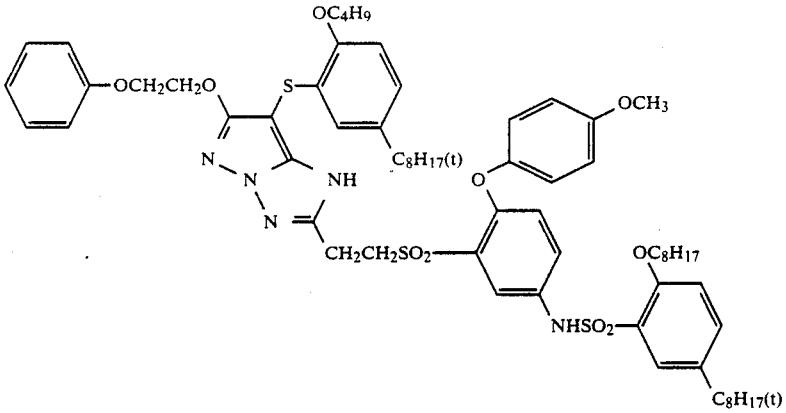
C-(56)
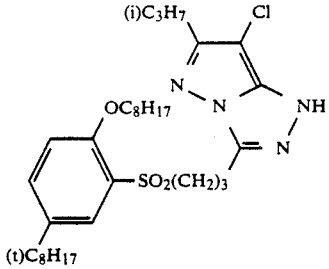

TABLE B-continued
C-(57)
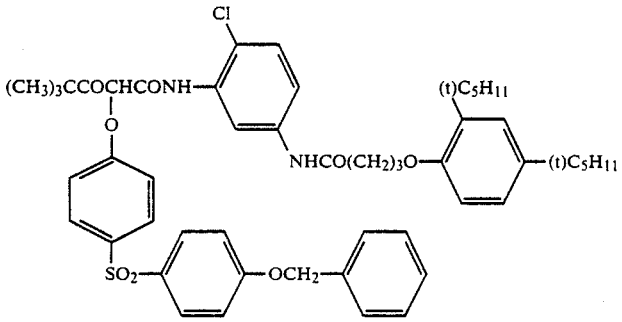
C-(58)
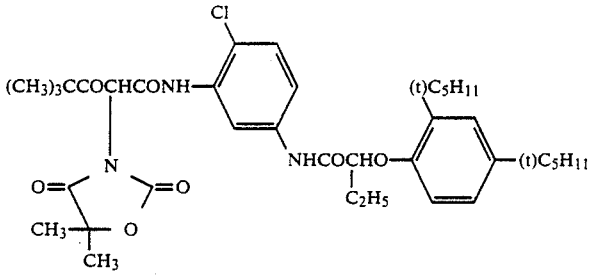
C-(59)
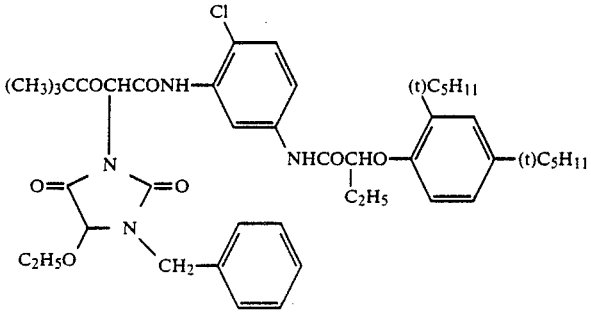
C-(60)
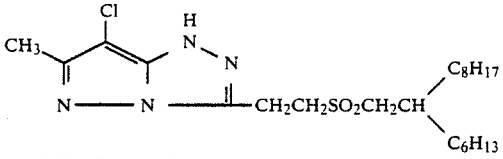
TABLE C
II
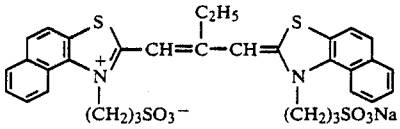
III
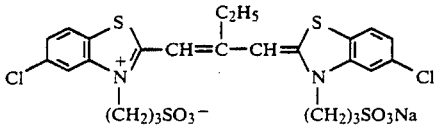
IV
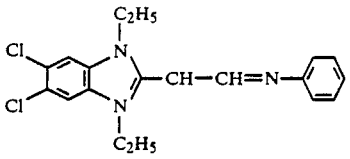
TABLE C-continued
V
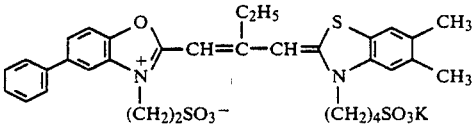
VI
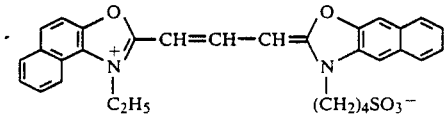
VII
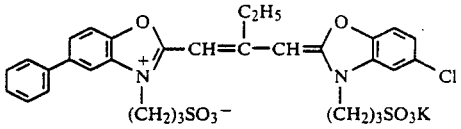

TABLE C-continued
VIII
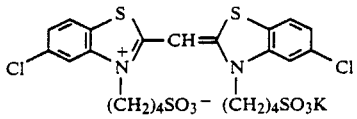
TABLE C-continued
IX
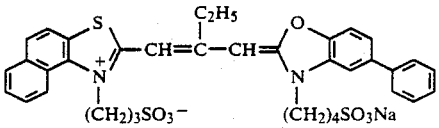
TABLE D
U-1
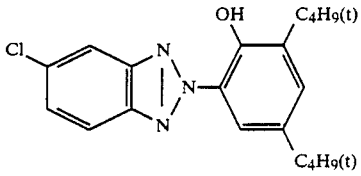
U-2
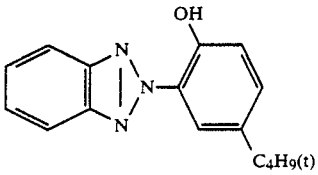
U-3
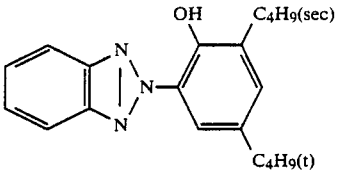
U-4
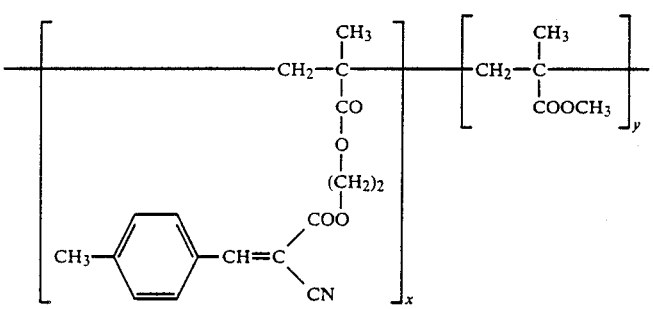
x:y = 7:3 (weight ratio)
U-5
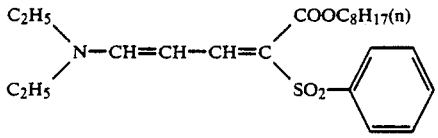
EX-1
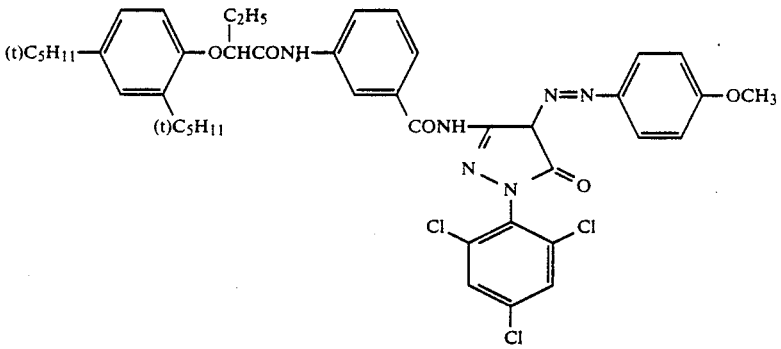

TABLE D-continued
EX-2
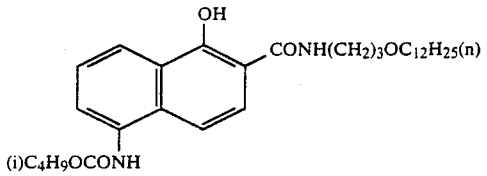
EX-3
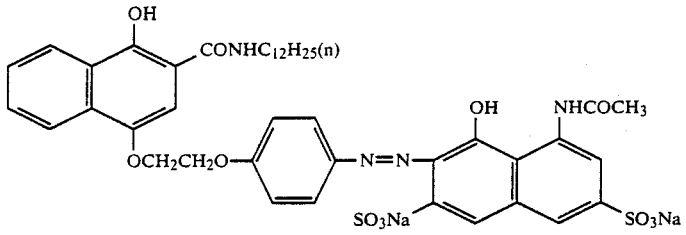
EX-4
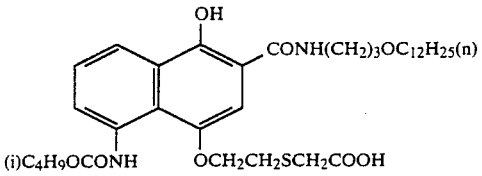
EX-5
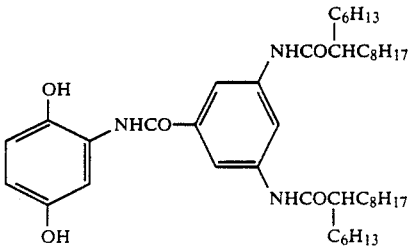
EX-6
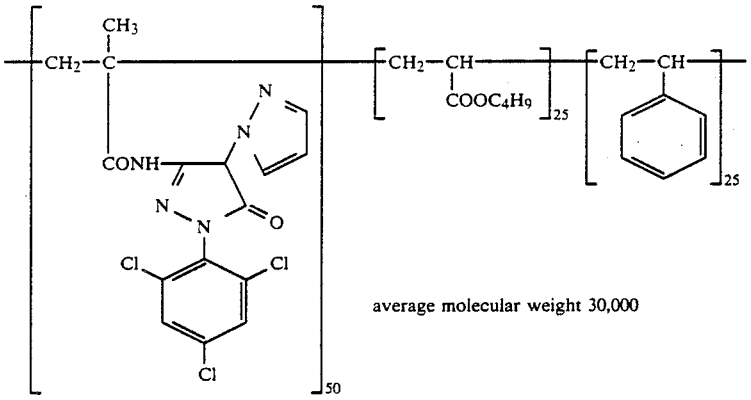
EX-7
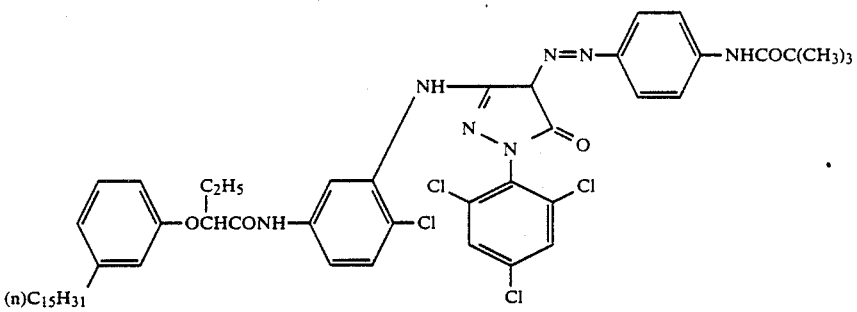

TABLE D-continued
EX-8
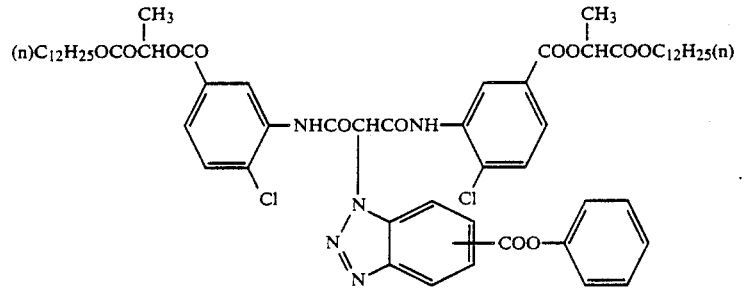
EX-9
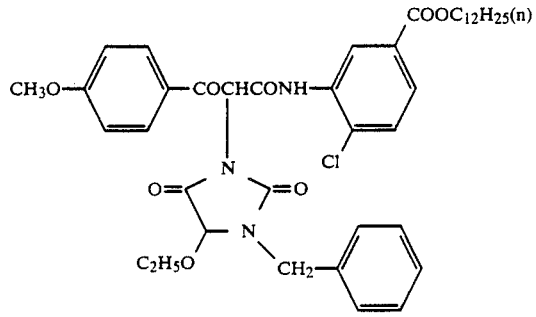
EX-10
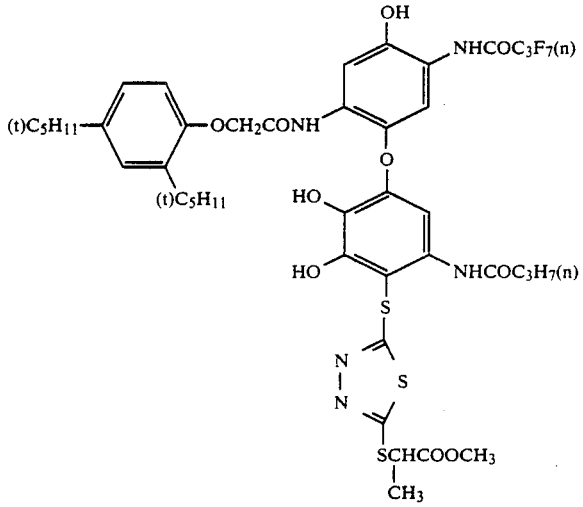
EX-11
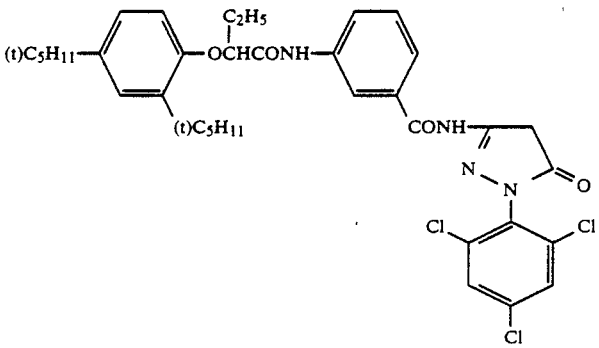
EX-12
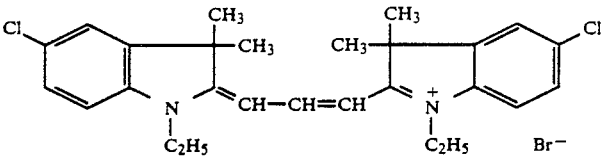

TABLE D-continued
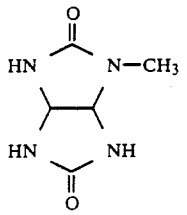
S-1
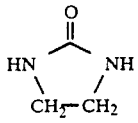
S-2
tricresyl phosphate HBS-1
dibutyl phtalate HBS-2
bis(2-ethylhexyl)phtalate HBS-3
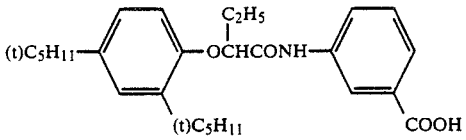
HBS-4
$CH_2{=}CHSO_2CH_2CONHCH_2$
$CH_2{=}CHSO_2CH_2CONHCH_2$ H-1
Spectral Sensitizing Dye I
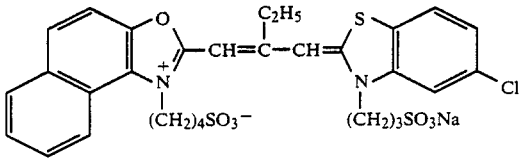
Sensitizing Dyes
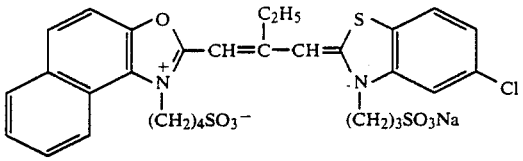
I
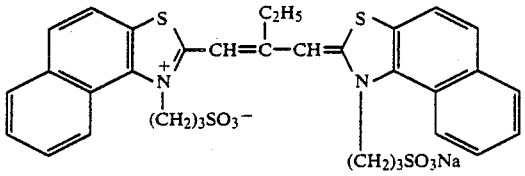
II
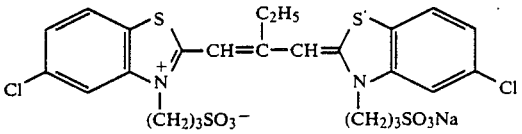
III
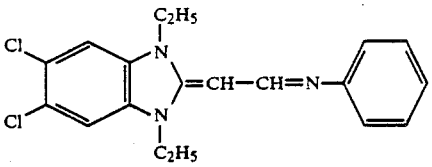
IV TABLE D-continued
V
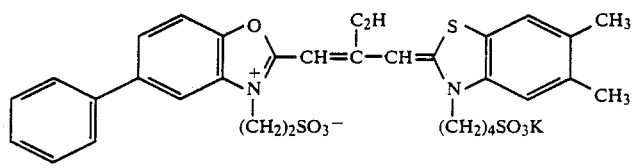
VI
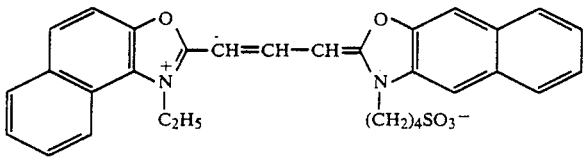
VII
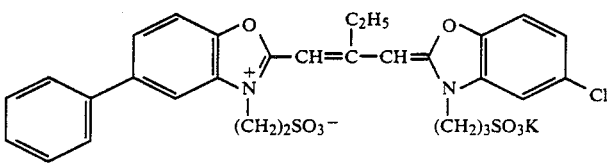
VIII
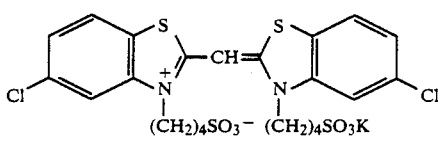
IX
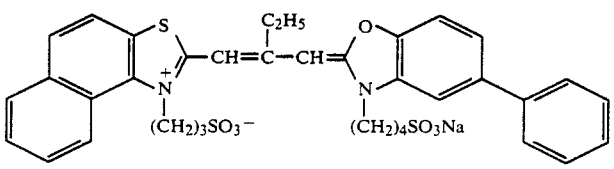
TABLE E
UV-1
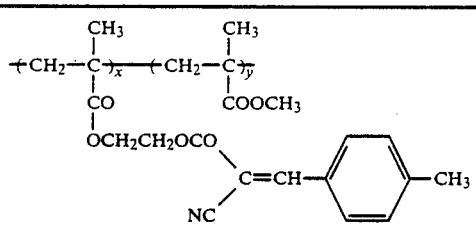
x/y = 7/3 (weight ratio)
UV-2
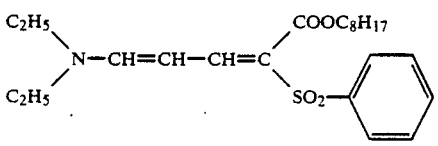

TABLE E-continued
ExM-3
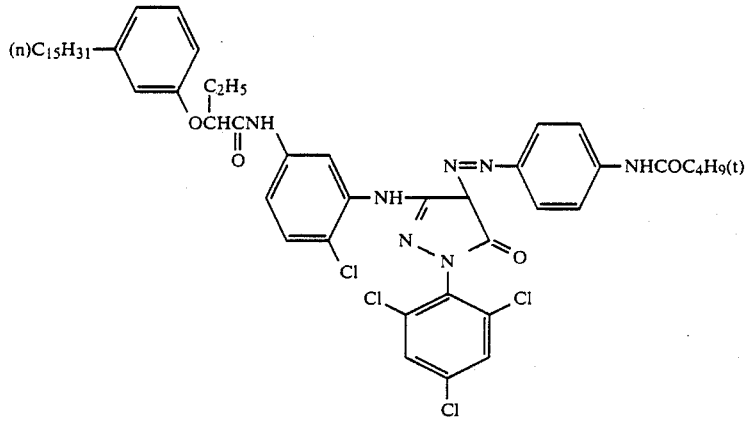
ExC-1
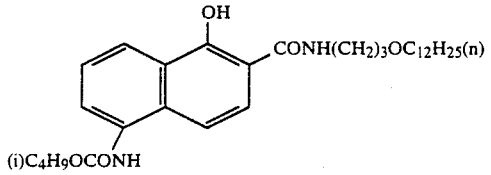
ExC-2
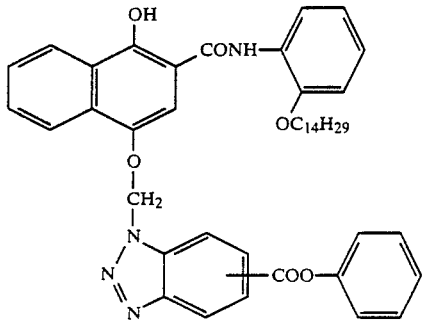
ExC-3
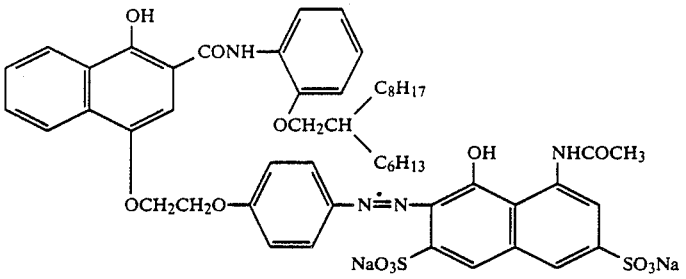
ExC-6
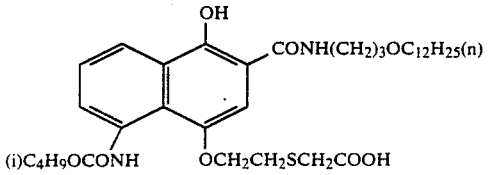
ExC-4
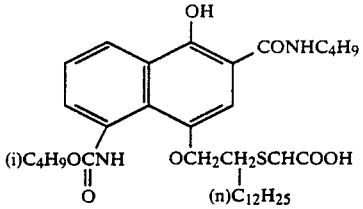

TABLE E-continued
ExC-5
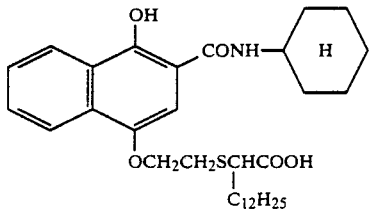
ExM-1
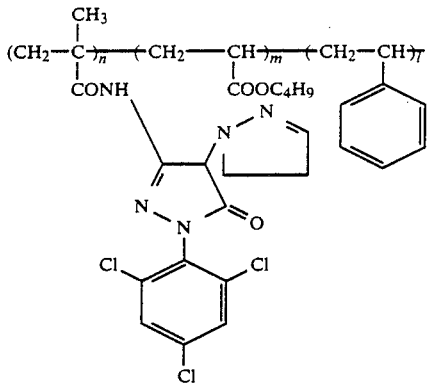
n:m:l = 2:1:1 (weight ratio)
average molecular weight 40,000
ExM-2
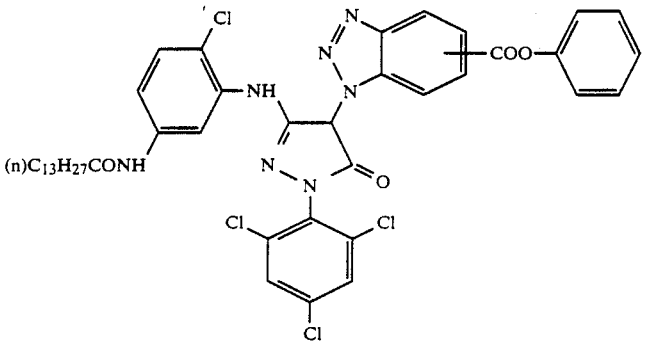
ExM-4
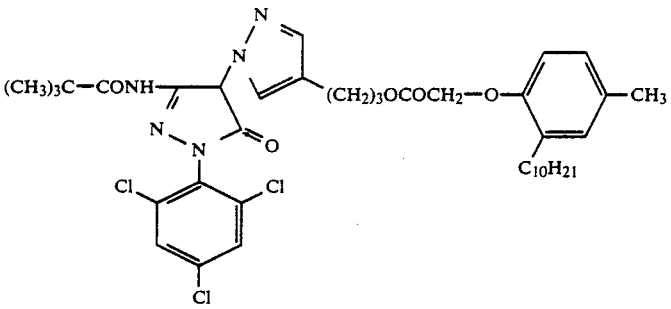
ExM-5
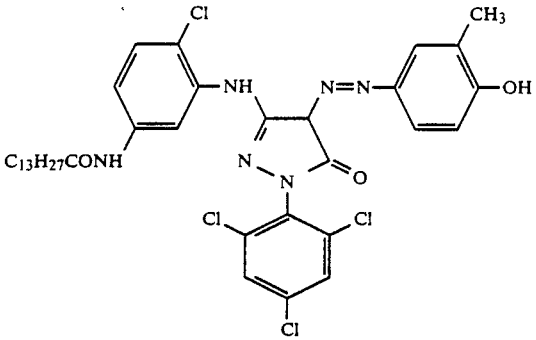

TABLE E-continued
ExY-1
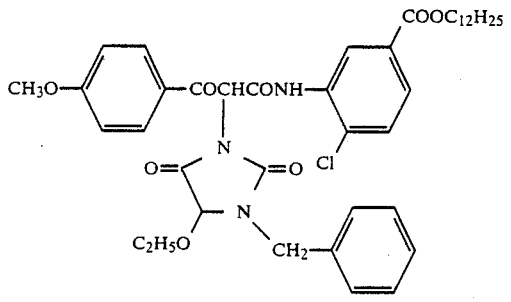
ExY-2
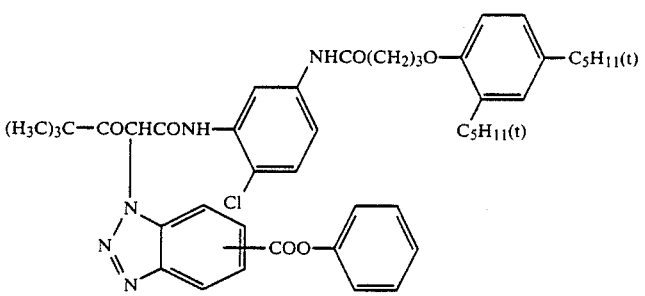
ExS-1
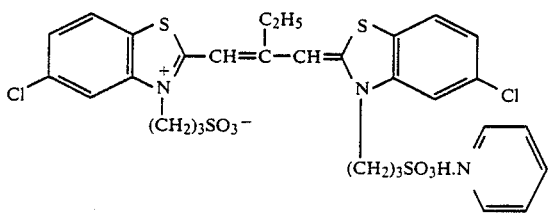
ExS-2
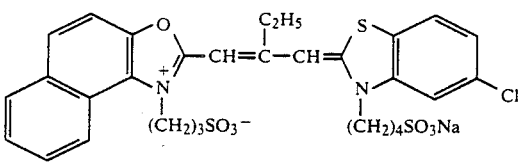
ExS-3
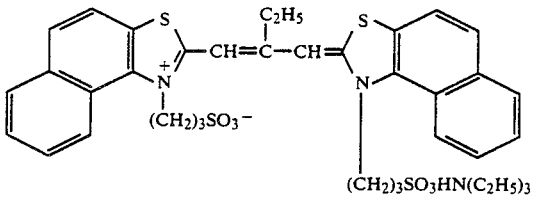
ExS-4
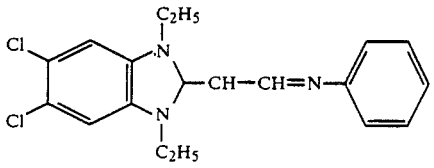
ExS-5
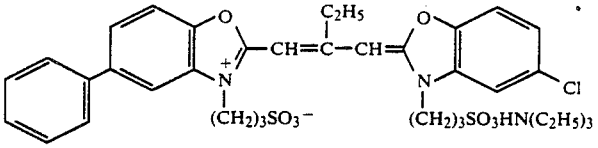

TABLE E-continued
ExS-6
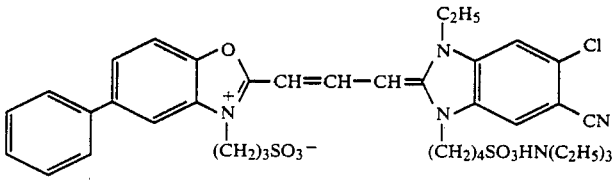
ExS-8
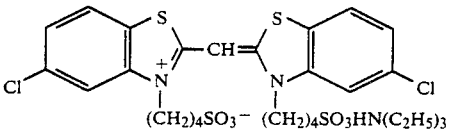
ExS-7
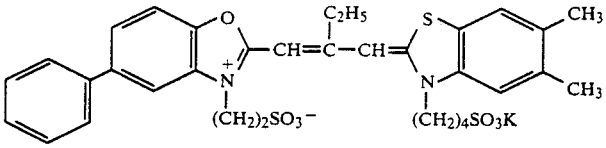
Solv-1
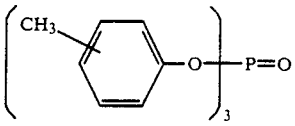
Solv-2
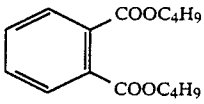
Solv-3
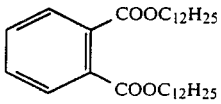
Solv-4
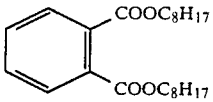
Solv-5
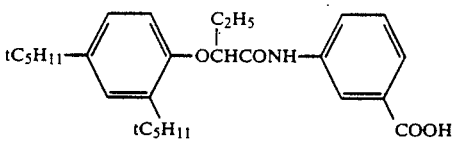
Cpd-1
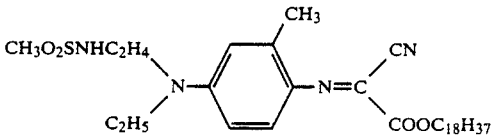
Cpd-2
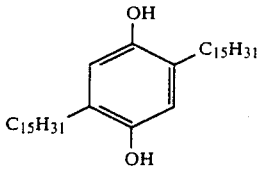
Cpd-3
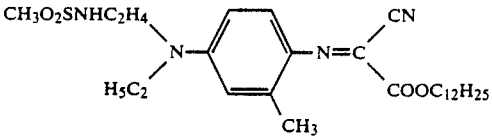

TABLE E-continued
Cpd-4
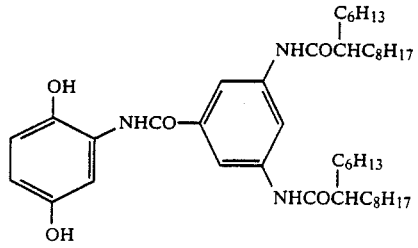
Cpd-5
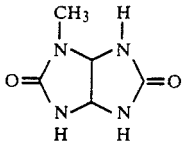
W-1
$C_8F_{17}SO_2NHCH_2CH_2CH_2OCH_2CH_2N^+(CH_3)_3$
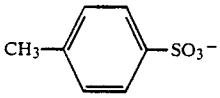
H-1
$CH_2{=}CHSO_2CH_2CONH{-}CH_2$
$CH_2{=}CHSO_2CH_2CONH{-}CH_2$
TABLE F
UV-1
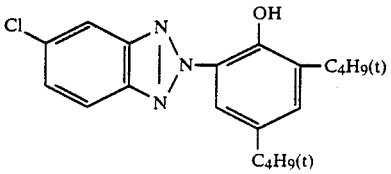
UV-2
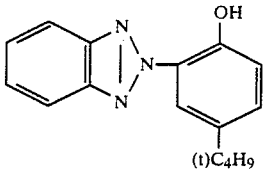
UV-3
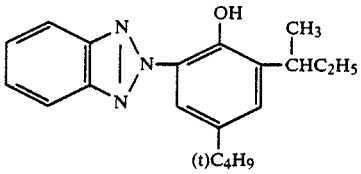
UV-4
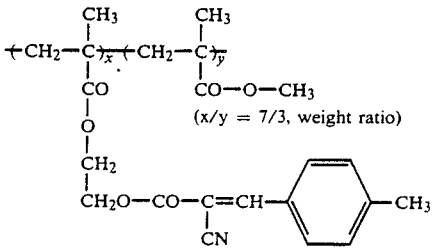
(x/y = 7/3, weight ratio)
UV-5
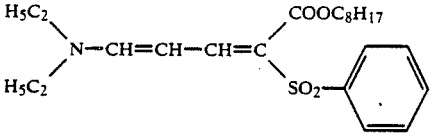

TABLE F-continued
tricresyl phosphate — Solv-1
Solv-2
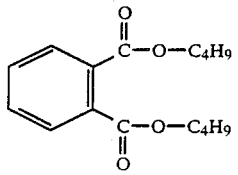
Solv-4
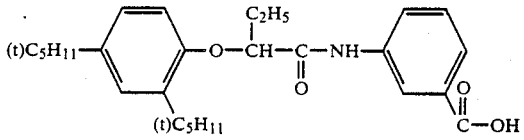
trihexyl phosphate — Solv-5
ExF-1
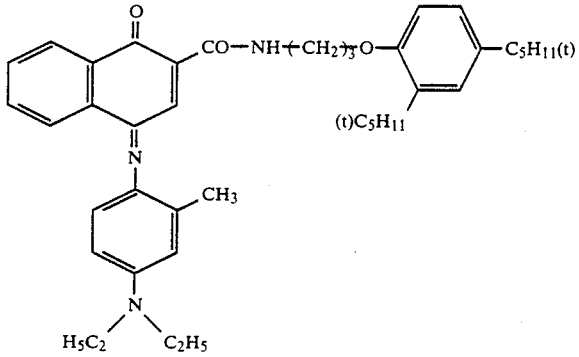
ExF-2
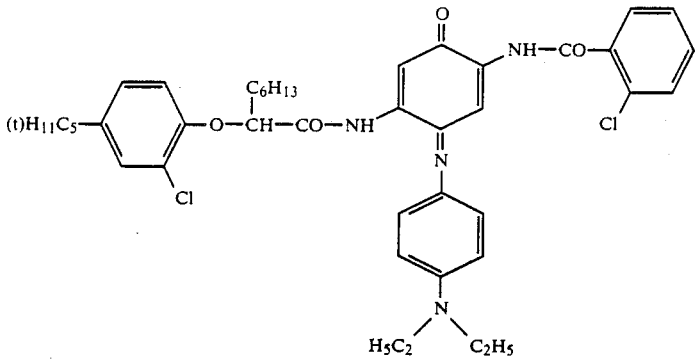
ExS-1
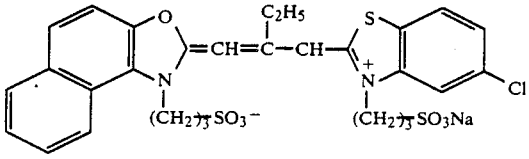
ExS-2
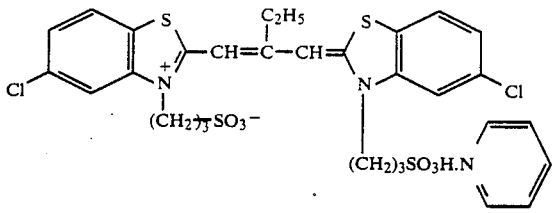

TABLE F-continued
ExS-3
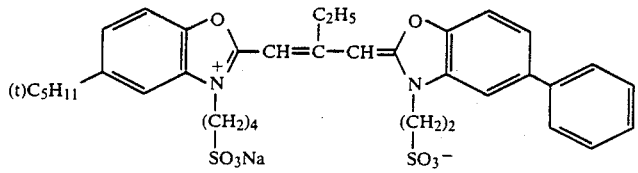
ExS-4
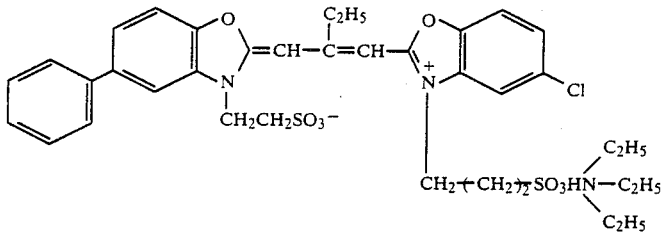
ExS-5
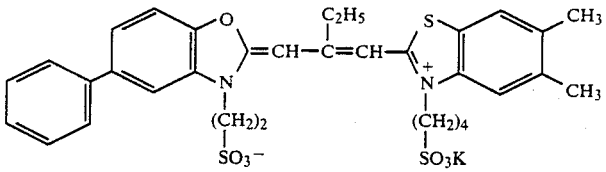
ExS-6
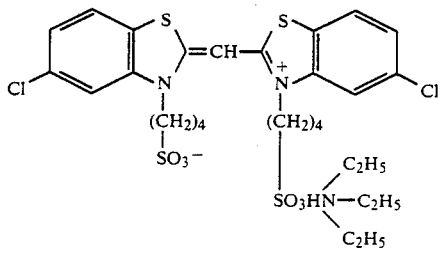
ExS-7
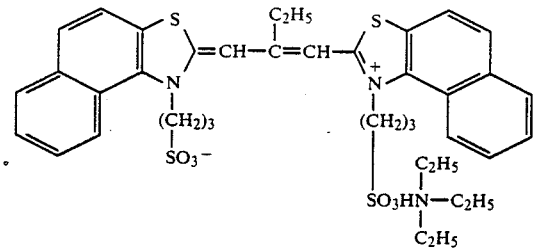
ExS-8
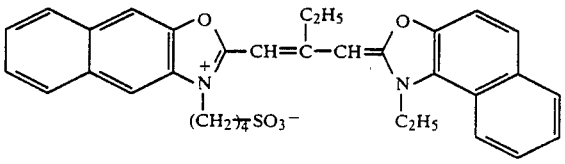
ExC-1
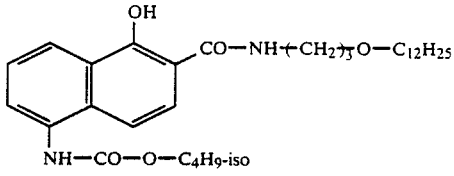

TABLE F-continued
ExC-2
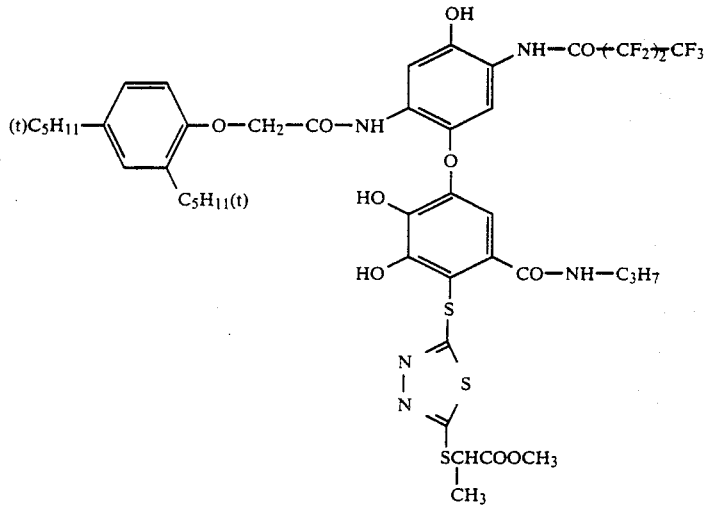
ExC-3
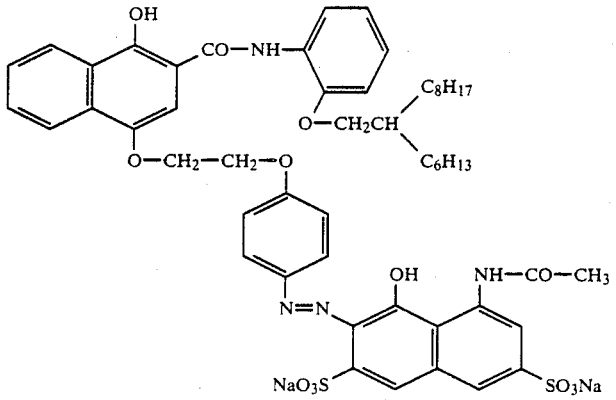
ExC-4
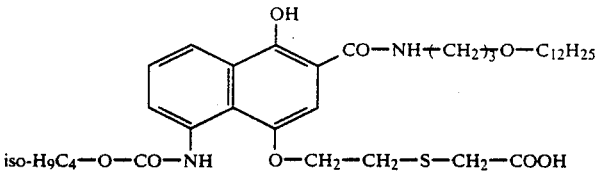
ExM-5
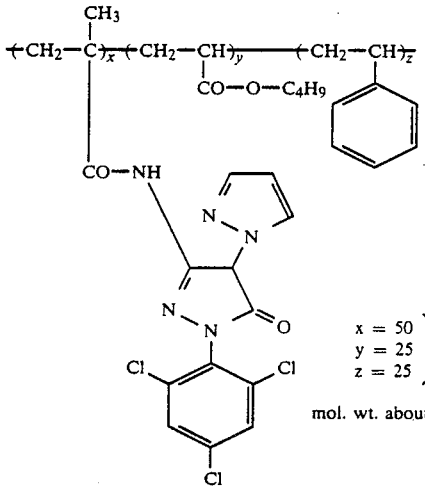
x = 50
y = 25
z = 25
weight ratio
mol. wt. about 20,000

TABLE F-continued
ExM-6
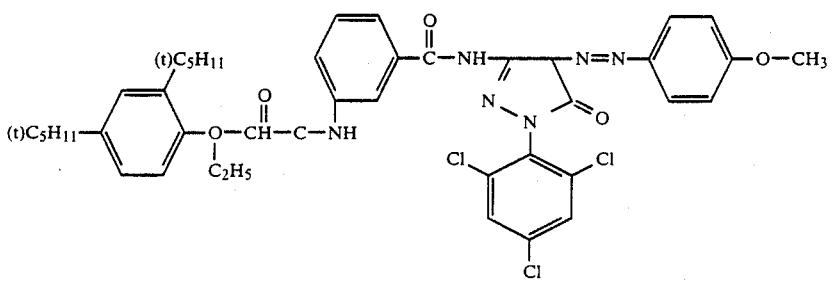
ExM-7
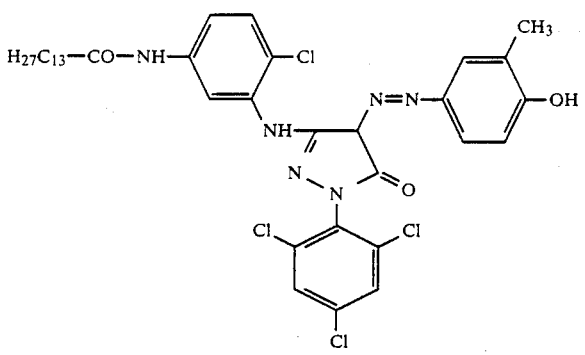
ExM-10
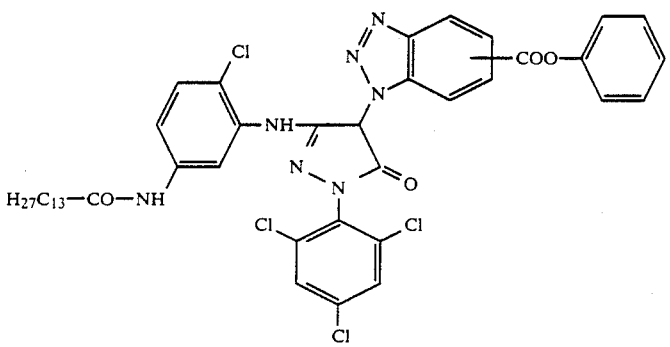
ExY-8
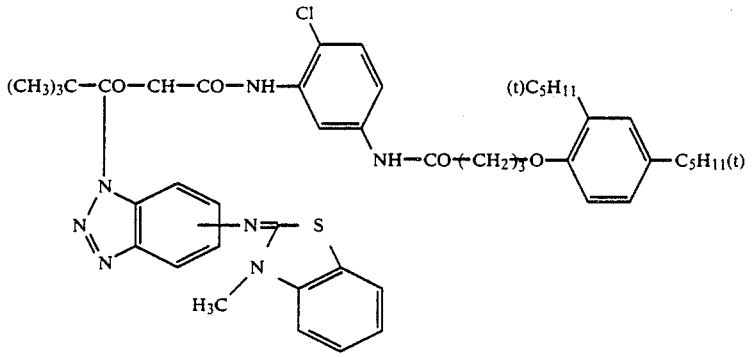
ExY-9
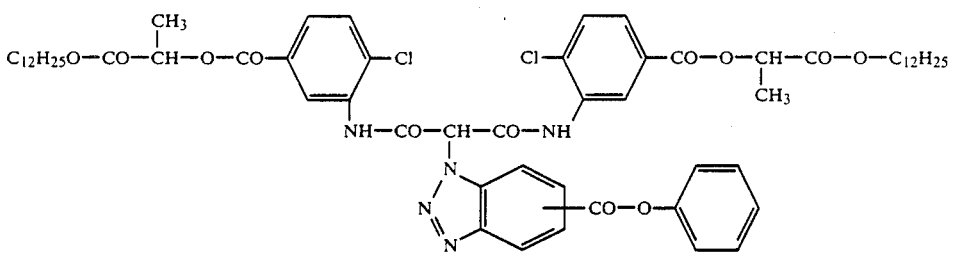

TABLE F-continued
ExY-11
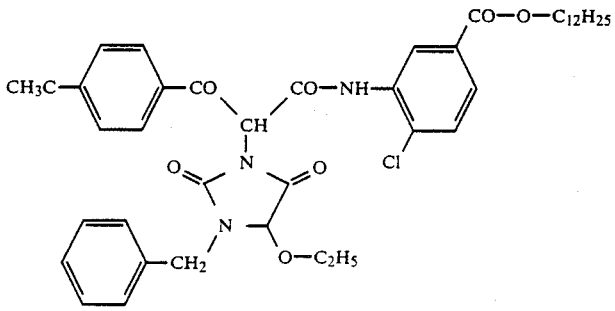
ExY-12
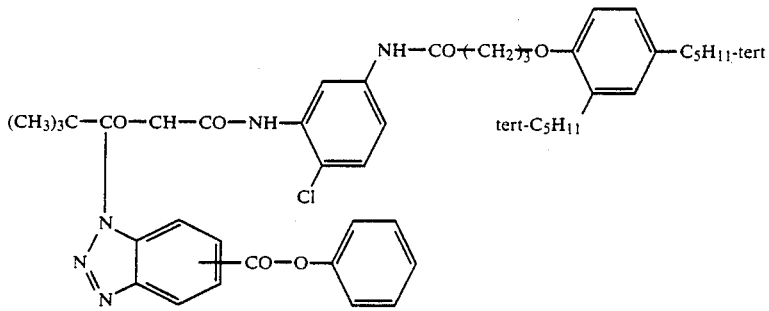
Cpd-7
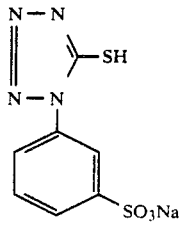
Cpd-1
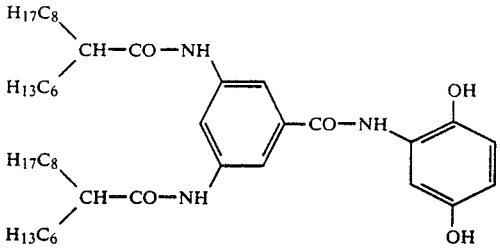
Cpd-2
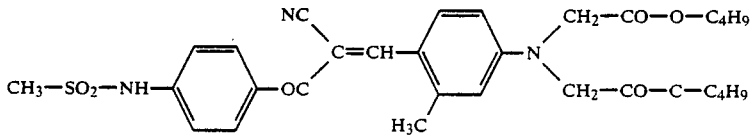
Cpd-6
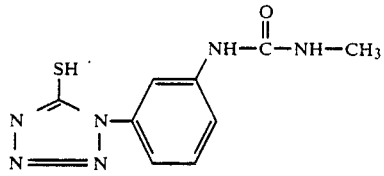
H-1
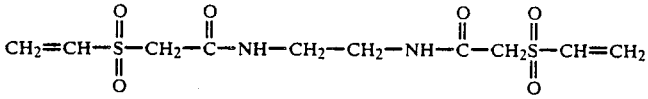

TABLE F-continued

| | |
|---|---|
| 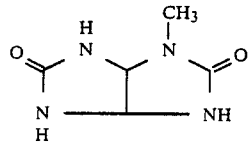 | Cpd-5 |
| 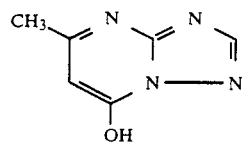 | Cpd-3 |
| 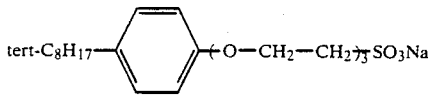 | Cpd-4 |

What is claimed is:

1. A silver halide emulsion manufactured by performing reduction sensitization during precipitation of silver halide grains by adding at least one compound selected from the group consisting of compounds represented by formulas (I), (II), and (III):

$$R—SO_2S—M \quad (I)$$

$$R—SO_2S—R^1 \quad (II)$$

$$RSO_2S—L_m—SSO_2—R^2 \quad (III)$$

wherein R, $R^1$, and $R^2$ can be the same or different and represent an aliphatic group, an aromatic group, or a heterocyclic group, M represents a cation, L represents a divalent bonding group, m represents 0 or 1, compounds represented by formulas (I) to (III) can be polymers containing, as a repeating unit, divalent groups derived from compounds represented by formulas (I) to (III), and, R, $R^1$, $R^2$ and L can be bonded with each other to form a ring, wherein not less than 50% of a total projected area of all silver halide grains are occupied by tabular grains having an aspect ratio of not less than 3.0.

2. The emulsion as in claim 1, wherein not less than 50% of a total projected area of all silver halide grains are occupied by tabular grains having an aspect ratio of 3 to 8.

3. A silver halide color photographic light-sensitive material comprising a support having thereon at least one silver halide emulsion layer comprising a silver halide emulsion reduction sensitized during precipitation of silver halide grains in the presence of at least one compound represented by formulas (I), (II), and (III):

$$R—SO_2S—M \quad (I)$$

$$R—SO_2S—R^1 \quad (II)$$

$$RSO_2S—L_m—SSO_2—R^2 \quad (III)$$

wherein R, $R^1$, and $R^2$ can be the same of different and represent an aliphatic group, an aromatic group, or a heterocyclic group, M represents a cation, L represents a divalent bonding group, m represents 0 or 1, compounds represented by formulas (I) to (III) can be polymers containing, as a repeating unit, divalent groups derived from compounds represented by formulas (I) to (III), and R, $R^1$, $R^2$ and L can be bonded with each other to form a ring, in which at least 50% of a total projected area of all silver halide grains in the emulsion layer are occupied by tabular silver halide grains and an average aspect ratio of the tabular silver halide grains occupying 50% is not less than 3.0.

4. The silver halide color photographic light-sensitive material as in claim 3, wherein the average aspect ratio of said tabular silver halide grains is 3 to 20.

5. The silver halide color photographic light-sensitive material as in claim 3, wherein the average aspect ratio of said tabular silver halide grains is 4 to 15.

6. The silver halide color photographic light-sensitive material as in claim 3, wherein the average aspect ratio of said tabular silver halide grain is 5 to 10.

7. The silver halide color photographic light-sensitive material as in claim 3, wherein tabular silver halide grains having an average aspect ratio of 3 to 20 occupies not less than 70% of a total projected surface area of all silver halide grains.

8. The silver halide color photographic light-sensitive material as in claim 1, wherein during reduction sensitization a reduction sensitizer is selected from the group consisting of stannous chloride, thiourea dioxide and dimethylamineborane.

9. The silver halide color photographic light-sensitive material as in claim 8, wherein the reduction sensitizer is present in an amount of $10^{-7}$ to $10^{-3}$ per mol of silver halide.

10. The silver halide color photographic light-sensitive material as in claim 1, wherein R, $R^1$, and $R^2$ are each independently an aliphatic group which is an alkyl group having 1 to 22 carbon atoms or an alkenyl or alkynyl group having 2 to 22 carbon atoms.

11. The silver halide color photographic light-sensitive material as in claim 1, wherein R, $R^1$, and $R^2$ are each independently an aromatic group having 6 to 20 carbon atoms.

12. The silver halide color photographic light-sensitive material as in claim 1, wherein R, $R^1$, and $R^2$ are each a heterocyclic group comprising a 3 to 15 membered ring having at least one element of nitrogen, oxygen, sulfur, selenium and tellurium and at least one carbon atom.

13. The silver halide color photographic light-sensitive material as in claim 1, wherein the divalent bonding group includes an atom or an atomic group containing at least one of C, N, S or O.

14. The silver halide color photographic light-sensitive material as in claim 1, wherein L represents a divalent aliphatic group or a divalent aromatic group.

15. The silver halide color photographic light-sensitive material as in claim 1, wherein M is a metal ion or an organic cation.

16. The silver halide color photographic light-sensitive material as in claim 1, wherein a compound represented by formulas (I) to (III) in a polymer having a repeating unit selected from the group consisting of

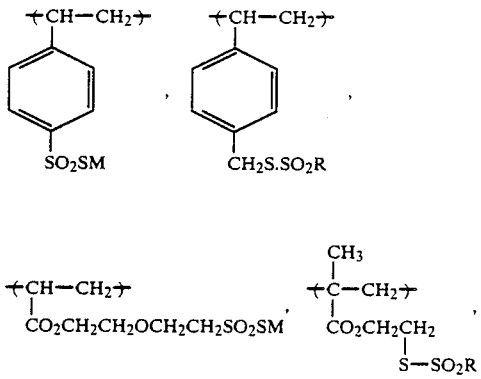

-continued and 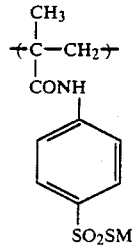

17. The silver halide color photographic light-sensitive material as in claim 1, wherein the compounds represented by formulas (I), (II) or (III) are present in an amount of $10^{-7}$ to $10^{-1}$ mol per mol of silver halide.

18. A method of manufacturing a silver halide emulsion, which comprises performing reduction sensitization during precipitation of silver halide grains by adding at least one compound selected from the group consisting of formulas (I), (II) and (II):

$$R—SO_2S—M \quad (I)$$

$$R—SO_2S—R^1 \quad (II)$$

$$RSO_2S—L_m—SSO_2—R^2 \quad (III)$$

wherein R, $R^1$, and $R^2$ can be the same of different and represent an aliphatic group, an aromatic group, or a heterocyclic group, M represents a cation, L represents a divalent bonding group, m represents 0 or 1, compounds represented by formulas (I) to (III) can be polymers containing, as a repeating unit, divalent groups derived from compounds represented by formulas (I) to (III), and, R, $R^1$, $R^2$ and L can be bonded with each other to form a ring.

* * * * *